US011805950B2

(12) United States Patent
Hodossy et al.

(10) Patent No.: US 11,805,950 B2
(45) Date of Patent: Nov. 7, 2023

(54) ADAPTOR ASSEMBLY FOR A FLUID DISPENSING SYSTEM

(71) Applicant: Essity Hygiene and Health Aktiebolag, Gothenburg (SE)

(72) Inventors: Sofia Hodossy, Gothenburg (SE); Agne Svedberg, Borlänge (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 18/022,850

(22) PCT Filed: Oct. 14, 2020

(86) PCT No.: PCT/EP2020/078958
§ 371 (c)(1),
(2) Date: Feb. 23, 2023

(87) PCT Pub. No.: WO2022/078597
PCT Pub. Date: Apr. 21, 2022

(65) Prior Publication Data
US 2023/0255411 A1 Aug. 17, 2023

(51) Int. Cl.
*A47K 5/12* (2006.01)

(52) U.S. Cl.
CPC ..... *A47K 5/1207* (2013.01); *A47K 5/1209* (2013.01)

(58) Field of Classification Search
CPC ..... A47K 5/1207; A47K 5/1209
(Continued)

(56) References Cited

U.S. PATENT DOCUMENTS 6,929,155 B1 8/2005 Sayers
7,798,370 B2 * 9/2010 Ciavarella ..... A47K 5/1204 222/153.09

(Continued)

FOREIGN PATENT DOCUMENTS

EP 2294958 A2 3/2011
EP 3539432 A1 9/2019

(Continued)

OTHER PUBLICATIONS

International Search Report & Written Opinion for International Application No. PCT/EP2020/078958; International Filing Date: Oct. 14, 2020; dated Jul. 2, 2021; 15 pages.

*Primary Examiner* — Lien M Ngo
(74) *Attorney, Agent, or Firm* — CANTOR COLBURN LLP

(57) ABSTRACT

An adaptor assembly for use in a dispenser for a replaceable fluid container comprising a fluid pump. The adapter assembly is used in the dispenser to allow using a fluid container having a pump being actuated by laterally compressing it. The adaptor assembly comprises a fluid container support for supporting the fluid container in a desired position in the dispenser and actuation parts having actuation heads being movable between non-actuated and actuated positions. The actuation heads have contact surfaces for abutting dolly surfaces and the pump. The contact surfaces abut against the dolly surfaces in the non-actuated and actuated positions. A moving part is displaceable between a lower and upper position. A horizontal plane through the actuation heads in their fully actuated positions intersects portions of the dolly surfaces that are in contact with the contact surfaces. A fluid dispensing system and a dispenser are also disclosed.

27 Claims, 25 Drawing Sheets

(58) Field of Classification Search
USPC ..... 222/181.3, 183, 181.1, 181.2, 52, 63, 222/182, 207
See application file for complete search history.

(56) References Cited

U.S. PATENT DOCUMENTS

| | | | | |
|---|---|---|---|---|
| 8,851,331 | B2 * | 10/2014 | Pelkey | A47K 5/1202 222/289 |
| 10,653,277 | B2 * | 5/2020 | Harris | A47K 5/1207 |
| 2012/0080452 | A1 * | 4/2012 | Boshuizen | A47K 5/1207 222/1 |
| 2014/0203045 | A1 * | 7/2014 | Mann | A47K 5/1211 222/181.3 |
| 2017/0100001 | A1 * | 4/2017 | Tojek | E05B 13/002 |
| 2017/0251884 | A1 * | 9/2017 | Carignan | A47K 5/1217 |
| 2019/0076864 | A1 * | 3/2019 | Nilsson | B05B 11/1077 |
| 2020/0197966 | A1 * | 6/2020 | Marshall | B05B 11/0054 |
| 2020/0292366 | A1 * | 9/2020 | Ophardt | A47K 5/1217 |
| 2023/0180971 | A1 * | 6/2023 | Crismann | A47K 5/12 222/207 |

FOREIGN PATENT DOCUMENTS

| | | | |
|---|---|---|---|
| WO | 2009104992 | A1 | 8/2009 |
| WO | 2011133077 | A1 | 10/2011 |
| WO | 2011133085 | A1 | 10/2011 |
| WO | WO 2011133085 | A1 * | 10/2011 |

* cited by examiner

ADAPTOR ASSEMBLY FOR A FLUID DISPENSING SYSTEM

CROSS REFERENCE TO RELATED APPLICATIONS

This application is a National Stage application of PCT/EP2020/078958, filed Oct. 14, 2020, which is incorporated by reference in its entirety herein.

TECHNICAL FIELD

The present disclosure generally relates to fluid dispensing systems for dispensing skincare and cleaning products such as soaps, gels, disinfectants and the like. The disclosure is specifically directed to dispenser adaptor assemblies to be used in the fluid dispensing system to allow the use of multiple types of disposable fluid dispensing packages of refill containers and fluid pumps in a dispenser. The disclosure is also directed to a dispenser.

BACKGROUND

Fluid dispensers of various types are known. In particular, for dispensing of cleaning products such as soaps and hand sanitizers, there are a wide variety of manually or automatically actuated pumps that dispense a given quantity of the product into a user's hand.

Consumer products may include a dispensing outlet as part of the package, actuated by a user pressing down the top of the package. Such packages use a dip tube extending below the level of the liquid and a piston pump that aspirates the liquid and dispenses it downwards through an outlet spout.

Commercial dispensers frequently use inverted disposable containers that can be placed in dispensing devices, affixed to walls or built into the counter of washrooms or the like. The pump may be integrated as part of the disposable container or may be part of the permanent dispensing device or both forming a fluid dispensing package. Such devices are robust and, if they are affixed to the wall, greater freedom is available in the direction and amount of force that is required for actuation. Such devices may also use sensors that identify the location of a user's hand and cause a unit dose of the product to be dispensed. This avoids user contact with the device and the associated cross-contamination. It also prevents incorrect operation that can lead to damage and premature ageing of the dispensing mechanism.

One dispensing system that uses a pump to dispense a unit dose of liquid from an inverted collapsible container has been described in WO2009/104992. The pump is formed of just few elements with a resilient pumping chamber and regulator valves. Operation of the pump occurs by application of a lateral force to the pumping chamber, causing it to partially collapse and expel its contents through the outer valve. Refilling of the pumping chamber occurs through the inner valve once the lateral force is removed. The filling force is provided by the inherent resilience of the wall of the pumping chamber, which is enough to overcome any backpressure due to a resistance to collapse of the container.

Other dispensing systems use an axial force for actuation of the pump i.e. directed in alignment with the direction in which the fluid is dispensed.

In many cases different dispensing systems with different types of fluid dispensing packages with the different pump types may be used at given location, e.g. a building may have a mixture of dispensers for use with different dispensing packages, in turn requiring having the different types of fluid dispensing packages in stock instead of just having one type in the stock. Consequently, it would be desirable to provide a dispensing system that could operate in different operating dispensing solutions, e.g. in axially operating dispensing solutions as well laterally operating dispensing solutions.

SUMMARY

It is desirable to have a dispensing system that is flexible in its operating manner and reliable when used to allow different types of fluid dispensing packages, yet simple, hygienic, environmentally acceptable and economical to produce.

The disclosure relates in particular to adaptor assemblies, a fluid dispensing system, and a dispenser. Embodiments are set forth in the following description and in the drawings.

Thus, there is disclosed an adaptor assembly for use in a dispenser for a fluid dispensing package of a replaceable fluid container comprising a fluid reservoir and a fluid pump. The dispenser comprises a housing and a compartment therein for containing the fluid container. The dispenser has a front portion, a rear portion, and upper and lower end portions. The lower end portion forms a dispensing end portion of the dispenser and comprising an actuator, which is displaced directly by a user or displaced via a motor for operating the dispenser to dispense a dose of a fluid from the fluid container through a nozzle at the lower end portion.

The compartment of the dispenser is sized to receive a fluid container having a pump of a first type being an axially compressible pump and the actuator has a lifter for actuating the pump of the first type by axially compressing it in a vertical direction, The adapter assembly is used in conjunction with the dispenser to allow a use of a fluid container having a pump of a second type within the dispenser, the second type being actuated by laterally compressing it. The adaptor assembly is configured for removably connect it to the dispenser and the fluid container.

The adaptor assembly comprises a fluid container support configured to be received in the compartment of the dispenser for holding and/or supporting the fluid container having the pump of a second type in a desired position in the compartment of the dispenser.

The adaptor assembly comprises a first actuation part including a first actuation head being movable between a non-actuated position and a fully actuated position, wherein the first actuation head comprises a first contact surface for abutting against a first dolly surface and a second contact surface for abutting against the pump of the second type.

The adaptor assembly further comprises second actuation part including a second actuation head being movable between a non-actuated position and a fully actuated position, wherein the second actuation head comprises a first contact surface for abutting against a second dolly surface and a second contact surface for abutting against the pump of the second type.

The first contact surfaces of the first and second actuation heads abut against the first and second dolly surfaces in the non-actuated and the fully actuated positions.

The adaptor assembly also comprises a moving part being displaceable between a lower position and an upper position, wherein a displacement of the moving part from the lower position to the upper position moves the first and second actuation heads from their non-actuated position towards the fully actuated positions.

The lifter engages and acts on the moving part, when the adaptor assembly is mounted in the dispenser, wherein a lifting force (P) applied by the lifter on the moving part displaces the moving part between from its lower position to and an upper position, thereby transferring an actuation force (TF) from the moving part via the actuation heads to the pump of the fluid container, when mounted in the compartment, wherein the pump of the second type is laterally compressed to cause fluid to be dispensed from the fluid container.

A horizontal plane (H1-H3) through the first and second actuation heads in their fully actuated positions intersects portions of the first and second dolly surfaces that are in contact with portions the first contact surfaces of the actuation heads.

The horizontal plane (H1-H3) may intersect portions of the second contact surfaces that are in contact with the pump of the second type.

By these having these contact points, a good force transfer from the lifter 124 to the pump 300*b* for dispensing a dose of a fluid is secured.

As used herein, the terms "horizontal", "lateral" and "vertical", "uppermost" and "lowermost", "downwards" and "upwards", "front" and "rear", and "upper" and "lower" or the like are to be understood as seen when a dispensing system with a dispenser and a fluid container is arranged for use, with or without the adaptor assembly.

The lifting force (P) that is applied by the lifter in the moving part may be an axial force. As used herein, by an axial or vertical force for actuation of the pump is understood to be a force directed in alignment with the direction in which the fluid is dispensed. Similarly, by a lateral force is understood to be a force substantially perpendicular to the direction in which the fluid is dispensed.

The fluid container may be adapted to be filled with a liquid such as for instance liquid soap, foam soap, alcogel, disinfecting or anti-bacterial liquid, or lotion. The flexible dispensing portion may be filled with the relevant liquid and subjected to an external force in order to dispense the liquid therefrom. The pumps described herein may be of such a size that a suitable or desired volume of around 0.5 to 1 ml, e.g. 0.6 to 0.9 ml, of the liquid may be dispensed upon performing a full dispensing stroke. The volume dispensed depends on the fluid type to be dispensed and the materials the adapter assembly are made of.

Suitable materials for forming the adaptor assembly may be aluminum or any suitable plastics such as polyoxymethylene (POM), polyamide 12 (PA 12) and olefin plastics, e.g. polyethylene or polypropylene. The adaptor assembly may be formed by injection molding, 3D printing or any other suitable method known to the skilled person. The mentioned materials and forming of the assembly can be used for all parts of the adaptor assembly and a combination of the materials may also be considered for adaptor assembly or parts thereof.

As used herein, the term adaptor or adaptor assembly is a device that converts attributes of the dispensing system or dispenser to those of an otherwise incompatible replaceable fluid container of the fluid dispensing system. The adaptor assembly should be configured for removably connect it to the dispenser and the fluid container having the pump of a second type. By removably connected here means that the adaptor assembly can be easily connected and removed from the dispenser without affecting the properties the dispenser has without the adaptor assembly.

Thus, the adaptor assembly allows for a dispensing system that could operate in different operating dispensing solutions, i.e. in axially operating dispensing solutions as well lateral operating dispensing solutions. The adaptor assembly makes the dispensing system flexible in its use and reliable when used so as to allow the use of different types of fluid dispensing packages, and yet being simple, hygienic, environmentally acceptable and economical to produce.

As mentioned hereinabove, the actuator having the lifter may be of the type that is displaced directly by a user or it may be of the type displaced via a motor for operating the dispenser to dispense a dose of a fluid from the fluid container through a nozzle at the lower end portion. If the actuator is of the type that is directly displaced by a user, it may be a user lever configured to pivot about a pivot. The user lever may then extend from the pivot towards a user operating portion of the user lever, wherein the user actuator has the lifter extending into the compartment of the dispenser to act on the moving part.

The moving part may be configured to at least partly be enclosed by a pump engagement portion of the lifter. The moving part may be configured to at least partly engage the engagement portion of the lifter in a form-fit manner.

This provides for a proper engagement between the lifter and the moving part and such a lifter may be suitable to be operably connected to a motor for operating the dispensing of a fluid.

The fluid container support may form an upper part of the actuator assembly and the moving part may form a lower part of the adaptor assembly, wherein the moving part is movably connected to the fluid container support. The first and second actuation parts may connect the fluid container support to the moving part.

The first and second dolly surfaces may form elongated sliding surfaces, against which the first contact surfaces of the actuation parts abut and along which the first contact surfaces slide or move, when the moving part is displaced from its lower position to its upper position.

The fluid container support may have a vertically extending through-opening for receiving a portion of the fluid container, wherein the through-opening extends to the front and present a front opening of the fluid container support to the surroundings.

This opening provides an easy assembly of the dispensing system and does not require the removal of the adaptor assembly from the dispenser, when the fluid container needs to be replaced.

The moving part may have a through-opening extending from the upper part to the lower part of the moving part. The through-opening may be configured to at least partly receive the pump of the second type.

The moving part may have an access opening at an upper front portion thereof to access the through-opening from the front portion, wherein the access opening forms a continuous opening with the through-opening at the upper portion of the moving part.

The moving part may have an access cavity is formed at an inner portion of the moving part that is located below the access opening and faces the through-opening of the moving part.

The openings as well as the access cavity provide an even easier assembly of the dispensing system and does not require the removal of the adaptor assembly from the dispenser, when the fluid container needs to be replaced.

The first and second dolly surfaces may form part of the moving part. The dolly surfaces may be arranged on opposite sides of the through-opening of the moving part and face each other. The dolly surfaces may then extend with oblique angles downwards and inwards in directions ($C_1$; $C_2$) towards each other to form a tapering cavity portion therebetween.

The provision of the dolly surfaces as described hereinabove provide a proper counter force to the actuation heads for providing a proper dispensing action, when they are moved from their non-actuated positions to their actuated positions. The first contact surfaces may abut against and slide along the dolly surfaces upon a displacement of the moving part between the lower position to the upper position. The inclined dolly surfaces allow for moving the actuation heads inwardly against the pump upon the displacement of the moving part towards an upper position.

Each one of the first and second actuation parts may comprise an elongated arm extending in a substantially longitudinal direction ($L_1$; $L_2$) thereof between two opposite ends of the arm. A first end may in such case be connected to the fluid container support and a second end may carry one of the two actuation heads, wherein he actuation head is movable between the non-actuated position and the fully actuated position.

The elongated arm with the actuation head provides a flexible and reliable actuation part that may be shaped and dimensioned to the desired use, e.g. it may be shaped and dimensioned for a desired volume to be dispensed.

The actuation parts may be movably connected to the fluid container support arms for allowing said movements of the actuation head between the non-actuated positions and the fully actuated positions. For example, each actuation part may be pivotally attached to the fluid container support and configured to pivot about a pivot.

This allows the actuation heads to move between non-actuated positions and actuated positions in a substantially lateral direction towards the pump. The pivot may be formed by a snap connection between the first connecting support and the actuation part, or it can, for example, be formed by a hinge connection or by a living hinge.

According another embodiment, the elongated arms may be flexible arms for allowing said movements of the actuation head between the non-actuated positions and the fully actuated positions.

This allows the actuation heads to move between their non-actuated positions and actuated positions in substantially lateral movements toward the pump. The arms may be fixedly connected to the first connecting support and in part or completely be made flexible from the non-actuated position to the fully actuated position. The skilled person appreciates that the arms may be made flexible by using an elastic and flexible plastic material of, for example, polyoxymethylene (POM) or olefin plastics such as polypropylene and by selecting shapes and dimensions suitable for the purpose.

According to yet another embodiment, the actuation heads may be movably connected to the respective arms of the actuation parts.

As mentioned hereinabove, there are some suitable materials for forming the adaptor assembly. The actuation parts may contain or be made of polyoxymethylene (POM). POM is a rather stiff plastic material that may be used to provide the flexible arms with proper flexibility and spring force to support functionality and structure of the adaptor assembly and to support the return of the actuation heads from their actuated positions to the non-actuated positions, i.e. towards the rest positions the arms have, as well as to support the return of the moving part to its lower position, when the moving part has been moved to an upper position and is movably connected to the actuation parts. Furthermore, by making the actuation heads of POM, there are provided good sliding properties between the first contact surfaces of the actuation heads and the dolly surfaces.

The fluid container support may contain or be made of polyoxymethylene (POM).

The moving part may contain or be made of olefin plastics such as polyethylene and/or polypropylene. In the case the moving part includes the dolly surfaces, the olefin plastics would provide good sliding properties between the dolly surfaces and the first contact surfaces of the actuation heads, e.g. when the latter are made of POM.

The pump of the second type may have a resilient pumping chamber. The resilient pumping chamber may be an elongated and elastic tube chamber extending downwards at the lower portion of the fluid container in a direction from the bottom of the fluid reservoir to a nozzle of the elastic tube chamber.

The adaptor assembly may further be configured so that at least a portion of each second contact surface abuts against the pump in the non-actuated position.

The possibility of this abutment may be provided by the actuation parts having the elastic and flexible arms that keeps the actuation heads in the non-actuated position such that at least portions of the actuation heads abut against pump when inserted between the actuation heads in the adaptor assembly. This provides a reliable and effective dispensing upon actuation thereof.

The adaptor assembly may further be configured so that a portion of each second contact surface extends with angle to the vertical direction in the non-actuated position, e.g. wherein each second contact surface is convex. The convex surface may convex in a vertical direction and towards the other second contact surface. The radius (r) of the convex surface may be about 10-18 mm.

During the use of the adaptor in the dispensing system, this allows for a smooth compression and deformation of the pump from an upper portion to a lower portion thereof.

The adaptor assembly may further comprise one or more positioning means for engaging corresponding one or more connecting portions in the dispenser and preventing axial and/or rotational movement of the adaptor assembly in the dispenser, and/or for preventing wrong positioning of the adapter assembly in the dispenser.

When the adaptor assembly and the fluid container having the pump of the second type are mounted in the dispenser, the energy consumption for a dispensing cycle of dispensing a fluid, by displacing the moving part from the lowermost position to its uppermost position and returning the moving part the lowermost position, may be lower than 1100 μWh, e.g. 300 to 1000 μWh or 500 to 1000 μWh.

There is further provided an adaptor assembly for use in a dispenser for a replaceable fluid container having a fluid pump being actuated by laterally compressing it The adaptor assembly comprises an actuation part being connected to a fluid container support and movably connected to a moving part, wherein the moving part is displaceable between a lower position and an upper position.

The actuation part has an actuation head that is moveable between a non-actuated position and an actuated position, wherein the actuation head comprises a first contact surface for abutting against a dolly surface of the moving part and a second contact surface for abutting against the fluid pump, wherein the first and second contact surfaces faces away from each other.

A horizontal plane (H1-H3) through the actuation head in its fully actuated position intersects a portion of the dolly surface that is in contact with portions of the first contact surface of the actuation head.

The adaptor assembly provides all the advantages and effects as described above. Some of the features that the adaptor assembly may have are described hereinbelow, which features correspond to similar features described hereinabove and they would add similar advantages and effects as described herein. Any additional features described herein, may also be used in the adaptor assembly now described. Furthermore, the adaptor assembly now disclosed is described in relation to having an actuation part of the actuation part and a dolly surface of moving part. The adaptor assembly may comprise two actuation parts and two dolly surfaces configured in the moving part as described hereinabove and hereinbelow.

The fluid container support may have a vertically extending through-opening for receiving a portion of the fluid container, wherein the through-opening extends to the front and present a front opening of the fluid container support to the surroundings.

The moving part may have a through-opening extending from the upper part to the lower part of the moving part. The through-opening of the moving part may be configured to at least partly receive the pump of the second type.

The moving part may an access opening at an upper front portion thereof to access the through-opening of the moving part from the front portion, wherein the access opening forms a continuous opening with the through-opening at the upper portion of the moving part.

An access cavity may be formed at an inner portion of the moving part that is located below the access opening and faces the through-opening of the moving part.

The fluid container support may form an upper part of the actuator assembly and the moving part may form a lower part of the adaptor assembly.

The dolly surface may form an elongated sliding surface, against which the first contact surface of the actuation part abuts and along which the first contact surface slides or moves, when the moving part is displaced from its lower position to its upper position.

The dolly surface may form part of the moving part. The dolly surface may face the through-opening of the moving part. The dolly surface may extend with an oblique angle downwards and inwards.

The actuation part may comprise an elongated arm extending in a substantially longitudinal direction ($L_1$; $L_2$) thereof between two opposite ends of the arm, of which the first end is connected to the fluid container support, and the second end carries the two actuation head, wherein said actuation head is movable between the non-actuated position and the fully actuated position.

The actuation part is movably connected to the fluid container support, e.g. wherein the actuation part may be pivotally attached to the fluid container support and configured to pivot about a pivot.

The elongated arm may be a flexible arm for allowing said movement of the actuation head between the non-actuated position and the fully actuated position.

The actuation head may be movably connected to the arm of the actuation part.

The actuation part may contain or be made of polyoxymethylene (POM).

The fluid container support may contain or be made of polyoxymethylene (POM).

The moving part may contain or be made of olefin plastics such as polyethylene and/or polypropylene.

The pump of the second type may have a resilient pumping chamber. The resilient pumping chamber may be an elongated and elastic tube chamber extending downwards at the lower portion of the fluid container in a direction from the bottom of the fluid reservoir to a nozzle of the elastic tube chamber.

The adaptor assembly may further be configured so that at least a portion of the second contact surface abuts against the pump in the non-actuated position.

The adaptor assembly may further be configured so that a portion of the second contact surface extends with angle to the vertical direction in the non-actuated position, e.g. wherein the second contact surface may be convex. The convex surface may convex in the vertical direction. The radius (r) of the convex surface may be about 10-18 mm.

The adaptor assembly may further comprise one or more positioning means for engaging corresponding one or more connecting portions in the dispenser and preventing an axial and/or rotational movement of the adaptor assembly in the dispenser, and/or for preventing wrong positioning of the adapter assembly in the dispenser.

There is also provided an adaptor assembly for use in a dispenser for a replaceable fluid container having a pump being actuated by laterally compressing it. The adaptor assembly comprises an actuation part being connected to a fluid container support and movably connected to a moving part, wherein the moving part is displaceable between a lower position and an upper position. The fluid container support forms an upper part of the actuator assembly and the moving part forms a lower part of the adaptor assembly. The actuation part comprises an actuation head being movable between a non-actuated position and a fully actuated position, wherein the actuation head has a first contact surface for abutting against a dolly surface of the moving part and a second contact surface for abutting against a fluid pump. The actuation part contains or is made of polyoxymethylene (POM).

The adaptor assembly provides all the advantages and effects as described above. Some of the features that the adaptor assembly may have are described hereinbelow, which features correspond to similar features described hereinabove and they would add similar advantages and effects as described herein. Any additional features described herein, may also be used in the adaptor assembly now described.

Furthermore, the adaptor assembly now disclosed is described in relation to having an actuation part and a dolly surface of the actuation part. The adaptor assembly may comprise two actuation parts and two dolly surfaces configured in the moving part as described herein.

The fluid container support may contain or be made of polyoxymethylene (POM).

The moving part contains or is made olefin plastics such as polyethylene and/or polypropylene.

There is also provided adaptor assembly for use in a dispenser for a replaceable fluid container having a fluid pump being actuated by laterally compressing it. The adaptor assembly comprises an actuation part being connected to a fluid container support and movably connected to a moving part, wherein the moving part is displaceable between a lower position and an upper position. A fluid container support forms an upper part of the actuator assembly and the moving part forms a lower part of the adaptor assembly. The actuation part comprises an actuation head being movable between a non-actuated position and fully actuated position, wherein the actuation head has a first contact surface for abutting against a dolly surface of the moving part and a second contact surface for abutting against the fluid pump. The fluid container support has a vertically extending through-opening for receiving a portion of the fluid container, wherein the through-opening extends to the front and present a front opening of the fluid container support to the surroundings in the front of the adaptor assembly.

This opening provides an easy assembly of the dispensing system and does not require the removal of the adaptor assembly from the dispenser, when the fluid container needs to be replaced.

The adaptor assembly also provides all the advantages and effects as described above. Some of the features that the adaptor assembly may have are described hereinabove and they would add similar advantages and effects to the present adaptor assembly. Any additional features described herein, may also be used in the adaptor assembly now described.

Furthermore, the adaptor assembly now disclosed is described in relation to having an actuation part and a dolly surface of the actuation part. The adaptor assembly may comprise two actuation parts and two dolly surfaces configured in the moving part as described herein.

The moving part may have a vertically extending through-opening and an access opening at an upper front portion thereof to access the through-opening from the front portion, wherein the access opening forms a continuous opening with the through-opening at the upper portion of the moving part. An access cavity may be formed at an inner portion of the moving part that is located below the access opening and faces the through-opening of the moving part.

The openings as well as the access cavity provide an even easier assembly of the dispensing system and does not require the removal of the adaptor assembly from the dispenser, when the fluid container needs to be replaced.

There is also provided a fluid dispensing system for dispensing a fluid from a replaceable fluid container. The dispensing system comprises a dispenser, a fluid container, and an adaptor assembly as described hereinabove. The dispenser comprises a housing and a compartment therein for containing the fluid container, the dispenser having a front portion, a rear portion, upper and lower end portions. The lower end portion forms a dispensing end portion of the dispenser and has an actuator, by which the dispensing system is operated to dispense a dose of a fluid through a nozzle at the lower end portion. The fluid container includes a fluid reservoir and a fluid pump, wherein the fluid reservoir extends downwards from the upper portion to the fluid pump being located at the lower end portion with the nozzle arranged at the lower end of the fluid container. The compartment of the dispenser in a dispensing system without the adaptor assembly is sized to receive a fluid container having a pump of a first type being an axially compressible pump, and the actuator has a lifter for actuating the pump of the first type by axially compressing it in a vertical direction towards the upper portion. The adapter assembly adapts the compartment to be sized to receive a fluid container having a pump of a second type within the dispenser, the second type being actuated by laterally compressing it. The fluid container has a pump of the second type and the lifter of the actuator for actuating the pump of the first type also actuates the pump of the second type by displacing the lifter upwards causing it to act on the adaptor assembly so that the fluid pump of the second type to be laterally compressed.

The pump of the second type may have a resilient pumping chamber.

The resilient pumping chamber may be an elongated and elastic tube chamber extending downwards at the lower portion of the fluid container in a direction from the bottom of the fluid reservoir to a nozzle of the elastic tube chamber.

The fluid dispensing system may further comprise one or more connecting portions for engaging one or more positioning means of the adaptor assembly.

There is also provided a dispenser comprising a dispensing mechanism for a fluid container with a pump a having a resilient pumping chamber, wherein the dispensing mechanism comprises an actuation part being connected to a fluid container support and a moving part attached to the dispenser, wherein the actuation part comprises an actuation head with a first contact surface for abutting against a dolly surface of the moving part of the dispenser and a second contact surface for abutting against a fluid pump, wherein

- the actuation head is movable between a non-actuated position and a fully actuated position;
- the fluid container support is any fluid container support as described hereinabove;
- the actuation part is any actuation part as described hereinabove; and
- the moving part is any moving part as described hereinabove.

A dispenser with the dispensing mechanism allows adaptor assembly to be non-integrated or integrated part of the dispenser and at the same time providing all the advantages the use of the fluid container support, the actuation part and the moving part have as described herein.

BRIEF DESCRIPTION OF THE DRAWINGS

The features and advantages of the present disclosure will be appreciated upon reference to the following drawings of a number of exemplary embodiments, in which:

In FIG. 17B shows an exploded view of the adaptor assembly as such is shown to illustrate the operation details.

DESCRIPTION OF ILLUSTRATIVE EMBODIMENTS

In the following, the fluid dispensing system and the adaptor assembly according to the disclosure will be exemplified by a few exemplary embodiments. However, this disclosure should not be construed as limited to these exemplary embodiments. Other fluid dispensing system and adaptor assembly embodiments may also be considered within the scope of the appended claims. Disclosed features of example embodiments may be combined as readily understood by one of ordinary skill in the art to which this disclosure belongs. Like numbers refer to like elements throughout. Well-known functions or constructions will not necessarily be described in detail for brevity and/or clarity.

Figure 1:
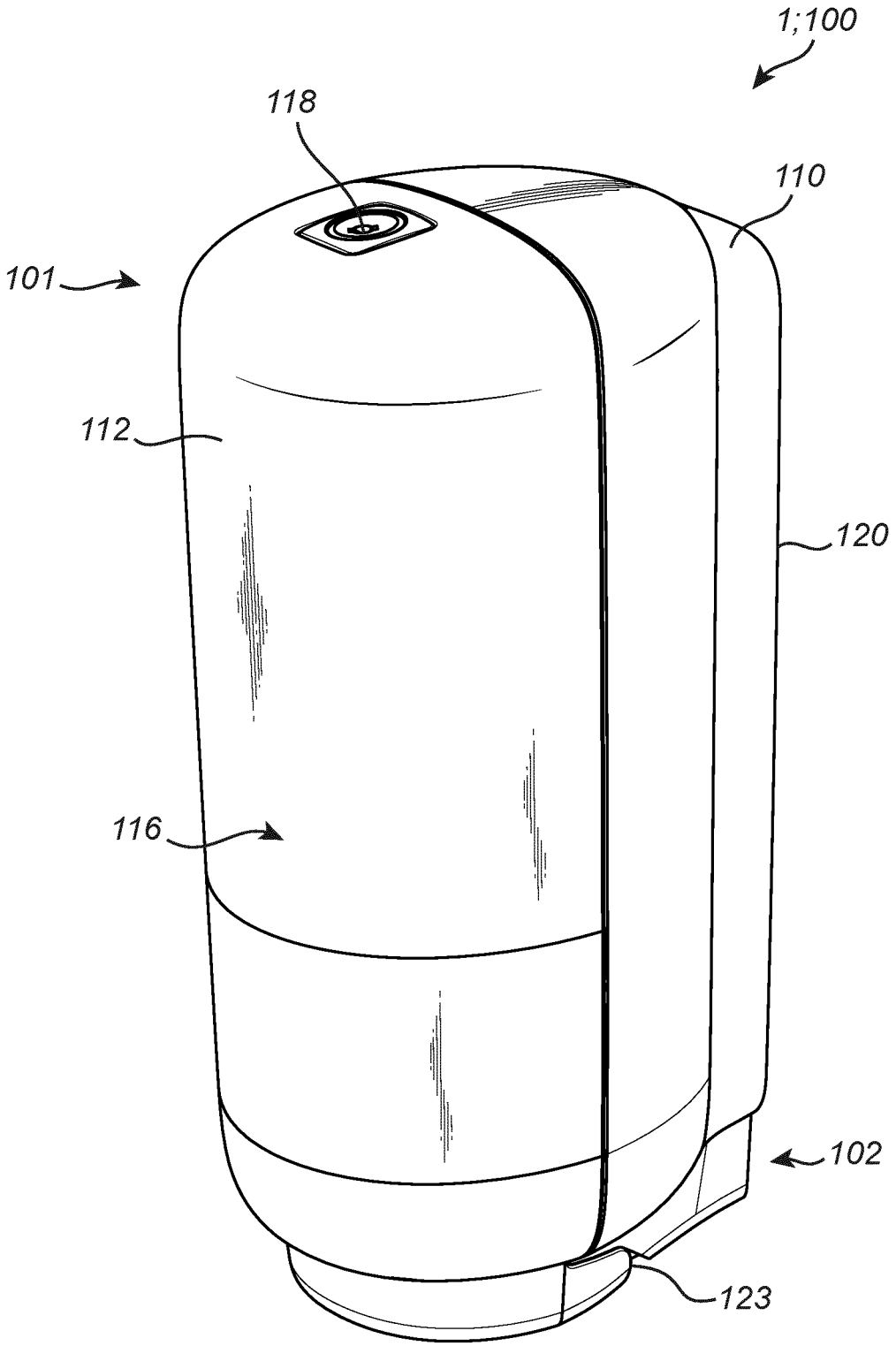
FIG. 1 shows a perspective view of a dispensing system.

FIG. 1 shows a perspective view of a fluid dispensing system 1 in which the present disclosure as claimed in the appended claims may be implemented. The dispensing system 1 includes a reusable dispenser 100 of the type used in washrooms and the like available under the name Tork™ from Essity Hygiene and Health AB. The operation the dispenser 100, as will be further described below, makes use of an automatic actuation using a motor and a sensor, but the invention is equally applicable to using a dispenser having a manual actuator, e.g. as the dispenser system described in WO2011/133085, the contents of which are incorporated herein by reference in their entirety. It will be understood that these embodiments of dispensing systems are merely exemplary and that the present disclosure may also be implemented in other dispensing systems.

The dispenser 100 includes a rear portion 110 and a front portion 112 that engage together to form a closed housing 116 that can be secured using a lock 118 at an upper end portion 101 of the dispenser 100. The housing 116 is affixed to a wall or other surface by a bracket portion 120. Ata lower end portion 102 forming a dispenser end portion of the dispenser 100 and a lower side of the housing 116 facing downwards is a touchless sensor 123 that is configured to detect the close proximity of, for example, a user's hand to activate an automatic dispensing of a unit dose of cleaning or sanitizing fluid or the like. The touchless sensor may be an infrared sensor, sonic sensor, capacitive sensor or the like.

Figure 2:
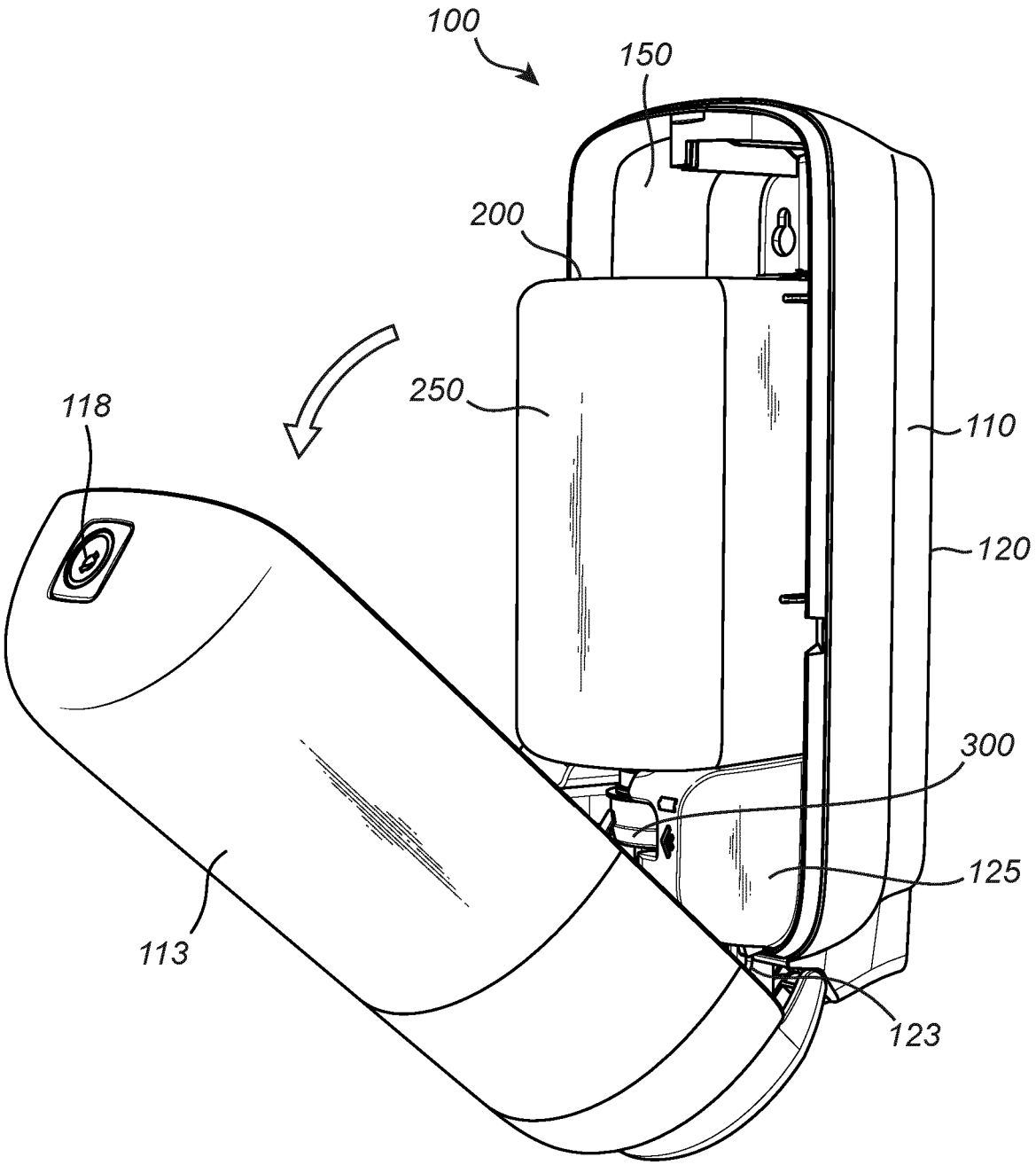
FIG. 2 shows the dispensing system of FIG. 1 in an open configuration.

FIG. 2 shows in perspective view the dispenser 100 with the housing 116 in the open configuration and with a disposable and replaceable fluid container 200 contained in a compartment 150 therein. At the front portion 112 of the dispenser 100, the housing 116 forms a front cover 113 being pivotally connected to the rear portion 110 at the lower end portion 102 thereof. In FIG. 2, the front cover 113 is shown in an open position wherein the cover has been rotated about its pivot at the lower end to expose the interior of the dispenser 100. The replaceable fluid container 200 comprises a fluid reservoir 250 and a fluid pump 300. The reservoir 250 is a 1000 ml collapsible reservoir of the type described in WO2011/133085 and in WO2009/104992, the contents of which are also incorporated herein by reference in their entirety. The reservoir 250 is of generally cylindrical form and is made of polyethylene. The skilled person will understand that other volumes, shapes and materials are equally applicable and that the reservoir 250 may be adapted according to the shape of the dispenser 100 and according to the fluid to be dispensed. At the lower end portion of the dispenser 100 is the pump 300 of the fluid container 200. The pump 300 is inserted in the lower end portion 102 and into a dispensing unit 125 arranged in the compartment 150 of the dispenser 100. The dispensing unit 125 comprises the touchless sensor 123 that is adapted to identify the location of a user's hand and the dispensing mechanism that's causes a unit dose of the product to be dispensed upon identification of the user's hand. At the rear portion of the dispensing unit 125, there is also provided a battery compartment to power the electronics in the dispenser (not shown)

The present disclosure relates a fluid dispensing system 1 and an adaptor assembly to allow the use of different fluid containers 200 with different types of pumps 300.

Figure 3:
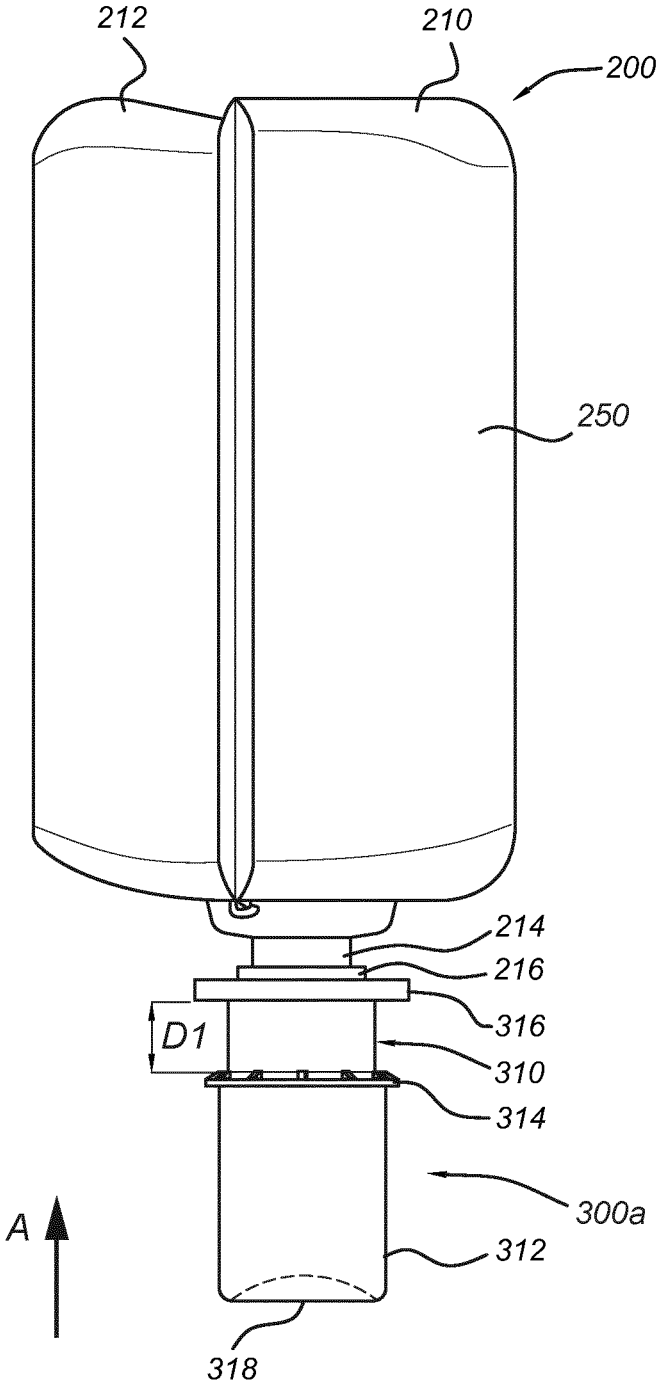
FIG. 3 shows a side view of a disposable container with a pump of a first type according to the disclosure.

A fluid container 200 with a pump 300*a* of a first type is sized to be received in the compartment 150 of the dispenser 100 without the use of an adaptor assembly, see FIG. 3. The pump of a first type is an axially compressible pump 300*a*, and an actuator 124 of the dispenser 100 engages and actuates the pump 300*a* of the first type by axially compressing it in a vertical direction towards the upper end portion 101 of the dispenser 100.

Figure 5:
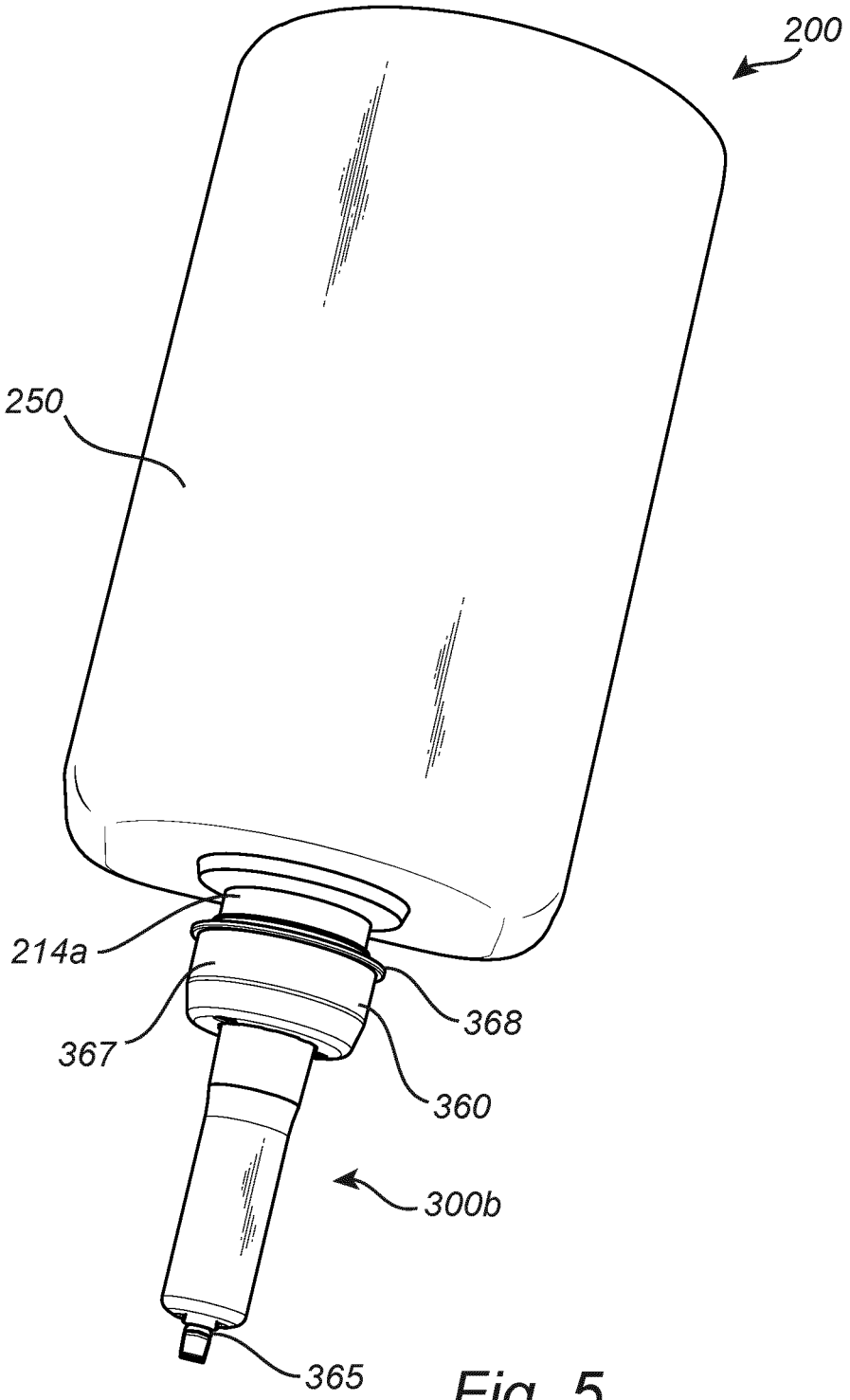
FIG. 5 shows a perspective view of a fluid container with a pump of a second type according to the disclosure.

A fluid container 200 with a pump 300*b* of a second type requires the use of an adapter assembly of the disclosure, see FIG. 5. The adaptor assembly adapts the compartment 150 to be sized to receive a fluid container 200 having a pump of a second type within the dispenser 100 so as to allow the pump of the second type to be actuated by laterally compressing it to cause fluid to be dispensed from the fluid container. The actuator 124 can move a moving part of the adaptor assembly, that in turn may act on and move an actuation part of the adaptor assembly towards the pump 300*b* of the second type and laterally compress the pump.

FIG. 3 shows the fluid container 200 with the pump 300*a* of the first type in a side view. As can be seen, the reservoir 250 includes two portions. A hard portion 210 and a soft portion 212. Both portions 210, 212 are made of the same material but having different thicknesses. As the reservoir 250 empties, the soft portion 210 collapses into the hard portion 212 as liquid is dispensed by the pump assembly 300*a*. This construction avoids the problem with a build-up of vacuum within the reservoir 250. The skilled person will understand that although this is an example for the form of the reservoir, other types of reservoir may also be used in the context of the present disclosure, including but not limited to bags, pouches, cylinders and the like, both closed and opened to the atmosphere. The container may be filled with soap, detergent, disinfectant, skincare formulation, moisturizers or any other appropriate fluid and even medicaments. In most cases, the fluid will be aqueous, although the skilled person will understand that other substances may be used where appropriate, including oils, solvents, alcohols and the like. Furthermore, although reference will be made in the following to liquids, the dispenser 100 may also dispense fluids such as dispersions, suspensions or particulates.

At the lower side of the fluid container 200, there is provided a pump 300*a* of the first type that has an outer configuration that corresponds substantially to that described in WO2011/133085. The fluid container has a rigid neck 214 provided with a connecting flange 216. The connecting flange 216 engages with a stationary sleeve 310 of the pump assembly 300*a*. The pump assembly 300*a* also includes a sliding sleeve 312, which terminates at an orifice 318. The sliding sleeve 312 carries an actuating flange 314 and the stationary sleeve has a locating flange 316. Both the sleeves 310, 312 are injection molded of polycarbonate although the skilled person will be well aware that other relatively rigid, moldable materials may be used. In use, as will be described in further detail below, the sliding sleeve 312 is displaceable in an axial direction A by a distance D1 with respect to the stationary sleeve 310 in order to perform a single pumping action.

Figure 4A:
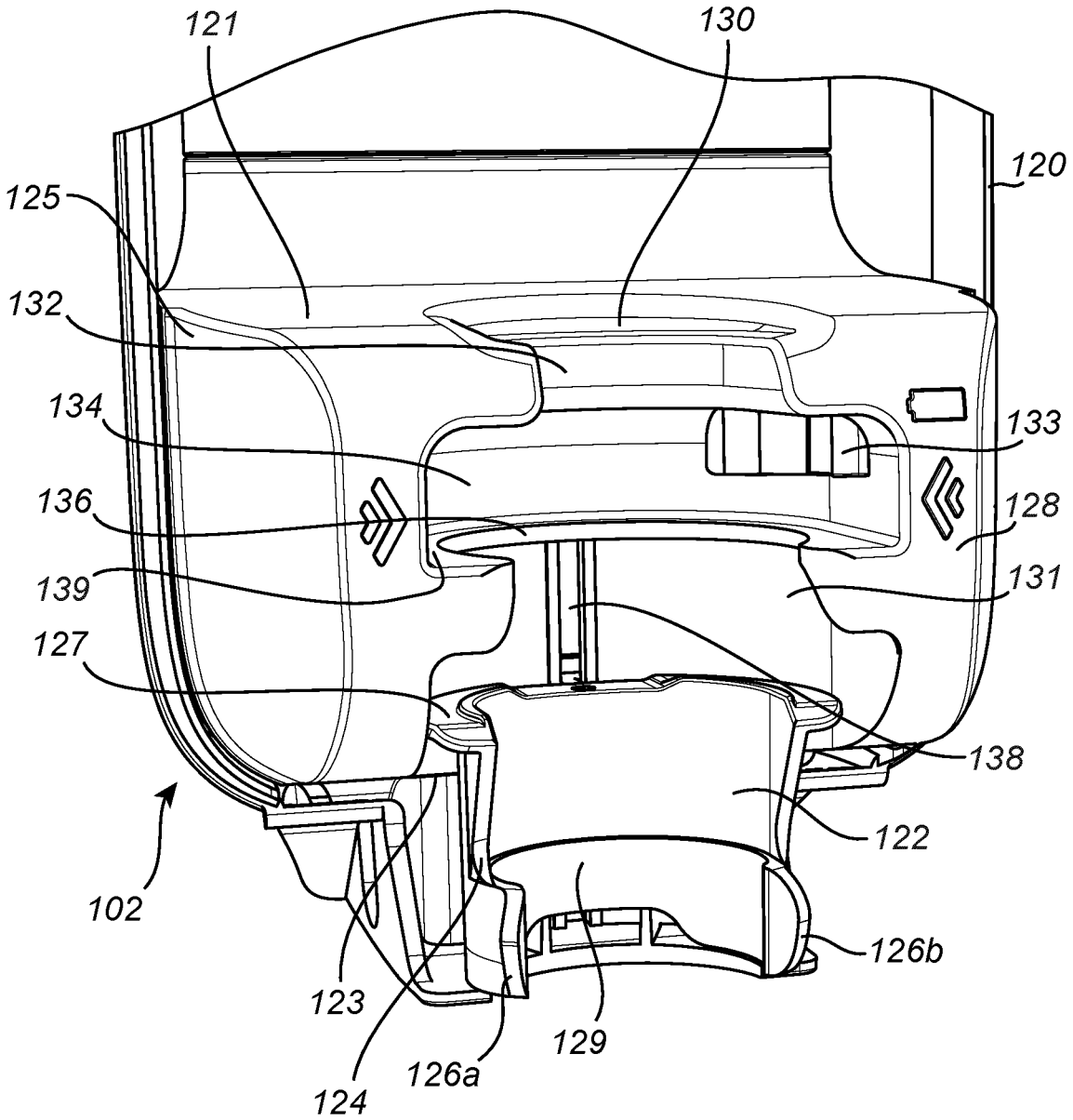
FIG. 4A shows a perspective view of a lower end portion of the dispenser shown in FIG. 1 with the front cover of the dispenser cut away to show details of the interior of the dispenser.

FIG. 4A shows a perspective view of a lower end portion 102 of the dispenser 100 of FIG. 1 with the front cover 113 of the dispenser 100 cut away to show details of the dispensing unit 125. The dispensing unit 125 comprises inter alia the means for actuating the dispensing of fluids and the means for connecting the pump 300*a* of the first type to the dispenser 100. These means will be explored in more detail below. At the rear portion of the dispensing unit 125, there is also provided the battery compartment to power the electronics in the dispenser (not shown).

The dispensing unit 125 has a protruding portion 128 at the lower end portion 102 of the dispenser 100 that protrudes towards the front. The protruding portion 128 includes an opening 130 extending from the lower end to the upper end of the protruding portion 128. The opening 130 faces the front portion of the dispenser 100 forming a cavity 130 in the protruding portion 128 that extends in the vertical direction thereof. This cavity 130 is sized to receive the lower portion of the fluid container 200 having the pump 300*a* of a first type as shown in FIG. 3 and described hereinabove.

The uppermost part of the cavity 130 forms a neck engagement portion 132 configured to partly enclose and match the shape of the neck 214 of fluid container 200 as shown in FIG. 3. A wider cavity portion 134 is located just below neck engagement portion 132. This cavity portion 134 forms a locating flange engagement portion 134 that is sized to enclose and receive the locating flange 316 of the stationary sleeve 310. An internal ridge 136 extending into the cavity 130 from the inner wall in the cavity delimits the lower end of the flange engagement portion 134 by forming a locating flange shelf 136 for the locating flange 316 to rest on.

At the lower portion of the dispensing unit 125 is the actuator 124 in the form of a lifter 124. The lifter is connected to a lifting mechanism in the rear portion of the dispensing unit 125 and a vertical movement of the lifter occurs along a vertical groove 138 formed at the rear of the inner wall 131 in the cavity 130 through which groove 138 the lifting mechanism connects to the lifter 124. The lifting mechanism is operably connected to a motor located inside the dispensing unit 125 (not shown).

The shown lifter 124 has a pump engagement portion 122 that partly encloses and in a form-fit manner engages the sliding sleeve 312 of the pump 300*a*. The engagement portion 122 has a substantially recessed surface portion 129 forming a lifter cavity being concave and forming a substantially hollow semicylinder extending in the vertical direction. An outwardly and laterally protruding flange 127 is formed at the upper end of the pump engagement portion 122, which flange forms a lifting shelf 127 for the actuating flange 314 of the sliding sleeve to rest on, also see FIG. 4B.

At the lower end of the pump engagement portion 122, there are provided two flexible arms 126*a*; 126*b* located at opposite sides of the lifter 124 and extending towards the front. These allow for an annular-like snap-fit engagement between the lifter 124 and the sliding sleeve 312 inserted into the lifter cavity 129. During the insertion of the sliding sleeve 312 into the lifter cavity 129, the arms 126*a*; 126*b* are moved sideward from their rest (equilibrium) positions and exert spring forces to the sleeve 312. The fully inserted sleeve 312 is resiliently kept in place by the arms partly enclosing the sleeve forming a cylinder snap-fit connection with the arms 126*a*; 126*b*, see FIGS. 4A and 4B.

A recognizing switch 133 is formed in the locating flange engagement portion 134 at the right side thereof. This recognizing switch 133 is actuated when the fluid container 200 have been inserted into dispenser 100 and the locating flange 316 of the pump 300*a* acts on the recognizing switch 133 by moving it in a sideward direction towards the right side of the dispenser 100. The actuation of this switch 133 triggers the dispenser 100 to recognize that a new refill 200 has been inserted into the dispenser 100.

Figure 4B:
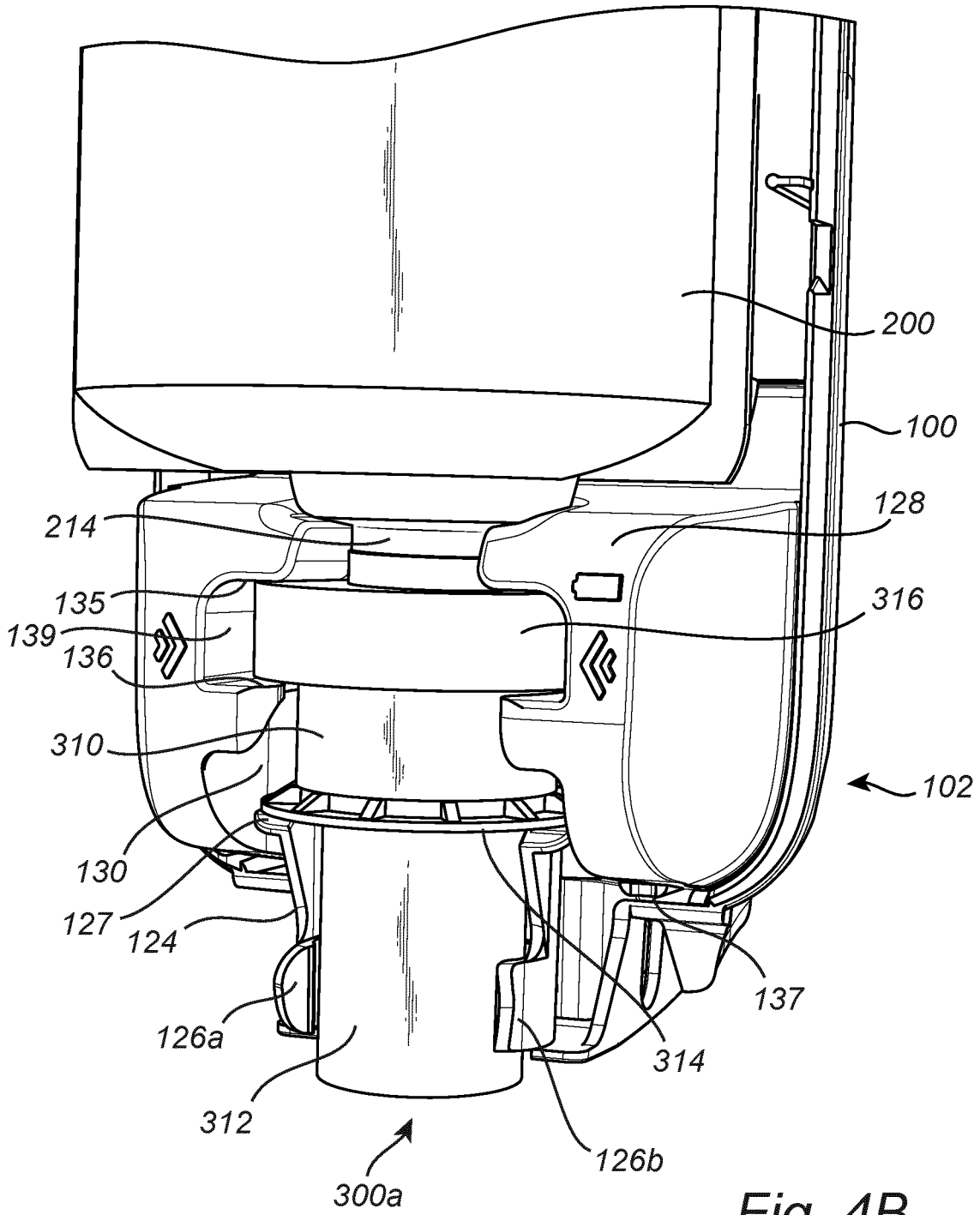
FIGS. 4B and 4C show perspective views of a lower end portion of the dispensing system of FIG. 1 and the pump assembly of FIG. 3 with the front cover of the dispenser removed to show details of the interior of the fluid dispensing system in operation.

The dispensing unit 125 also has an activation switch 137 for turning on and off the mode of actuating the possibility of dispensing a fluid, see FIG. 4B. This switch 137 is located at the bottom of the dispensing unit 125 and is actuated to turn on the dispensing mode when the front cover 113 is moved from its opened position as shown in FIG. 2 to its closed position as shown in FIG. 1. Likewise, the switch 137 is deactivated to turn off the dispensing mode when the front cover is moved from the closed position to the open position. This secure that no dispensing of a fluid can accidently occur when the front cover 113 is opened to, for example, replace the refill 200 in the dispenser 100.

Figure 4C:
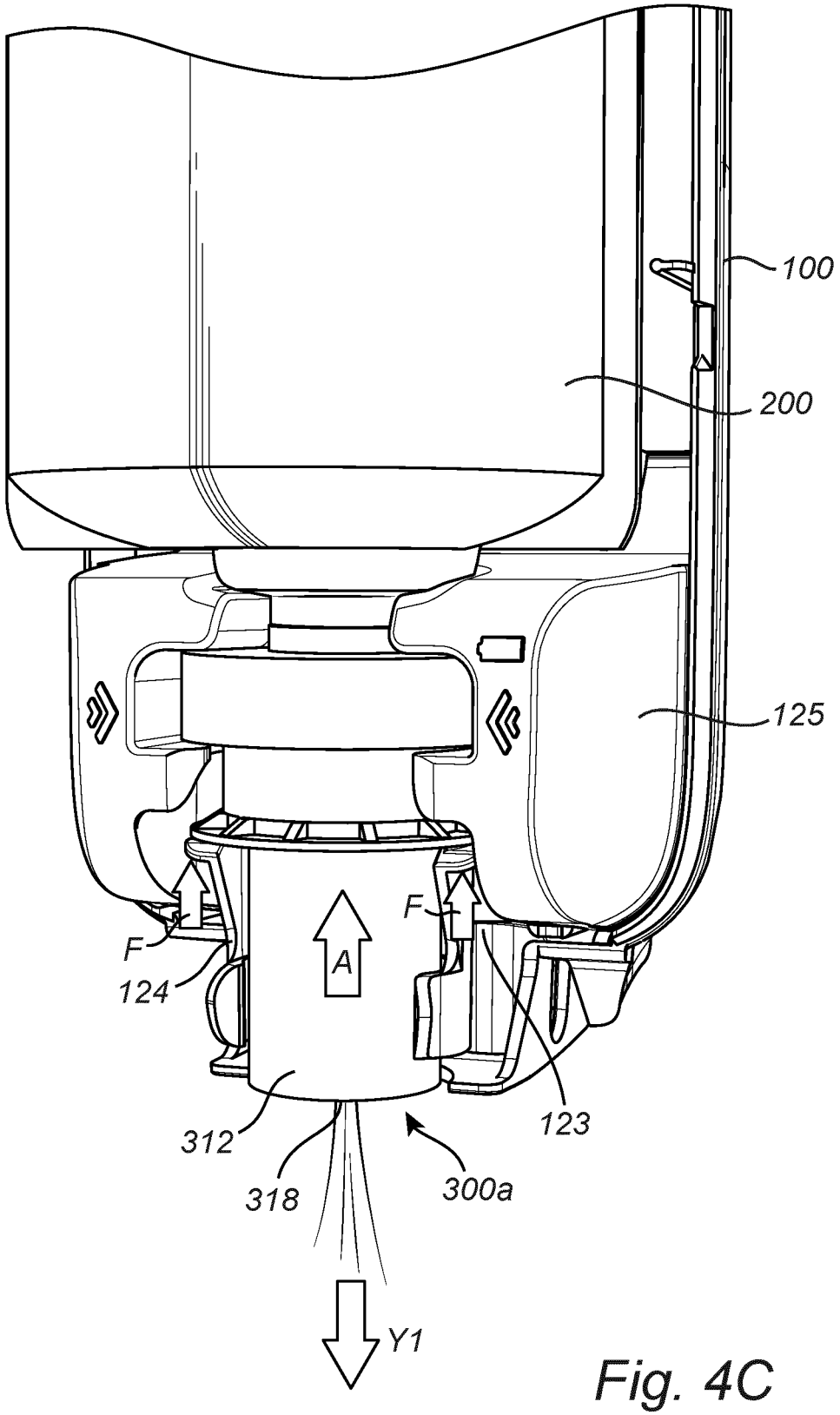

FIGS. 4B and 4C show perspective views of the lower end portion 102 of the dispenser 100 of FIG. 1, with the front cover 113 of the dispenser 100 removed to illustrate the dispensing unit 125 and the pump 300*a* of the first type in operation. As mentioned hereinabove, the pump 300*a* of the first type is an axially compressible pump 300*a*, According to FIG. 4A, the fluid container 200 has been inserted into dispenser 100, wherein the pump 300*a* is fitted into the cavity 130 of the dispensing unit 125 and engaging the lifter 124 as described hereinabove. The locating flange 316 is engaged by a locating groove 139 formed between the locating flange shelf 136 and an upper inner surface 135 of the locating flange engagement portion 134.

As shown in FIG. 4B, the sliding sleeve 312 of the pump 300*a* is engaged by the lifter 124 in its rest position, i.e. when the pump has not been actuated to dispense a unit dose of fluid. The motor is activated, when a user's hand is identified by the sensor 123, wherein the lifter 124 that is operably connected to the motor causes the pump 300*a* to be axially compressed to dispense fluid from the fluid container 200.

FIG. 4C shows the position of the pump 300*a* of the first type once a user's hand has been identified by the sensor 123, wherein the motor has been activated and the lifter 124 that is operably connected to the motor caused the pump 300*a* to be axially compressed to dispense a fluid from the fluid container 200. In this view, the lifter 124 acts in an upward direction with a force F, causing the sliding sleeve 312 to move upwards in an axial direction (A). This causes fluid to be dispensed downwardly in a direction Y1 from the fluid container 200 and the orifice 318 thereof. The skilled person appreciates that the fluid dispensing system 1 comprising a fluid container 200 with a pump 300*a* of the first type and its operation is essentially the same for the manual dispensing system as known from WO2011/133085, except that the lifter 124 is replaced with another actuator for engaging and moving the sliding sleeve 312.

The fluid dispensing system 1 has so far been described in view of using the dispenser 100 together with the fluid container 200 having a pump 300*a* of the first type. It is desirable to be able to use the fluid container 200 with a pump 300*b* of the second type in the dispenser 100 described above without affecting the possibility of still being able to load the dispenser 100 with a fluid container 200 having a pump 300*a* of the first type. A removable adaptor assembly according to the present disclosure provides this possibility. In the following, the fluid dispensing system 1, the dispenser 100 and the adaptor assembly will be exemplified in more detail by reference to enclosed drawings and a number of exemplary embodiments.

FIG. 5 shows a perspective view of a fluid container 200 with the pump 300*b* of a second type. As can be seen, the reservoir 250 is for the sake of simplicity shown to be of a generally cylindrical form. Nevertheless, the skilled person will understand that the reservoir 250 may have the same construction as described above in relation to the fluid container 200 shown in FIG. 3. The skilled person will also understand that any other type of reservoir 250 that has been described above and that may be used with the container 200 shown in FIG. 3 may also be used in the context of the fluid container 200 with the pump of a second type. The container 200 may be filled fluids such as soap, detergent, disinfectant, skincare formulation, moisturizers or any other appropriate fluid as mentioned above in relation to FIG. 3.

At the lower side of the fluid container 200, there is provided the pump 300*b* of the second type that has an outer configuration of an elongated and elastic tube forming a resilient pump chamber 300*b*. The chamber is in fluid communication with an inside of the fluid reservoir and is connected to a rigid neck 214*a* of the fluid reservoir by a connector cap 360 for connecting and sealing the fluid reservoir to the chamber 300*b*. A nozzle 365 is provided at the lower end of the chamber. A valve may be arranged in the chamber 300*b* close to the nozzle 365 to prevent liquid from dripping out of the fluid container, when the chamber is not squeezed. Similarly, a valve may be arranged between the chamber 300*b* and the fluid reservoir in order to prevent liquid from being pressed back into the reservoir when the chamber is being squeezed. Such valves are known in the art. An example of a pump of this type and an example of a connection of the pump to the fluid reservoir are described in WO2009/104992. The skilled person will understand that although the elongated and elastic tube chamber 300*b* is an example of a pump 300*b* of the second type, other types of pumps of the second type may also be used in the context of the present disclosure, including a pump 300*b* of a flexible or resilient pump chamber of other shapes than an elongated and elastic tube chamber 300*b*.

Figure 6B:
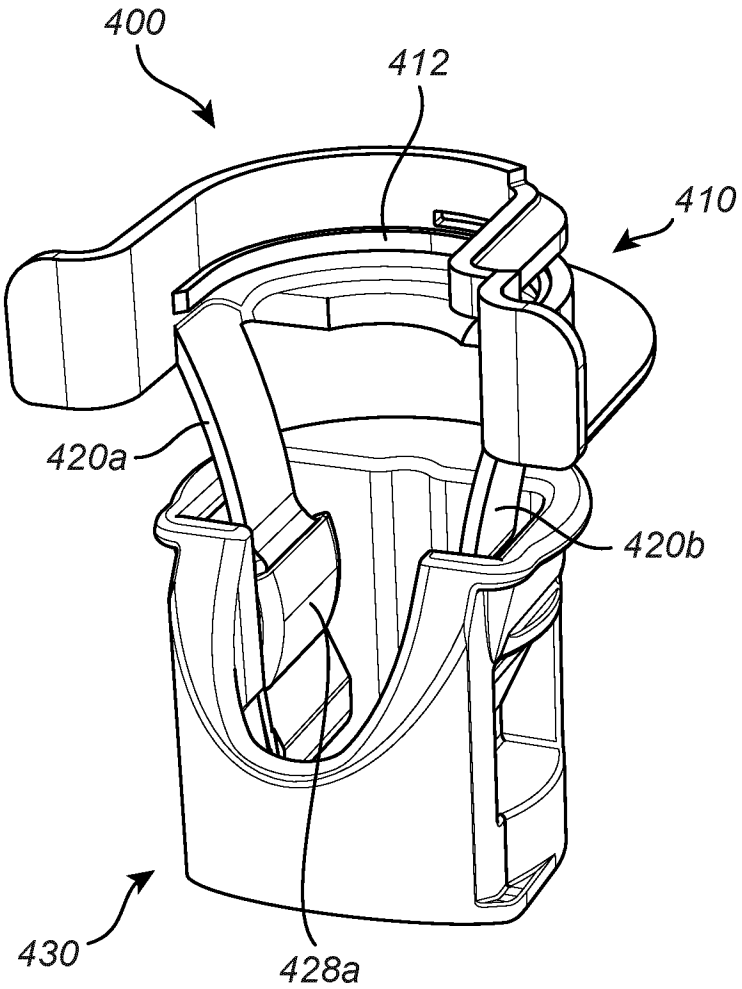
FIGS. 6A and 6B show perspective views of an embodiment of an adaptor assembly.
Figure 6A:
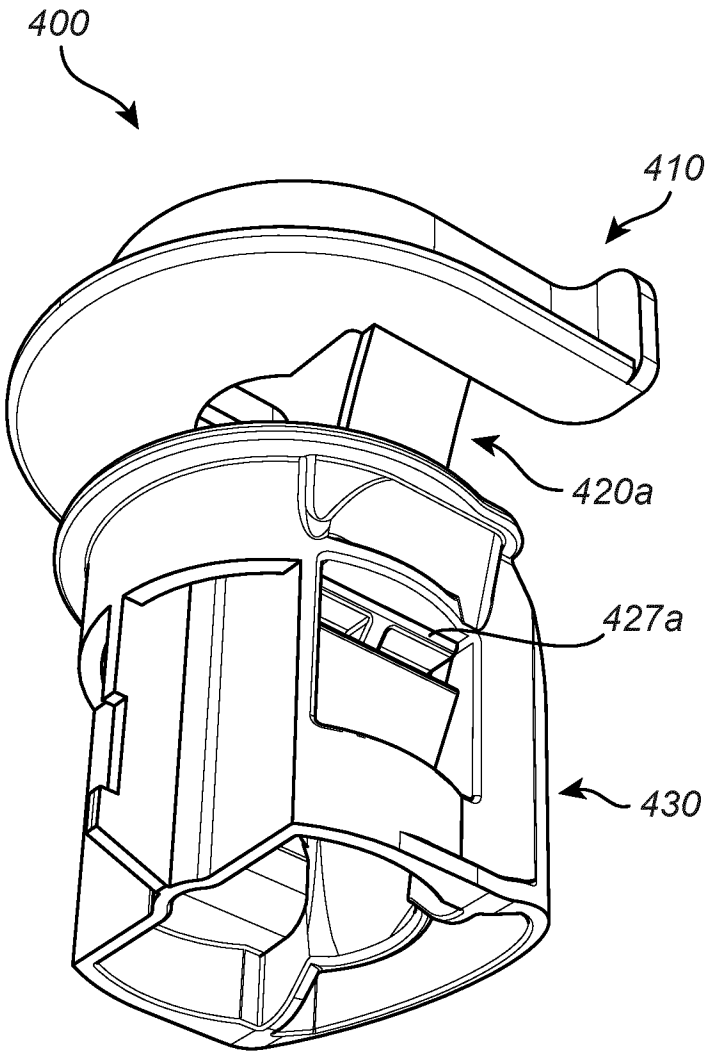

FIGS. 6A and 6B show an embodiment of an adaptor assembly 400 to be used with a fluid container 200 with a pump 300*b* of the second type, in particular the fluid container 200 with the elastic and elongated tube chamber 300*b* as shown in FIG. 5.

The adaptor assembly 400 comprises an upper part 410 forming a fluid container 410 of the present disclosure for removably connecting the adaptor assembly to the fluid dispensing system 1 and the fluid container 200.

The adaptor assembly 400 also comprises two actuation parts 420*a*; 420*b*, each comprising a portion 126*a*; 126*b* forming an actuation head 126*a*; 126*b* that is movable between a non-actuated position and a fully actuated position, so that the elongated and elastic pump chamber 300*b* can be laterally compressed between the two actuation heads 126*a*; 126*b*, when the adaptor assembly 400 and the fluid container are mounted in the dispenser, thereby causing fluid to be dispensed from the fluid container 200.

The adaptor assembly 400 further comprises a lower part 430 forming a moving part 430 of the present disclosure that is configured to engage the pump engagement portion 122 of the lifter 124 and to partly enclose the pump 300*b* of the second type.

Figure 7A:
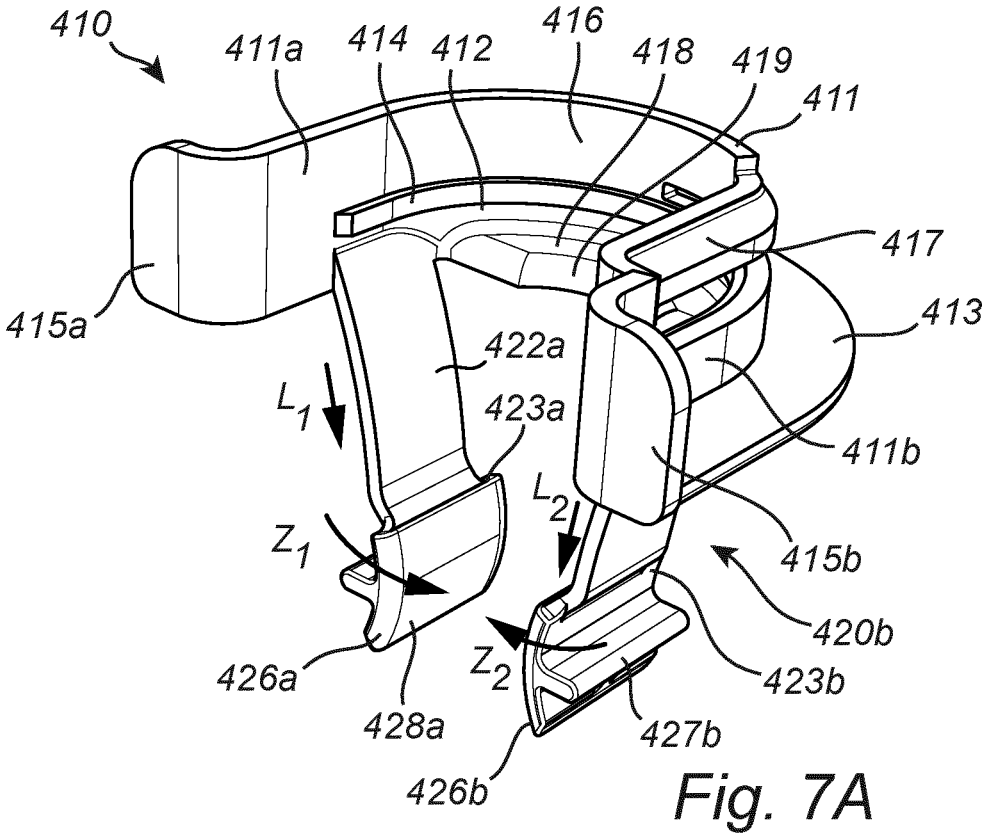
FIGS. 7A and 7B show perspective views of an upper part of the adaptor assembly of FIGS. 6A and 6B.
Figure 7B:
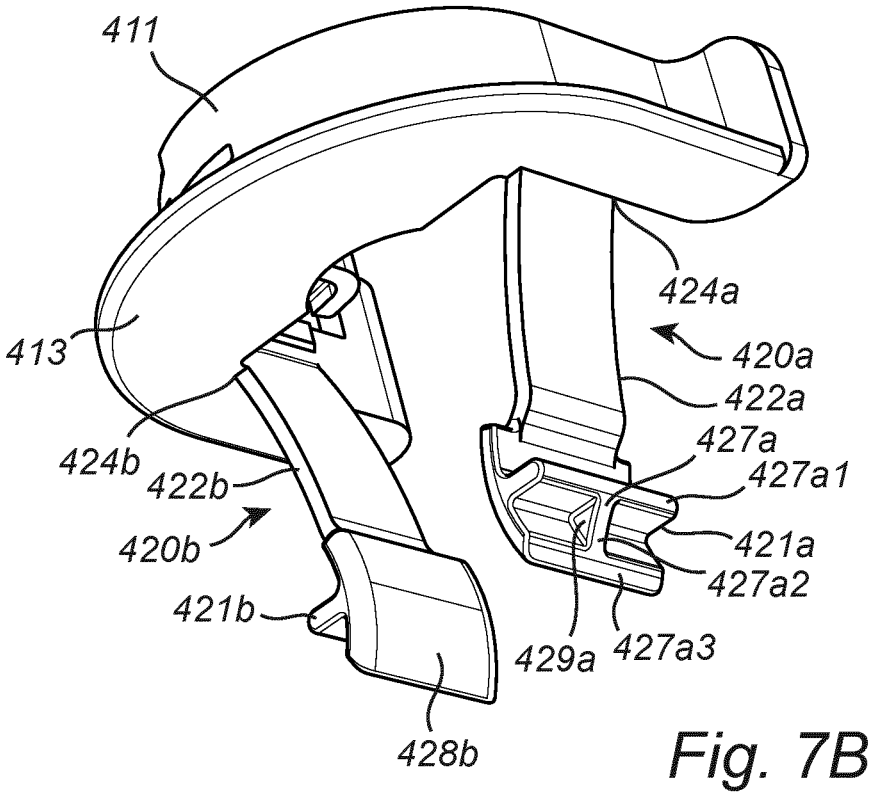

FIGS. 7A and 7B show the fluid container support 410 includes a cap receiving portion 411 being a U-shaped element forming a cavity 412 that extends in a vertical direction and providing a central through-opening 412 for receiving and engaging the connector cap 360 and the of the fluid container 200 of FIG. 5. The fluid container support 410 is fully open in the front to be able to access the cavity 412, when mounted in the dispenser, to allow insertion of the fluid container 200 from the front and when the adaptor assembly 400 has already been mounted in the dispenser 100.

A laterally protruding flange 413 is provided at the lower end of the fluid container support 410, which flange protrudes outwardly from the lower end of the cap receiving portion 411. The flange 413 has a shape and dimensions to allow it to match the U-shaped form of the cavity portion 134 forming the locating flange engagement portion 134 of the dispensing unit 125 and to rest on the seat of the dispenser 100 formed by the locating flange shelf 136 of the dispensing unit 125, see FIGS. 4A and 11A. The height of the fluid container support 410 corresponds to the height of the locating flange engagement portion 134.

Each front terminal end of the U-shaped element forming the cap receiving portion 411 turns and projects in a sideward direction to form a positioning means in the form of a positioning flange 415*a*; 415*b* that connects to and extends along the width of the front end of the laterally protruding flange 413. These positioning flanges 415*a*; 415*b* match the shapes and dimensions of outer front side edge portions the flange engagement portion 134 that form the connecting portions for the positioning means 415*a*; 415*b*. Thus, the positioning flanges 415*a*; 415*b* provide a proper insertion of the adaptor assembly 400 into the dispensing unit 125. The flanges 415*a*; 415*b* may also prevent the lateral, rotational and/or axial movement of the cap receiving portion 411 mounted in the dispensing unit 125.

At the rear lower portion of the cap receiving portion 411 there is optionally provided a pump supporting element 418 in the form of a supporting flange 418 laterally extending into the opening 412 and having concave portion 419 that in form matches the elongated and elastic tube chamber 300*b* shown in FIG. 5. This flange 418 may support a proper insertion of the fluid container into the dispenser 100 as well as a proper support of the pump 300*b*, when the fluid container 200 is mounted in the dispenser 100.

A cap supporting rib 414 extends laterally from and partly along the U-shaped inner surface 416 of the cap receiving portion 411. This cap supporting rib 414 may provide some rigidity to the fluid container support and is configured to partly engage or support the circular shape of the connector cap 360 of the fluid container 200 of FIG. 5 to provide a proper insertion of the fluid container 200 into the dispenser 100 and the adaptor assembly 400 as well as a proper support of the connector cap 360, when the fluid container is mounted in the dispenser 100.

The skilled person appreciates that the fluid container support 410 may adopt other shapes than the U-shaped one, including but not limited to a polygonal shape that still may form the support for fluid container 200 and the connector cap 360 or the like and form an engagement with U-shaped cavity portion 134 forming the locating flange engagement portion 134 of the dispensing unit 125.

In an upper portion of the cap receiving portion 411 and the wall thereof, there is provided a recess in which there is provided an elastic and flexible switch displacing arm 417 extending from a rear portion of the wall 416 towards the front. The switch displacing arm 417 is laterally movable from a rest position to towards a switch-actuated position. The function will be explored in more detail below, see FIG. 12A.

The adaptor assembly 400 further comprises the two actuation parts 420*a*; 420*b* as shown in FIGS. 7A and 7B. Each actuation part 420*a*; 420*b* includes an elongated arm 422*a*; 422*b* that extends in a longitudinal direction ($L_1$; $L_2$) thereof between two opposite ends 423*a*; 423*b*; 424*a*; 424*b* of the arm.

Each first end 424*a*; 424*b* is connected to the fluid container support 410 at the lower end of the U-shaped inner surface 416 at a straight surface portion 411*a*; 411*b* formed by a straight pointing arm 411*a*; 411*b* of the U-shaped element 411. Thus, the elongated arms 422*a*; 422*b* are connected to the straight pointing arms 411*a*; 411*b* of the fluid container support 410 at opposite sides of the central opening 412 and extend from their first ends 424*a*; 424*b* in a direction ($L_1$; $L_2$) downwards and towards each other to their second ends 423*a*; 423*b*.

Each second end 423*a*,423*b* of the arms carries an actuation head 426*a*; 426*b* that comprises a first contact surface 427*a*; 427*b* and a second contact surface 428*a*; 428*b*. Each first contact surface 428*a*; 428*b* is configured for abutting against a dolly surface 436*a*; 436*b* formed by a sliding surface of the moving part 430 as described hereinbelow. Each second contact surface 428*a*; 428*b* is configured to abut against the pump 300*b* of the second type. The actuation heads 426 projects slightly outwardly in two opposing directions being substantially perpendicular directions to the longitudinal direction ($L_1$) of the elongated arm 422 to form the first and second contact surfaces 427*a*; 427*b*; 428*a*; 428*b* facing away from each other. Each shown second contact surface 428*a*; 428*b* is convex in its shape to allow a smooth and proper contact with the pump 300*b*. The second contact surfaces 428*a*; 428*b* face each other to allow the surfaces to abut against the pump 300*b* of the second type on opposite sides thereof, see FIG. 12B. The skilled person appreciates that each second contact surface 428*a*; 428*b* may adopt other shapes and dimensions, including but not limited to being flat or concave to match the pump shape, for example.

As shown in FIG. 7B, each first contact surface is formed by an upper surface portion 427*a*1, a middle surface portion 427*a*2 and a lower surface portion 427*a*3. The upper surface portion 427*a*1 is provided by a laterally extending flange 421*a*; 421*b* forming a snap-fit hook element 421*a*; 421*b* to connect to the moving part 430 as described hereinbelow. The upper surface portion 427*a*1 of each first contact surface 427*a*; 427*b* is configured for slidingly contacting a dolly surface 436*a*; 436*b* of the moving part 430 for moving the actuation head 426*a*; 426*b* from the non-actuated position to an actuated position as will also be further explored in more detail below. Below the upper surface portion 427*a*1 is the inclined middle second surface portion 427*a*2 provided by a vertical supporting flange 429*a* that is connected to the laterally extending flange 421*a*; 421*b*. The lower surface portion 427*a*3 is formed in the lowered end as a lateral surface portion 427*a*3 being inclined and connects the inclined surface of the middle surface portion 427*a*2.

The actuation heads 426*a*; 426*b* are both movable between their non-actuated positions and fully actuated positions to allow a pump 300*b* of the first type to be compressed between the two actuation heads 426*a*; 426*b* causing fluid to be dispensed from the pump 300*b*, when the adaptor assembly 400 is mounted in the dispenser 100 together with the fluid container 200 and upon actuation of the dispensing operation.

The movements of the actuation heads 426*a*; 426*b* can be realized by movably connect the first ends 424*a*; 424*b* of the arms to the fluid container support 410 and/or by making at least a portion of the arm flexible or elastic. Thus, the actuation heads 426*a*; 426*a*2 can be moved along rotational directions $Z_1$; $Z_2$ between non-actuated positions and fully actuated positions, see FIG. 7A.

The movable connections of the arms 422*a*; 422*b* to the fluid container support 410 can be provided by the arms 422*a*; 422*b* being pivotally connected to the fluid container support 410. The skilled person also appreciates that other types of movable connections may be used, including but not limited to a pivot formed by hinge connection or by a living hinge.

In the shown embodiment, the skilled person envisages that the arms 422*a*; 422*b* may be fixedly connected to the fluid container support 410 and in part or completely be made flexible so as to allow the movements of the actuation head 426*a*; 426*b* from the non-actuated positions to the fully actuated positions in the rotational directions ($Z_1$; $Z_2$). The skilled person appreciates that the arms 422 may be made flexible by using an elastic and flexible plastic material, e.g. olefin plastics such as polypropylene, and selecting shapes and dimensions suitable for the purpose. Stiffer plastic materials such polyoxymethylene (POM) may also be used to form the flexible arm 422*a*; 422*b* for proper flexibility and spring force to support the return of the actuation heads 426*a*; 426*b* from the actuated position to the non-actuated positions, i.e. towards the rest positions the arms have, as well as to support the connection to the moving part 430. The mentioned materials are all suitable when parts are formed by injection molding. Nevertheless, the parts may also be formed by 3D printing or any other suitable method known to the skilled person, when other plastics such as a nylon like polyamide 12 (PA 12) may be used.

The skilled person will understand that although the actuation parts 420*a*; 420*b* being movably connected to the fluid container support 410 or having flexible arms 422*a*; 422*b* to provide the movable actuation heads 426*a*; 426*b* are examples of actuation parts 420*a*; 420*b* being connected to the fluid container support 410 and carrying the first and second contact surfaces 428*a*; 428*b*; 428*a*; 428*b* for use with the pump 300*b* of the second type, other actuation parts 420*a*; 420*b* may be used, including but not limited to actuation parts 420*a*; 420*b* having actuation heads 426*a*; 426*b* being movably connected to the arms 422*a*; 422*b*, and to the actuation parts 420*a*; 420*b* being formed with shapes of the actuation heads 426*a*; 426*b* such as the heads having a ball-formed shape or the heads having a second contact surfaces 428*a*; 428*b* being flat or concave to match the pump shape. The first contact surfaces 427*a*; 427*b* may also adopt other shapes and dimensions such as being convex or flat in their shapes to allow proper contacts to the dolly surfaces 436*a*; 436*b*.

Figure 8A:
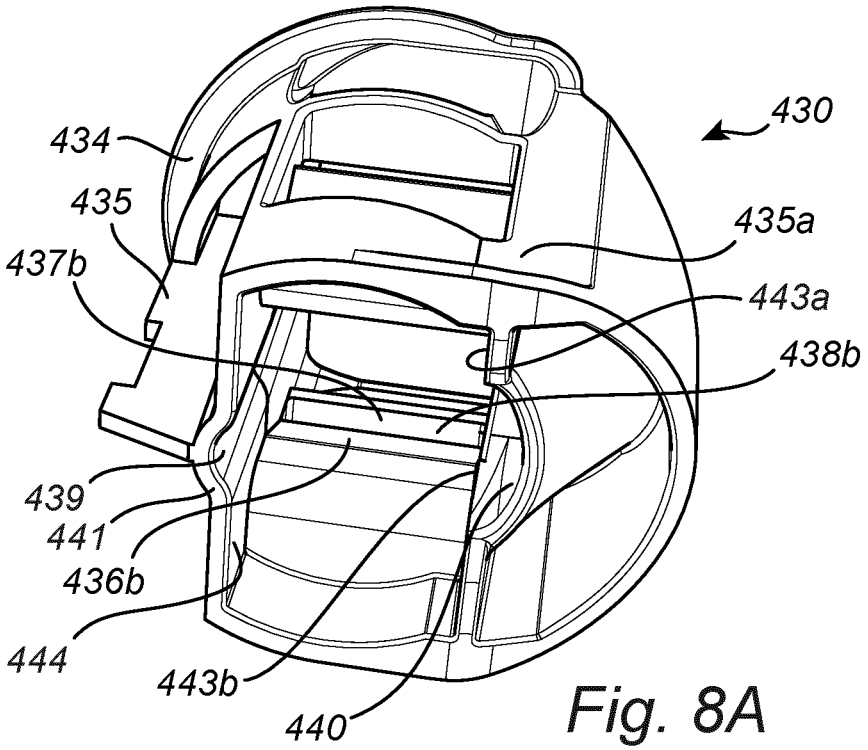
FIGS. 8A and 8B show perspective views of a lower part of the adaptor assembly of FIGS. 6A and 6B.
Figure 8B:
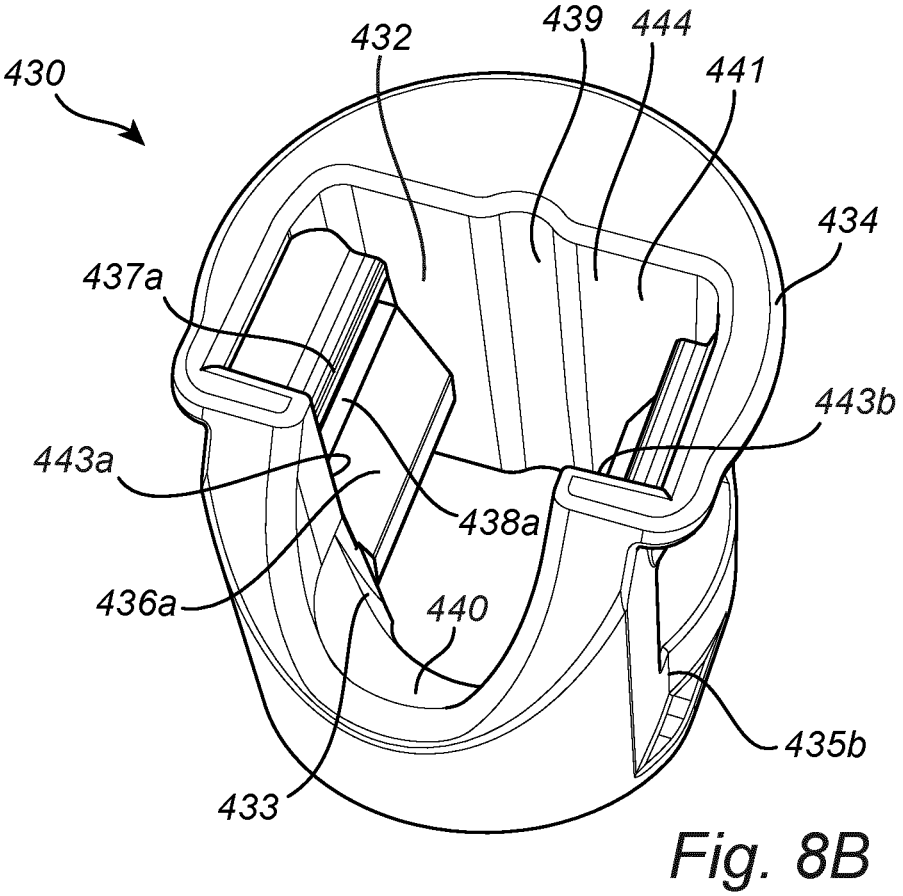

As further shown in FIGS. 6A and 6B, the adaptor assembly 400 further comprises the lower part 430 forming the moving part 430 of the present disclosure that is configured to engage the pump engagement portion 122 of lifter 124 and partly enclose the pump 300*b* of the second type:

As set forth in FIGS. 8A and 8B, the moving part 430 forms a sleeve 430 with an axially extending through-opening 432, wherein an upper front portion of the sleeve has an access opening 433 to access the through-opening from the front portion of the moving part 430. The access opening 433 forms a continuous opening with the through-opening 432 at the upper portion of the moving part 430, i.e. in other words that the upper end portion of the axially extending through-opening 432 extends from the rear portion to the front portion and to the upper portion of access opening 433 that in turn extends downwards to provide a large opening 433 for accessing the interior of the moving part 430 from the top and the front of the moving part 430. An inner surface portion 440 of the moving part 430 below the access opening 433 may form an access cavity 440 extending with an oblique angle downwards and rearwards from the lower end of the access opening 433 to the lower end of the front portion of the through-opening 432 so as to provide a better access to the interior of the moving part 430, e.g. upon insertion of a fluid container 200 into the adapter assembly 400, when mounted in the dispenser 100 as illustrated in FIG. 11B.

The shapes and dimensions of the moving part 430 are configured to be partly enclosed and engaged by the lifter 124 of the dispenser 100 shown in FIG. 4A. The shown lifter 124 has the pump engagement portion 122 that is normally configured to partly enclose and in a form-fit manner engage the sliding sleeve 312 of the pump 300*a* of the first type as shown FIG. 4B. The moving part 430 of the adaptor assembly 430 is also configured to be enclosed and engaged with the pump engagement portion 122 in a form-fit manner within the lifter cavity 129 of the engagement portion 129. The moving part 430 also comprises a lateral upper flange 434 extending outwardly in lateral directions from the rear and side portions at the upper end of the moving part 430. This upper flange 434 is configured to rest on the lifting shelf 127 of the lifter 124, see FIG. 12A, As mentioned hereinabove in relation FIG. 4A, the lifter 124 has the two flexible arms 126*a*; 126*b* that are located at opposite sides of the lifter 124 and that extend towards the front. These arms 126*a*; 126*b* normally allow for an annular-like snap-fit engagement between the lifter 124 and the sliding sleeve 312 of the pump 300*a* of the first type as shown in FIG. 4A. These flexible arms 126*a*; 126*b* will also allow for a snap-fit engagement between the moving part 430 and the lifter 124. At the lower portion of the moving part 430 are two recessed portions 435*a*; 435*b* on the opposite sides of the sleeve 430 close to the front portion thereof. These recessed portions 435*a*; 435*b* are configured to receive outer portions of the two flexible arms 126*a*; 126*b* that have slightly rounded protruding portions facing inwards towards each other. During the insertion of the moving part 430 into the lifter cavity 129, the arms 126*a*; 126*b* are moved sideward from their rest (equilibrium) positions and exert spring forces to the sleeve 430. The fully inserted moving part 430 is resiliently kept in place by the arms 126*a*; 126*b* partly enclosing the sleeve 430 and the outer rounded portions of the arms 126*a*; 126*b* being snap-fitted into the recessed portions 435*a*; 435*b* of the moving part 430, see FIG. 12A. Thus, these recessed portions 435*a*; 435*b* provide a proper insertion of the moving part 430 into the dispensing unit 125. The recessed portions 435*a*; 435*b* being snap-fit connected to the flexible arms also prevent the lateral, rotational and/or axial movement of the moving part 430 in the lifter 124. Thus, the recessed portions form positioning means 435*a*; 435*b* for engaging corresponding one or more connecting portions 126*a*; 126*b* in the dispenser 100 and preventing an undesired axial and/or rotational movement of the adaptor assembly 400 in the dispenser, and/or for preventing wrong positioning of the adapter assembly in the dispenser. When the adaptor is fully inserted, the lower end of the adaptor assembly 400 is located close to the bottom of the dispenser, see FIG. 12A.

The skilled person appreciates that the moving part 430 may adopt any suitable shape and dimensions for engaging the lifter 124, e.g. by adopting a circular shape as the sliding sleeve 312 of the pump 300*a* of the first type as described hereinabove.

The moving part 430 has a substantially flat rear wall 441, which is provided with a vertical extending flange 435 extending rearwards along a central portion thereof from the bottom to the top of the wall and the moving part 430. This flange 435 is adapted to form bear against rear portion of the lifter 124 for proper engagement of the moving part 430 in the lifter 124. Furthermore, vertically and centrally extending rounded cavity 439 is formed in the rear wall 441 on an inner surface 444 surface thereof. This cavity 439 is formed to fit the pump of an elongated and elastic tube chamber 300*b* into the moving part 430 and the adaptor assembly 400.

Figure 10:
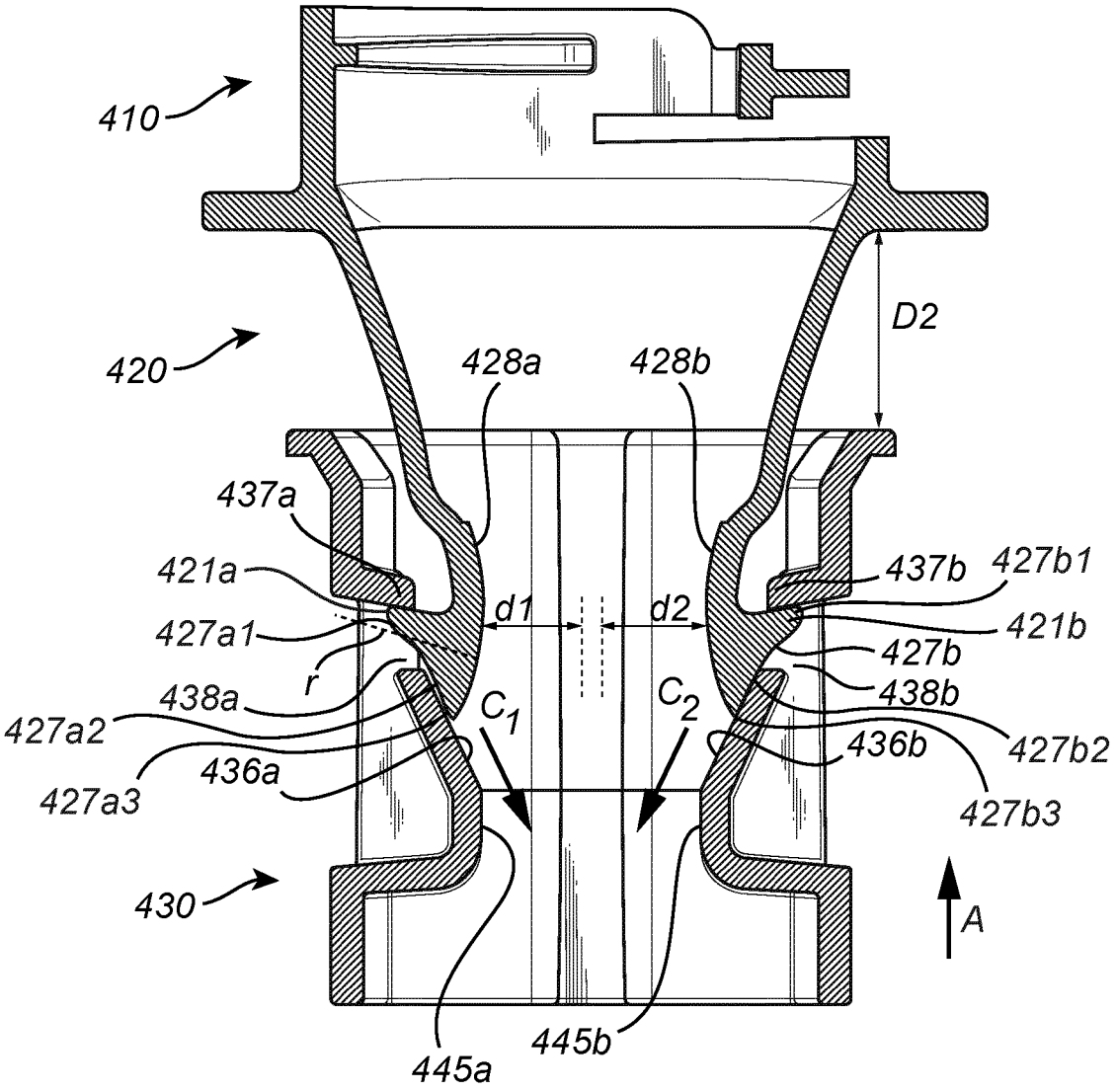
FIG. 10 shows a partial cross-sectional view of an embodiment of the adaptor assembly of FIGS. 6A and 6B.

In the central through-opening 432 of the moving part 430 on opposite side portions thereof between the front portion and the rear wall are two snap-fit mating parts with two snap-fit supports 437*a*; 437*b* and two cut-outs 438*a*; 438*b* configured to allow for a snap-fit engagement with the snap-fit hook elements 421*a*; 421*b* of the actuation parts 420*a*; 420*b* formed by the laterally extending flanges 421*a*; 421*b* of the respective actuation heads 426*a*; 426*b*. The snap-fit engagements are best shown in FIGS. 10 and 12B, wherein the actuation parts 420*a*; 420*b* form types of cantilever snap-fit beams with hook elements 421*a*; 421*b* that subject to bending loads engage their snap-fit mating parts of the two snap-fit supports 437*a*; 437*b* and the two snap-fit cut-outs 438*a*; 438*b*. The width of the snap-fit mating parts extend in a lateral direction from the inner surface 444 of the rear wall 441 to inner front surface portions 443*a*; 443*b*, which in turn extend downwards from the upper end of the moving part 430 along each side of the access opening 433 and the access cavity 440 to the lower end of the moving part 430 at the front portion thereof. Below and from the two snap-fit cut-outs 438*a*; 438*b* are the dolly surfaces 436*a*; 436*b* extending with oblique angles downwards and inwards in directions (C1; C2) towards each other to form a tapering cavity portion therebetween ending in lower narrow portion connected to two vertical surfaces 445*a*; 445*b* facing each other, see FIG. 10. A lateral dimension between the two vertical surfaces 445*a*; 445*b* substantially matches the outer diameter of the elongated tube of the pump 300*b*, see FIG. 12B. The both dolly surfaces 436*a*; 436*b* also face each other and provide sliding surfaces for the actuation heads 426*a*; 426*b* to slide along, when the moving part 430 is moved upwards to move the sliding surfaces 436*a*; 436*b* upwards causing the actuation heads 426*a*; 426*b* to be displaced towards each other from their non-actuated positions to their actuated positions.

Figure 9:
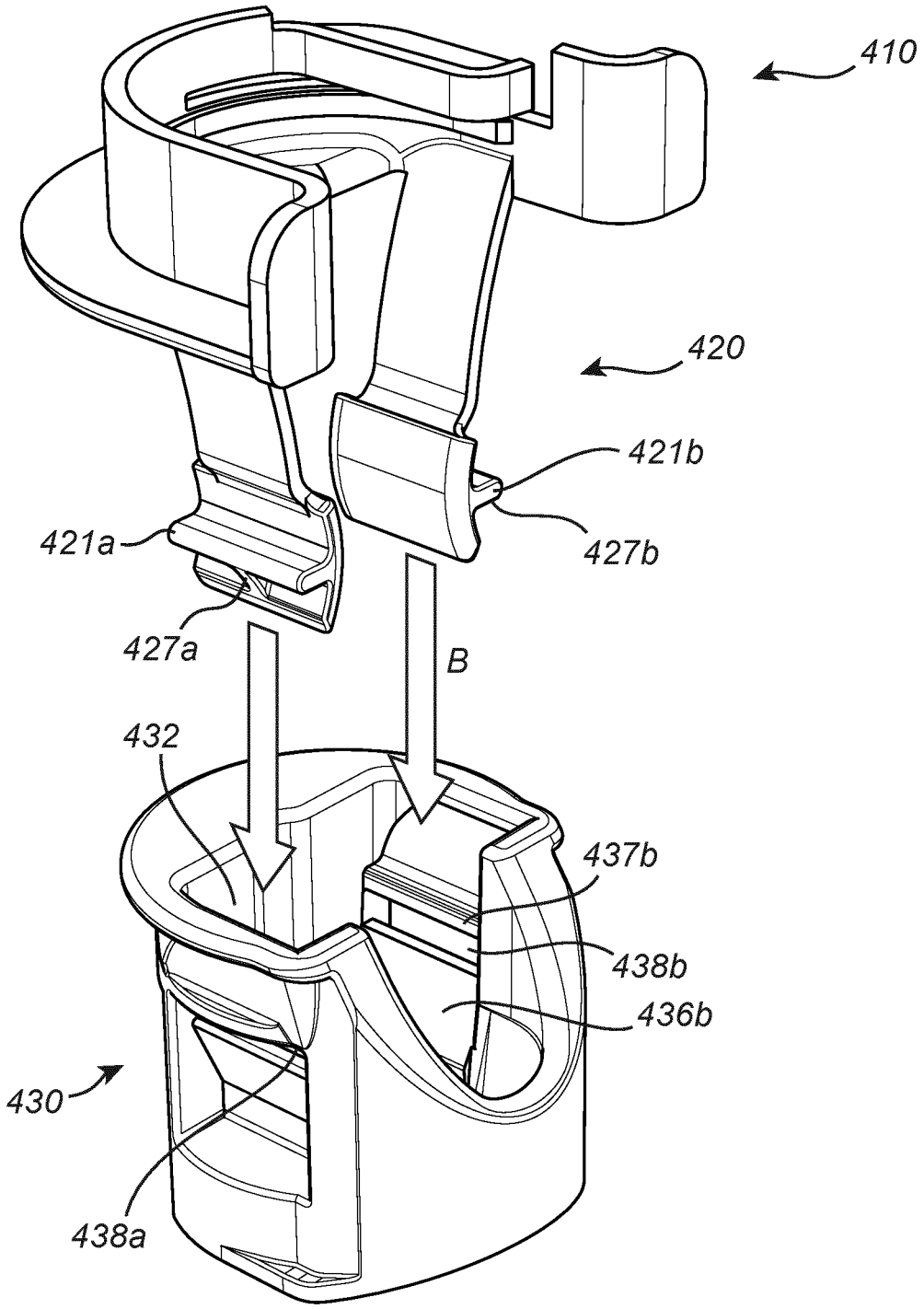
FIG. 9 illustrates the assembly of the upper part of FIG. 7A and the lower part of FIG. 8A into the adaptor assembly of FIGS. 6A and 6B.

As shown in FIG. 9, the adaptor assembly 400 is assembled by moving the fluid container support 410 with the two actuation parts 420*a*; 420*b* facing downwards towards the moving part 430 and the upper part thereof, all parts being placed in the correct directions they should have when mounted together. As the actuation parts 420*a*; 420*b* are moved into the through-opening 432 of the moving part 430, their first contact surfaces 427*a*; 427*b* will come in contact with snap-fit supports 437*a*; 437*b* and slide over these supports causing the arms 422*a*; 422*b* of actuation parts 420*a*; 420*b* to bend inwardly according to the cam-like shapes of the first contact surfaces 427*a*; 427*b* and finally the snap-fit hook elements 421*a*; 421*b* of the actuation head 426*a*; 426*b* are moved into the snap-fit engagements with their snap-fit mating parts of the two snap-fit supports 437*a*; 437*b* and two snap-fit cut-outs 438*a*; 438*b*, which snap-fit engagements are subject to bending loads of the actuation parts 420*a*; 420*b* and the arms 422*a*; 422*b* thereof, see FIG. 10.

As could be envisage from FIGS. 8A to 9, the inner surface 444 of the rear wall 441 and inner front surface portions 443*a*; 443*b* delimit a space therebetween to house the actuation heads 426*a*; 426*b* having maximum lateral dimensions in rearwardly directions that match the corresponding lateral dimension of the space. Accordingly, there are provided positioning means for a correct assembly of the adaptor assembly 400 and for properly guiding the axial movement of the moving part 430 and the lateral movements of the actuation heads 126*a*; 126*b*, as well as for preventing a rotational movement between the moving part 430 and the fluid container support 410.

Suitable materials for forming the adaptor assembly 400 may be aluminum or any suitable plastics such as polyoxymethylene (POM), polyamide 12 (PA 12) and olefin plastics, e.g. polyethylene or polypropylene. The adaptor assembly 400 may be formed by injection molding, 3D printing or any other suitable method known to the skilled person. The mentioned materials and forming of the assembly can be used for all parts of the adaptor assembly and a combination of the materials may also be considered for adaptor assembly or parts thereof.

Furthermore, the described adaptor assembly 400 that now has been described may have the following examples of dimensions. The fluid container support 410 may have a maximum width of 54-55 mm and a height of about 14-15 mm. Each actuation arm 422*a*; 422*b* has a length of about 22-23 mm. Each second contact surface 428*a*; 428*b* has a width of about 14-16 mm, a height of 12-13 mm and a radius (r) of the convex surface of about 14-16 mm, see FIG. 10. The moving part 430 has a height of about 37-38 mm, a width of about 40 mm and a depth of about 44-46 m. Each dolly surface 436*a*; 436*b* has a width of about 14-16 mm and a length of about 10 mm. The distance between the upper ends of the two dolly surfaces 436*a*; 436*b* is about 23-25 mm and the distance between lower ends of the two dolly surfaces 436*a*; 436*b* is about 14-15 mm. The diameter of the elongated and elastic tube chamber may be 13-14 mm and a length from the dispensing end to the cap of about 50-56 mm.

A dispensing system 1 having the dispenser 100 of FIG. 1 that contains the adaptor assembly 400 according to the disclosure and the fluid container 200 having the pump 300*b* of the second type are mounted may provide a dispensing cycle of dispensing a fluid with low energy consumption. The dispensing cycle includes displacing the moving part 430 from the lowermost position to its uppermost position and returning the moving part 430 the lowermost position. The energy consumption of the adaptor assembly 400 described so far may be lower than 1100 μWh, e.g. 300 to 1000 μWh or 500 to 1000 μWh. The energy consumption may be measured by using an Otii analyzer that is a power analyzer from Qoitech.

FIG. 10 shows a partial cross-sectional view of an embodiment of the adaptor assembly of FIGS. 6A and 6B including the upper fluid container support 410, the actuation parts 420*a*; 420*b* and the lower moving part 430. In this view, the actuation parts are in the snap-fit engagements with the moving part 430, as described hereinabove. Thus, the actuation parts 420*a*; 420*b* form types of cantilever snap-fit beams with hook elements 421*a*; 421*b* that subject to bending loads engage their snap-fit mating parts of the two snap-fit supports 437*a*; 437*b* and the two snap-fit cut-outs 438*a*; 438*b* of the moving part 430. Below and from the two snap-fit cut-outs 438*a*; 438*b* are the dolly surfaces 436*a*; 436*b* that extend with oblique angles downwards and inwards in directions ($C_1$; $C_2$) towards each other to form a tapering cavity portion therebetween that ends in a lower narrow portion connected to two vertical surfaces 445*a*; 445*b* facing each other. The lateral dimension between the two vertical surfaces 445*a*; 445*b* may substantially match the outer diameter of the elongated tube of the pump 300*b*, see FIG. 12B.

The both dolly surfaces 436*a*; 436*b* also face each other and provide sliding surfaces for the actuation heads 426*a*; 426*b* to slide along, when the moving part 430 is moved upwards in an axial direction (A) in order to perform a single pumping action. As the moving part 430 moves upwards, the dolly surfaces 436*a*; 436*b* forming sliding surfaces also move upwards causing the actuation heads 426*a*; 426*b* to be displaced towards each other from their non-actuated positions to their actuated positions. A movement of the moving part 430 from its lowermost position to its uppermost position by a distance $D_2$ with respect to the fluid container support 410 causes the portions of the second contact surfaces 428*a*; 428*b*, that are configured to abut against the elongated and elastic tube chamber 300*b* placed therebetween, be laterally displaced towards each other by distances $d_1$ and $d_2$ as illustrated in FIG. 10. The lateral displacement of each portion of the second contact surfaces 428*a*; 428*b* may provide a ratio between distance d1; d2 and the distance D2 of about ⅓ for providing a proper single pumping action. For example, D2 may be 12 mm, d1 may be 4 mm and d2 may be 4 mm.

As shown in FIG. 10, the portion of the middle and lower first surface portions 427*a*2; 427*a*3; 427*b*2; 427*b*3 of each actuation head 426*a*; 426*b*, being in the non-actuated position, bears on the respective dolly surface 436*a*; 436*b* just below the snap-fit cut-out 438*a*; 438*b* in the moving part 430 being in its lowermost position. A displacement of the moving part 430 upwards will also move the dolly surfaces upwards causing the first contact surfaces 427*a*; 427*b* to slide along the moving dolly surfaces 436*a*; 436*b*. The upper edges of the moving dolly surfaces 436*a*; 436*b* will act on surface portions of the hook elements 421*a*; 421*b* to move the actuation heads inwardly following the shapes of the hook elements 421*a*; 421*b*. The bearing contacts between the dolly surfaces 436*a*; 436*b* and the portions of the middle and lower first surface portions 427*a*2; 427*a*3; 427*b*2; 427*b*3 will be moved to bearing contacts between the dolly surfaces 436*a*; 436*b* and the upper surface portions 427*a*1; 427*b*1 of the first contact surfaces 427*a*; 427*b* formed on the hook elements 421*a*; 421*b*. The upper surface portions 427*a*1; 427*b*1 will then abut and slide along the dolly surfaces during the upwards displacement of the moving part 430 causing the actuation heads 426*a*; 426*b* to be displaced to their actuated positions.

As also shown in FIG. 10, the second contact surfaces 428*a*; 428*b* are convex surfaces in the vertical direction. The radius (r) of the convex surface may be about 10-18 mm.

Figure 11A:
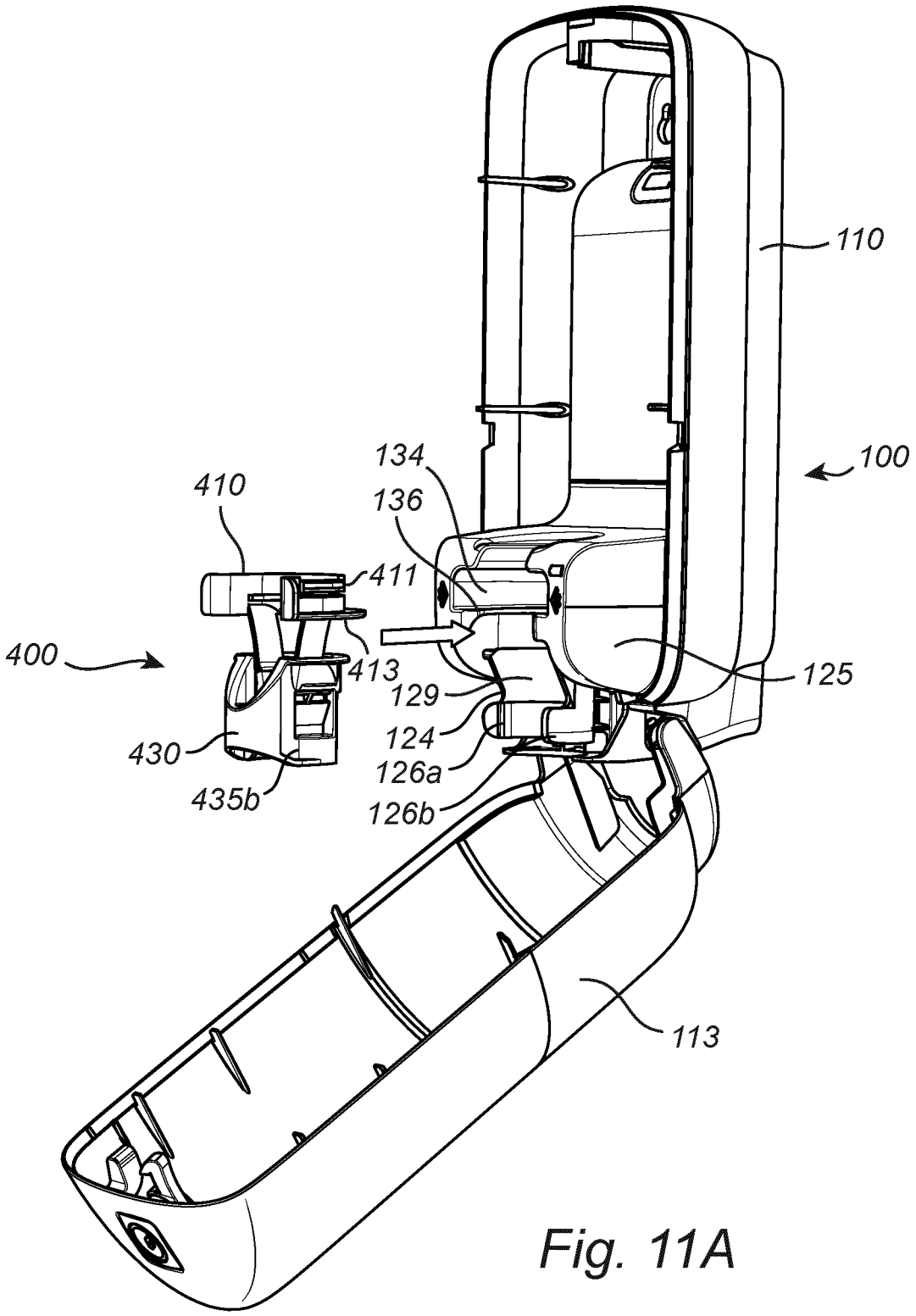
FIGS. 11A and 11B shows schematically an assembly of a fluid dispensing system including the dispenser of FIG. 1, a disposable container of FIG. 5 and the adaptor assembly of FIGS. 6A and 6B.
Figure 11B:
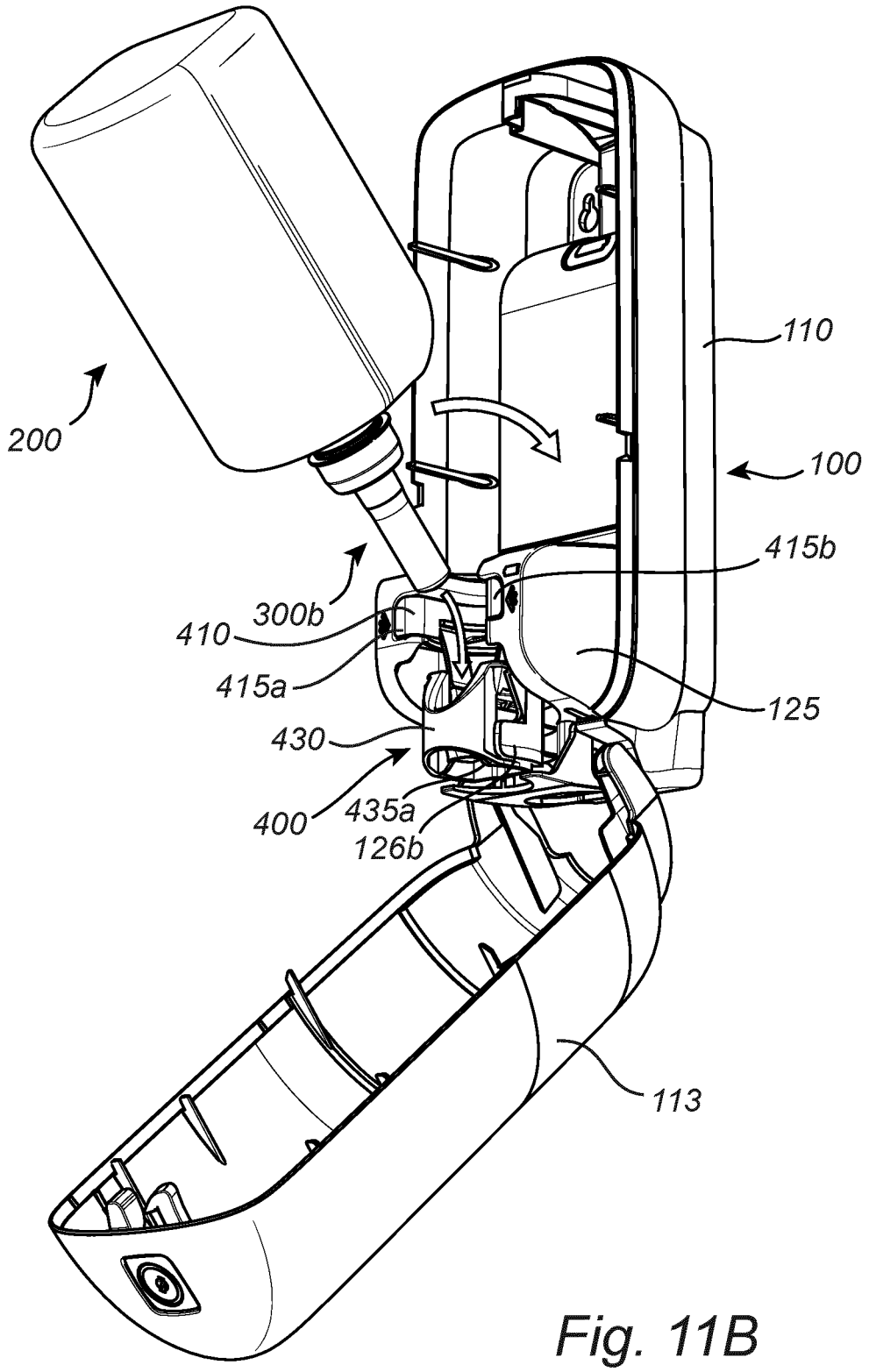

FIGS. 11A and 11B schematically illustrate an assembly of a fluid dispensing system 1 including the dispenser 100 of FIG. 1, a disposable container of FIG. 5 and the adaptor assembly 400 of FIGS. 6A and 6B.

At the front portion 112 of the dispenser 100, the housing forms a front cover 113 being pivotally connected to the rear portion 110 at the lower end portion 102 thereof. The front cover 113 is opened by unlocking the lock 118 at the upper end thereof and rotating the cover about its pivot at the lower end to expose the interior of the dispenser 100. At the lower end portion of the rear portion 110 is the dispensing unit 125, i.e. portion for holding fluid container 200 and the pump. As shown in FIG. 11A, the adaptor assembly 400 is inserted into the dispenser 100 and the dispensing unit 125 thereof from the front into the dispensing unit 125 by inserting the fluid container support 410 with the rounded portion of the U-shaped element 411 of the fluid container support 410 facing towards rear portion 110 of the dispenser 100 into the cavity portion 134 of the dispensing unit 125 and by inserting the moving part 430 into the lifter cavity 129 of the lifter 124 until the outer rounded portions of the arms 126*a*; 126*b* of the lifter 124 are in snap-fit engagements with the recessed portions 435*a*; 435*b* of the moving part 430. The laterally extending flange 413 of the fluid container support 410 rests on the seat of the dispenser 100 formed by the locating flange shelf 136 of the dispensing unit 125, when the adaptor assembly 400 has been mounted in the dispensing unit 125.

Figure 12A:
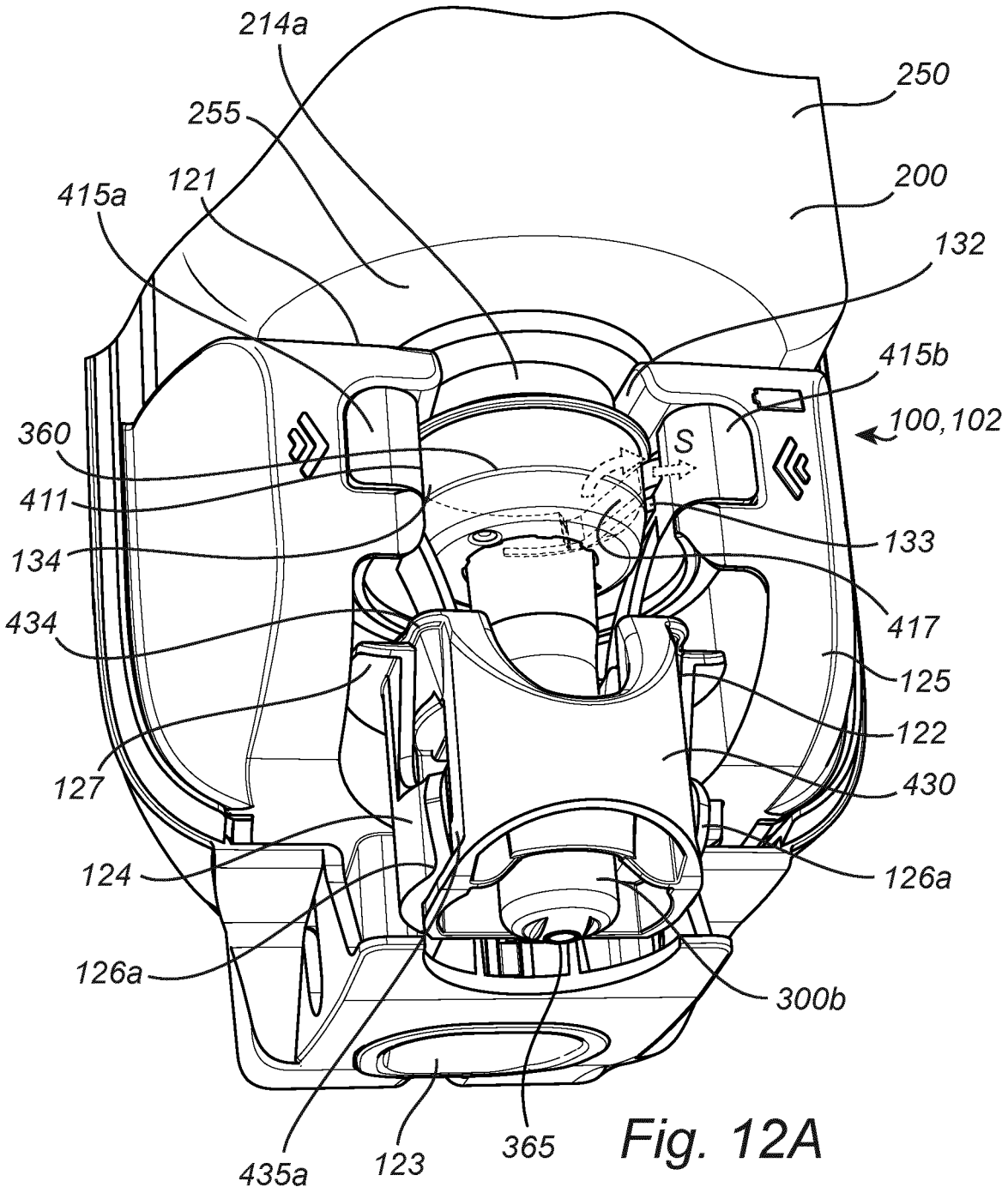
FIG. 12A shows a perspective view of a lower end portion of the fluid dispensing system formed from the parts shown FIGS. 11A and 11B with the front cover removed and viewed from the front and partly from below to show details of the interior of the fluid dispensing system.
Figure 12B:
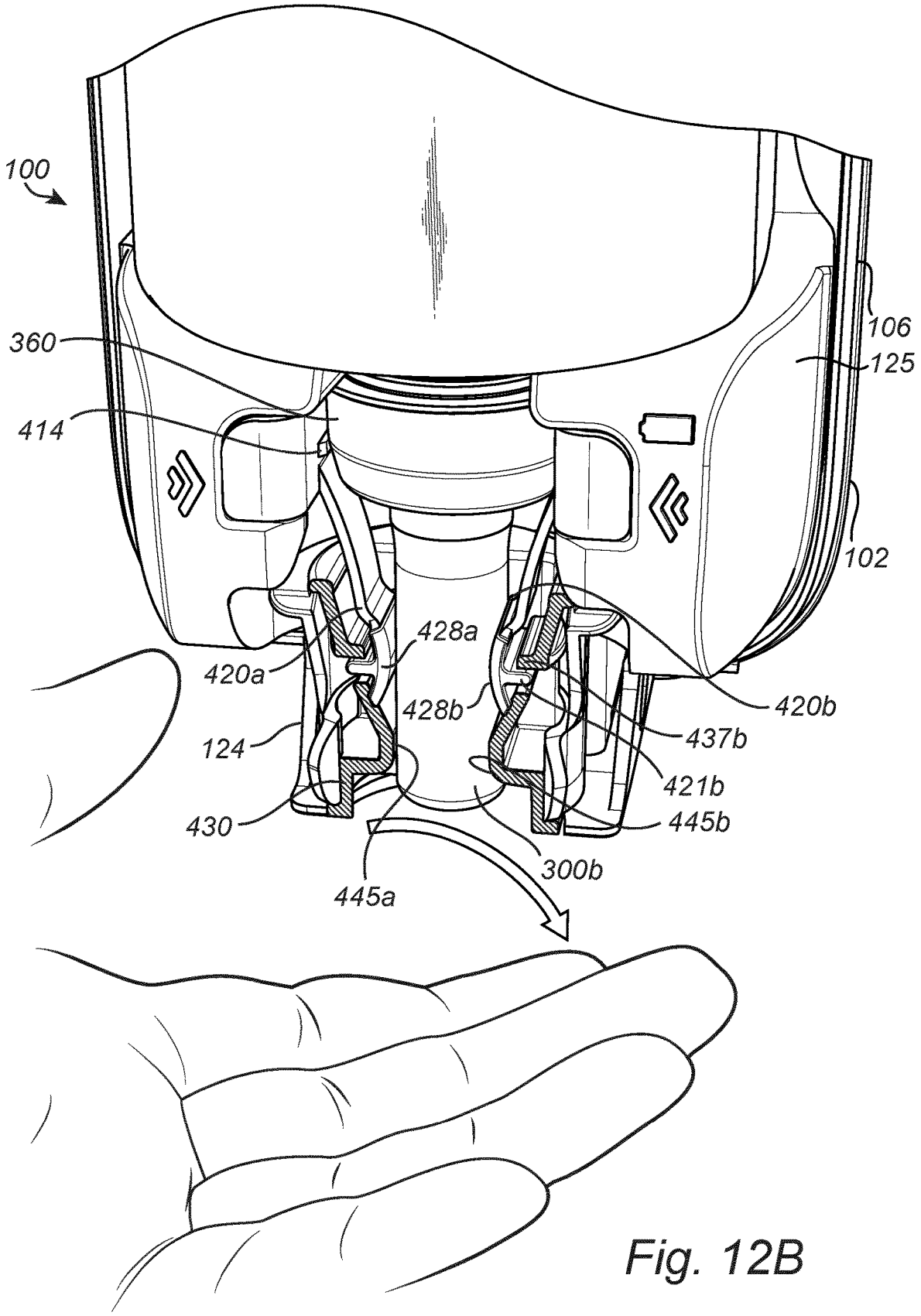
FIGS. 12B and 12C show perspective views of a lower end portion of the fluid dispensing system formed from the parts shown in FIGS. 11A and 11B with the front cover removed and viewed from the front to show details of the interior of the fluid dispensing system in operation.

The dispenser 100 carrying the inserted adaptor assembly 400 is shown in FIGS. 11B and 12A, wherein the positioning flanges 415*a*; 415*b* of the fluid container support 410 match the shapes and dimensions of outer front side edge portions of the flange engagement portion 134 and thereby being aligned with the front of the dispensing unit 125, wherein the flanges 415*a*; 415*b* provide a proper insertion of the adaptor assembly 400 into the dispensing unit 125. These flanges 415*a*; 415*b* may prevent the lateral, rotational and/or axial movement of the cap receiving portion 411 mounted in the dispensing unit 125. When the adaptor assembly 400 has been fully inserted, the lower end of the adaptor assembly 400 is located close to the bottom of the dispenser 100.

As schematically illustrated in FIG. 11B, the next step in the assembly of the fluid dispensing system 1 is to insert the fluid container 200 into the dispenser 100 now holding the adaptor assembly 400. The fluid container 200 is tilted and inserted with its pump 300*b* of an elongated and elastic tube chamber 300*b* moved with an angle from above into the central through-opening 412 of the fluid container support 410 and the through-opening 432 of the moving part 430 until the connector cap 360 of the fluid container 200 can be inserted from the front by rotating the fluid container 200 into its fully inserted and upright position.

Attention is drawn to the fact that the adaptor assembly 400, provided with the central through-opening 412 of the fluid container support 410 that is accessible from the front and optionally the access opening 433 and access cavity 440 of the moving part 430, allows the replacement of a fluid container 200 without removing the adaptor assembly 400 as such. The openings 412; 432 are shaped and dimensioned to allow the pump 300*b* of the second type to be inserted through them.

The assembly of the fluid dispensing system 1 is then finalized by closing the dispenser 100 by moving the upper portion of the front cover 113 to the rear portion 110 and, optionally locking the cover 113 to the rear portion 110 of the dispenser 100. The dispenser 100 is then ready for use.

FIG. 12A shows a perspective view of the lower end portion of the fluid dispensing system 1 formed from the parts shown in FIGS. 11A and 11B with front cover 113 removed and viewed from the front to show details of the interior of the fluid dispensing system 1.

According to FIG. 12A, the fluid container 200 and a bottom surface 255 of the fluid reservoir 250 rests on a seat in the dispenser 100 that is formed by an upper surface 121 of the protruding portion 128 of the dispensing unit 125, also see FIG. 4A. The rigid neck 214*a* of the fluid reservoir 250 is housed in the neck engagement portion 132 and the connector cap 360 is partly enclosed and engaged within the cavity portion 134. The moving part 430 engages the pump engagement portion 122 of the lifter 124 as described hereinabove and partly encloses the pump 300*b* of the second type.

In the upper portion of the cap receiving portion 411 and the wall thereof, there is the elastic and flexible switch displacing arm 417 extending from a rear portion of the wall towards the front. As shown in FIG. 12A, the inserted connector cap 360 has laterally moved the switch displacing arm 417 in a rotational direction S from its rest position to the switch-actuated position so that the recognizing switch 133 formed in the locating flange engagement portion 134 has been moved in a sideward direction and actuated. As mentioned hereinabove, the actuation of this recognizing switch 133 triggers the dispenser 100 to recognize that a new refill 200 has been inserted into the dispenser 100.

The fluid pump 300*b* of the second type being an elongated and elastic tube chamber 300*b* extends downwards from the fluid container 200 and between the second contact surfaces 428*a*; 428*b* of the actuation part 420*a*:420*b* to the nozzle 365 at the bottom of the dispenser 100. The nozzle 365 is placed at the lowermost part of the dispenser 100 so as to prevent the risk of having any dispensing part contaminated upon dispensing any fluids from the fluid container 200, but at the same time not being clearly visible for a user, when using the dispenser 100. The position of the nozzle 365 depends on, for example, the dimensions of the fluid container 200 and the position the fluid container 200 can have in the dispenser 100. The skilled person appreciates how to adopt the adaptor assembly 400 or its position it has in the dispenser 100 so as to adjust the position of the nozzle 365.

Figure 12C:
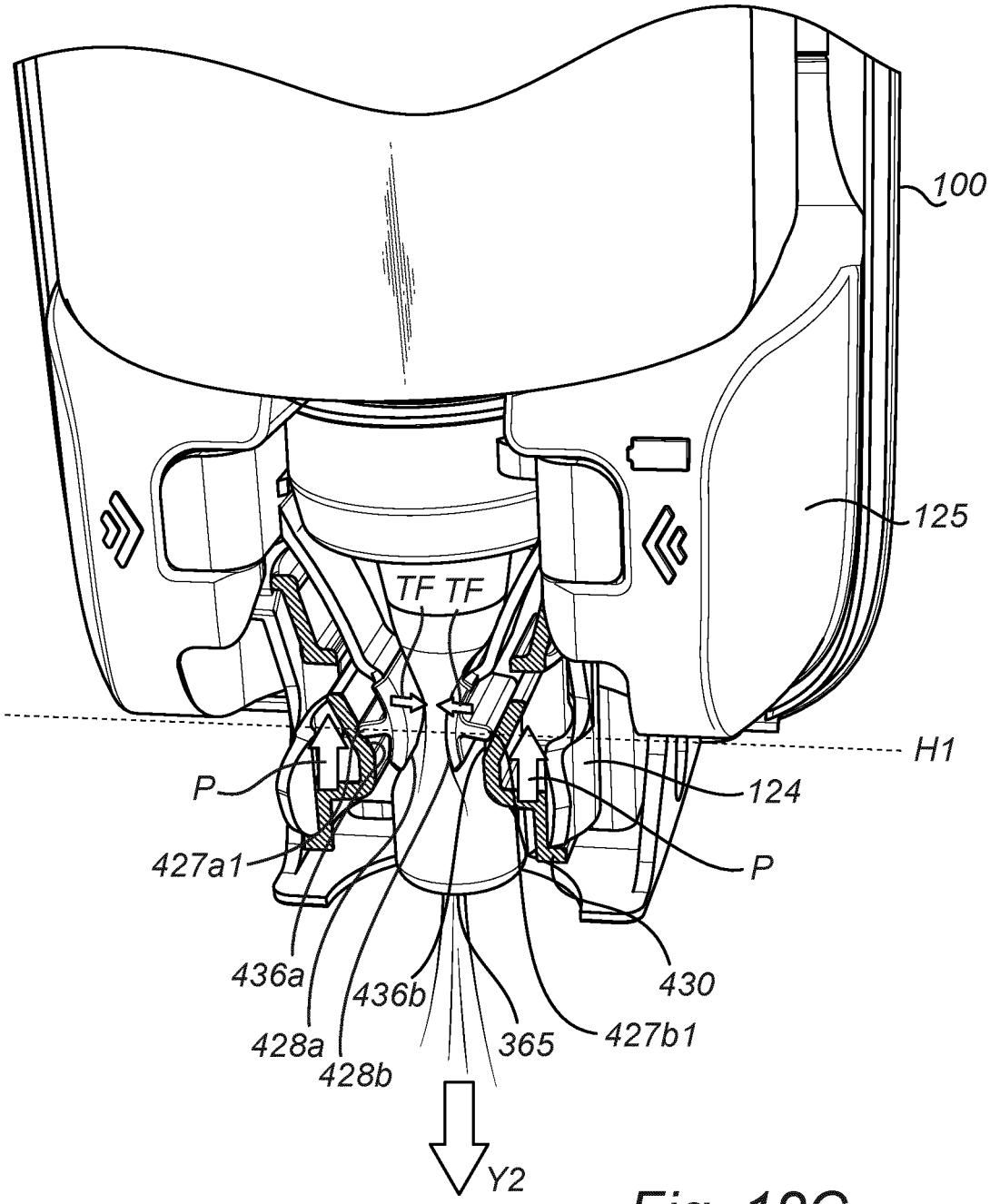

FIGS. 12B and 12C show perspective views of a lower end portion of the fluid dispensing system 1 formed from the parts shown in FIGS. 11A and 11B with front cover 113 of the dispenser 100 removed to show details of the interior of the fluid dispensing system 1 in operation.

In FIG. 12B, the fluid pump 300*b* of the second type being an elongated and elastic tube chamber 300*b* extends downwards from the connector cap 360 of the fluid container 200 and between actuation parts 420*a*; 420*b* and the second contact surfaces 428*a*; 428*b* of the actuation heads 426*a*; 426*b* located in the through-opening 432 of the moving part 430 to the nozzle 365 at the bottom of the dispenser 100. In this view, the lifter 124 and the moving part 430 are in their lowermost positions, i.e. their rest positions. In these positions, the actuation parts 420*a*; 420*b* and their actuation heads 426*a*; 426*b* are kept in their non-actuated positions between the moving part 430 and the elongated and elastic tube chamber 300*b* forming the pump 300*b* of the second type. As envisage from FIGS. 10 and 12B, the actuation heads 426*a*; 426*b* are both in their non-actuated positions, in which snap-fit hook elements 421*a*; 421*b* are engaged with their respective mating snap-fit part 437*a*; 437*b*; 438*a*; 438*b*. At least a portion of the middle and lower first surface portions 427*a*2; 427*a*3; 427*b*2; 427*b*3 of each actuation heads 426*a*; 426*b* bear on the respective dolly surface 436*a*; 436*b* just below the snap-fit cut-out 438*a*; 438*b* in the moving part 430, see FIG. 10.

As shown in FIG. 12B, the second contact surfaces 428*a*; 428*b* are facing each other and are in their non-actuated positions laterally distanced from each other with portions thereof abutting against the elongated and elastic tube chamber 300*b* placed therebetween, so that a pump 300*b* of the second type placed therebetween in the dispenser 100 and in the non-actuated position should be in a non-compressed and non-distorted form, and still providing a sufficient dispensing when actuated. Thus, the minimum lateral dimension between the two second contact surfaces 428*a*; 428*b* in the non-actuated position is slightly larger or substantially matches the outer diameter of the elongated tube of the pump 300*b*. As shown in FIG. 12B, the adaptor assembly 400 is configured so that second contact surfaces 428*a*; 428*b* abut against the pump 300*b* of the second type in the central portion thereof, so as to provide a proper actuation of dispensing. Furthermore, the lateral dimension between the two vertical surfaces 445*a*; 445*b* is slightly larger or substantially matches the outer diameter of the elongated tube of the pump 300*b*.

The adaptor assembly 400 may also be modified to adjust the position it has in relation to the pump 300*b* as well as to the shape of the pump 300*b* and the maximum volume desired to be dispensed from the fluid container 200. Some examples of dimensions and shapes of the adaptor assembly 400 have been presented hereinabove for the embodiment now shown in FIG. 12B. These dimensions and shapes may also be envisaged for other embodiments shown herein. For example, the dimensions of the actuation heads 426*a*; 426*b* may be adjusted so that a pump 300*b* of the second type placed therebetween in the dispenser 100 and in the non-actuated positions should still be in the non-compressed and non-distorted form, and still providing a sufficient dispensing when actuated. Optionally, the shapes and dimensions may be adjusted to allow the actuation heads 426*a*; 426*b* to rest on the pump 300*b* in prestressed manners in the non-actuated positions to allow an immediate and proper dispensing when the actuation head 426*a*; 426*b* are moved to activated positions.

FIG. 12B also shows the fluid dispensing system 1 when a user's hand located below the dispenser 100 is identified by the sensor 123. FIG. 12C then shows the dispensing system 1, when the user's hand has been identified by the sensor 123, wherein the motor has been activated and the lifter 124 that is operably connected to the motor has moved upwards and exerted an upwardly-directed force (P) on the moving part 430 that has caused the moving part 430 to be displaced from its lower position to an upper position. The displacement of the moving part 430 has displaced the actuation heads 426*a*; 426*b* from their non-actuated positions towards actuated positions and towards the pump 300*b*, wherein the pump 300*b* is laterally compressed between the two second contact surfaces 428*a*; 428*b* of the actuation heads 426*a*; 426*b*, wherein an actuation force TF is transferred from the moving part 430 via the actuation parts 420*a*; 420*b* and the second contact surfaces 428*a*; 428 to the pump 300*b*. This has caused fluid to be dispensed downwardly in a direction Y2 from the fluid container 200 and the nozzle 365 thereof. In FIG. 12C, the upper surface portions 427*a*1; 427*b*1 abut the dolly surfaces 436*a*; 436*b*, when the actuation heads are in their full actuated positions. A horizontal plane H1 through the first and second actuation heads 426*a*; 426*b* that are in their fully actuated positions will then intersect portions of the first and second dolly surfaces 436*a*; 436*b* that are in contact with portions of the first contact surfaces 427*a*; 427*b* of the actuation heads. This secures a good force transfer from the lifter 124 to the pump 300*b* for dispensing a dose of a fluid.

Once the lifter 124 is in its uppermost position, the lifter 124 and moving part 430 moves downwards to the positions they had before the user's hand was identified to actuate the dispensing of fluid. The actuation heads 426*a*; 426*b* are then returned to their non-actuated positions, when refilling of the pumping chamber occurs by the provision of a filling force being provided by, inter alia, the inherent resilience of the wall of the pumping chamber 300*b* (not shown). The returning of the actuation heads 426*a*; 426*b* is also supported by the bending load of the actuation arms 422*a*; 422*b* that spring the actuation heads 426*a*; 426*b* outwardly.

Figure 13B:
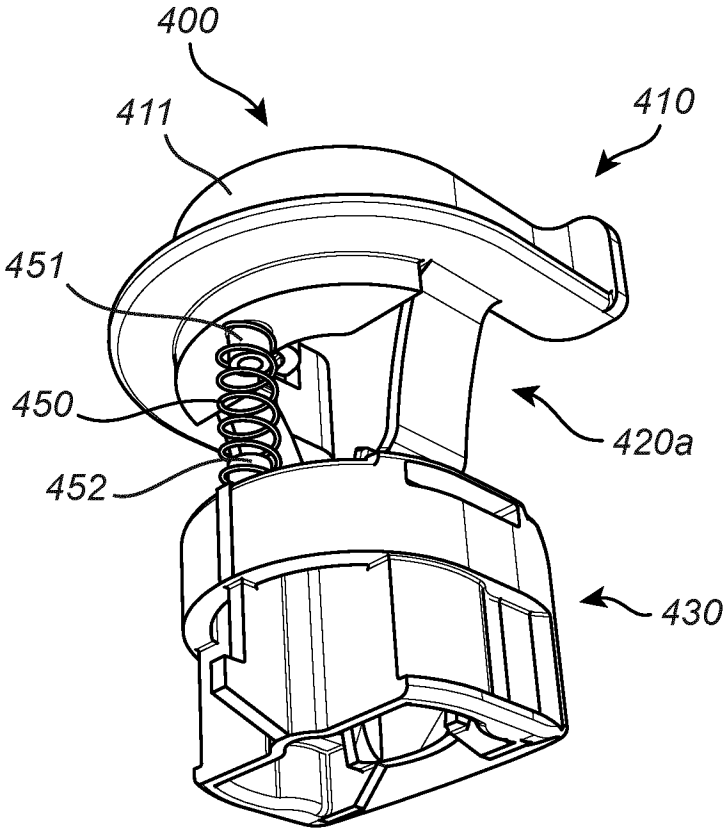
FIGS. 13A and 13B are perspective views of an embodiment of an adaptor assembly.
Figure 13A:
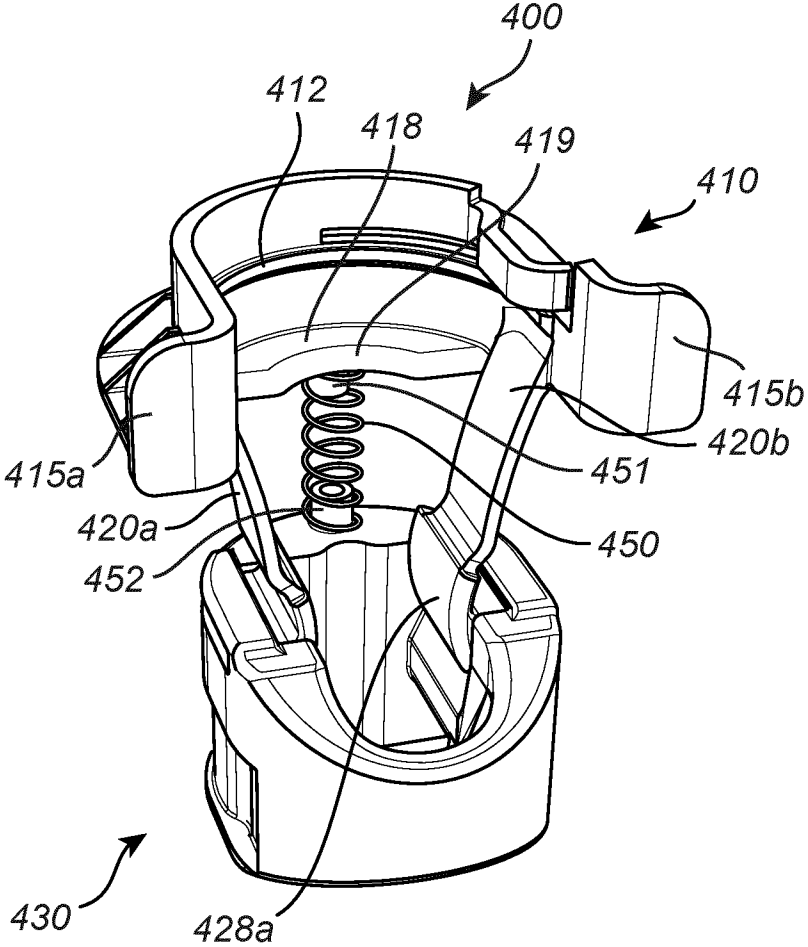

FIGS. 13A to 13B show an embodiment of an adaptor assembly 400 to be used with a fluid container 200 with a pump 300*b* of the second type, in particular the fluid container 200 with the elastic and elongated tube chamber 300*b* as shown in FIG. 5.

The adaptor assembly 400 is a variant of the embodiment shown in FIGS. 6A and 6B, with few differences only. The differences relate to a spring 450 being mounted between a rear bottom surface of the fluid container support 410 and a rear upper surface of the moving part 430. The shown spring 450 is a coil spring being connected at its ends to a pin 451 protruding from the bottom surface of the fluid container part and a pin 452 protruding from the upper surface of the moving part 430. The use of a spring 450 may support the proper movement of the moving part 430 as well the configuration it has to allow a proper mounting of the adaptor assembly 400 into the dispensing unit 125. The use of a spring may particularly be useful if, for example, the flexible and elastic arms of the actuation parts 420*a*; 420*b* that allow for the movements of the actuation heads 426*a*; 426*b* are made of a very soft, flexible and less elastic material, or if the arms are shaped and dimensioned differently that would not provide a spring returning force that could support the actuation parts 420*a*; 420*b* and the moving part 430 to return to their non-actuated position and lower position, respectively.

In the FIGS. 13A and 13B, like numbers refer to like elements shown for the embodiments of FIGS. 6A and 6B as described hereinabove and reference is made to details described in relation to the embodiment shown in FIGS. 6A and 6B. The assembly of a fluid dispensing system 1 comprising the adaptor assembly 400 of FIGS. 13A and 13B resembles the assembly of the fluid dispensing system 1 as shown in FIGS. 11A and 11B. The operation of fluid dispensing system 1 with the adaptor assembly 400 of FIGS. 13A and 13B is the same as for the fluid dispensing system 1 of FIGS. 11A and 11B as shown in FIGS. 12B and 12C.

Figure 14A:
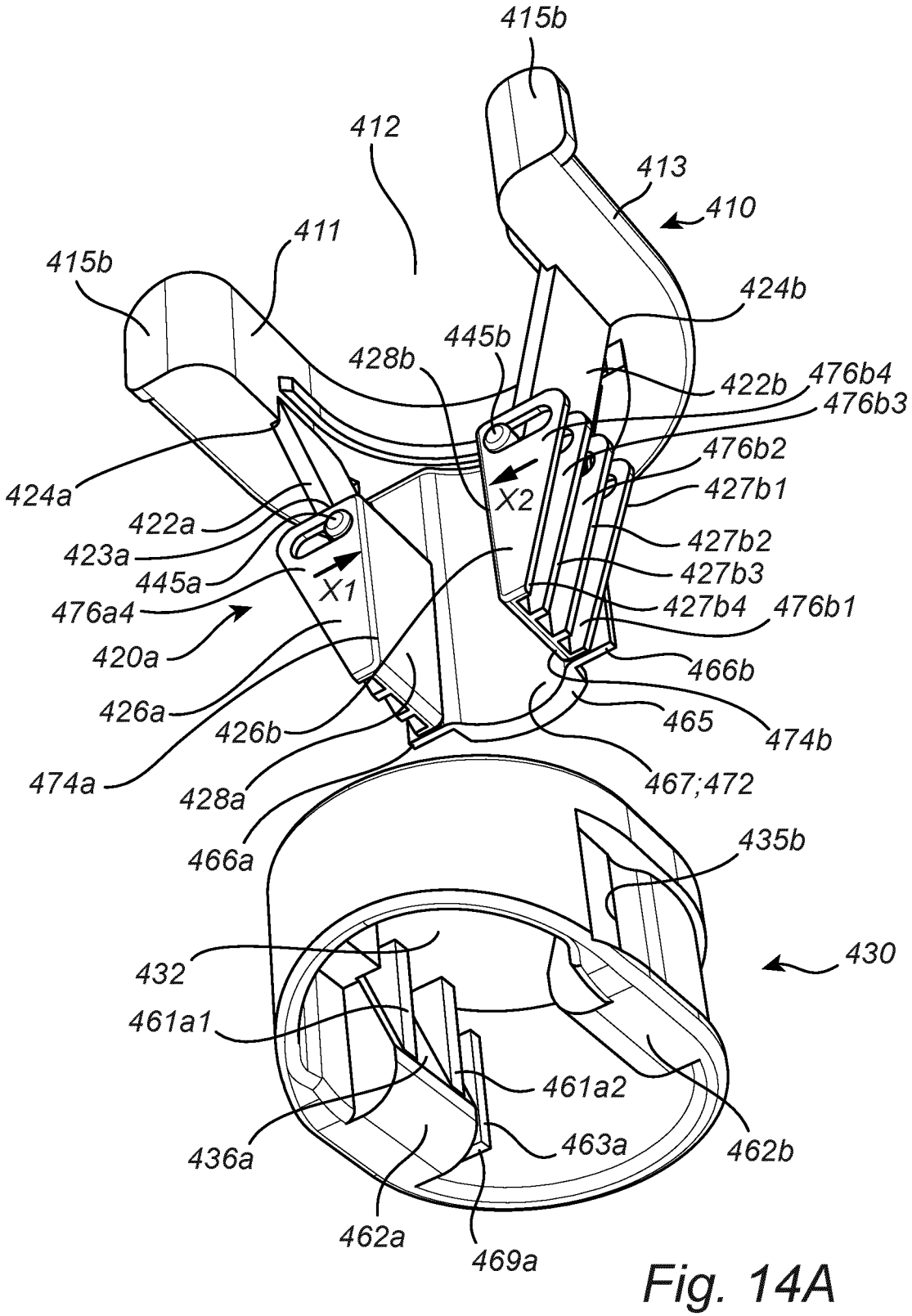
FIGS. 14A to 14C are perspective views of an embodiment of an adaptor assembly.
Figure 14C:
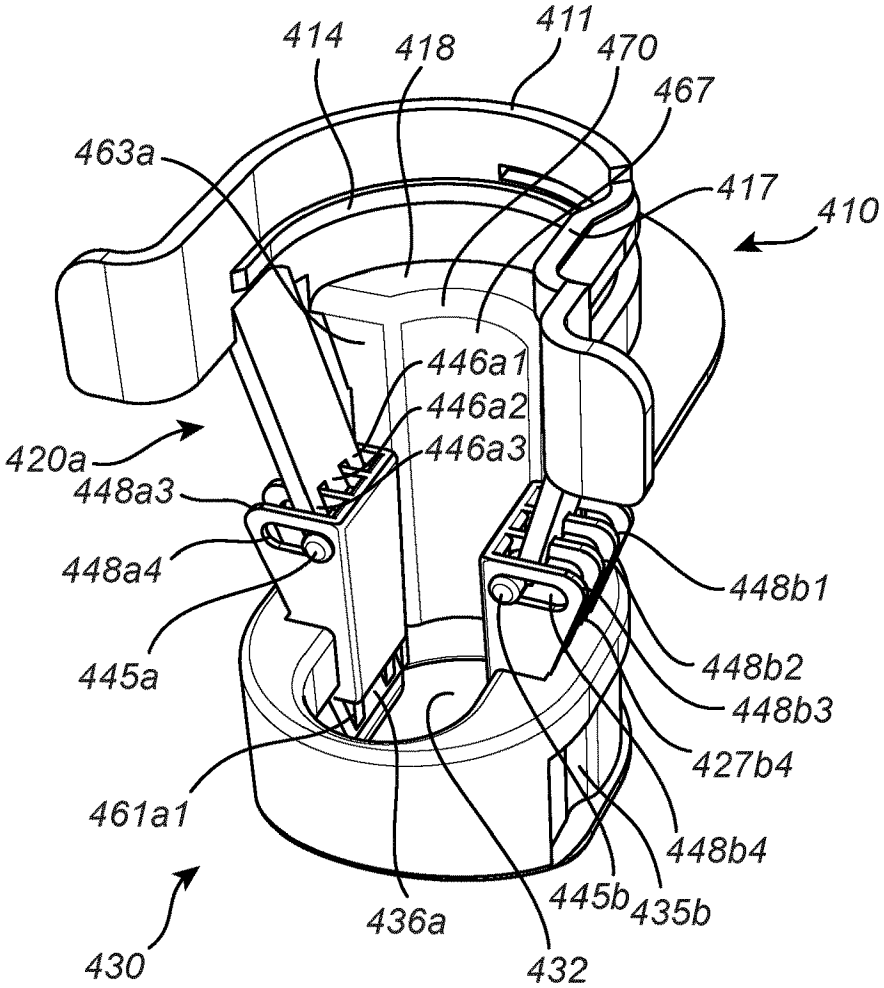
Figure 14B:
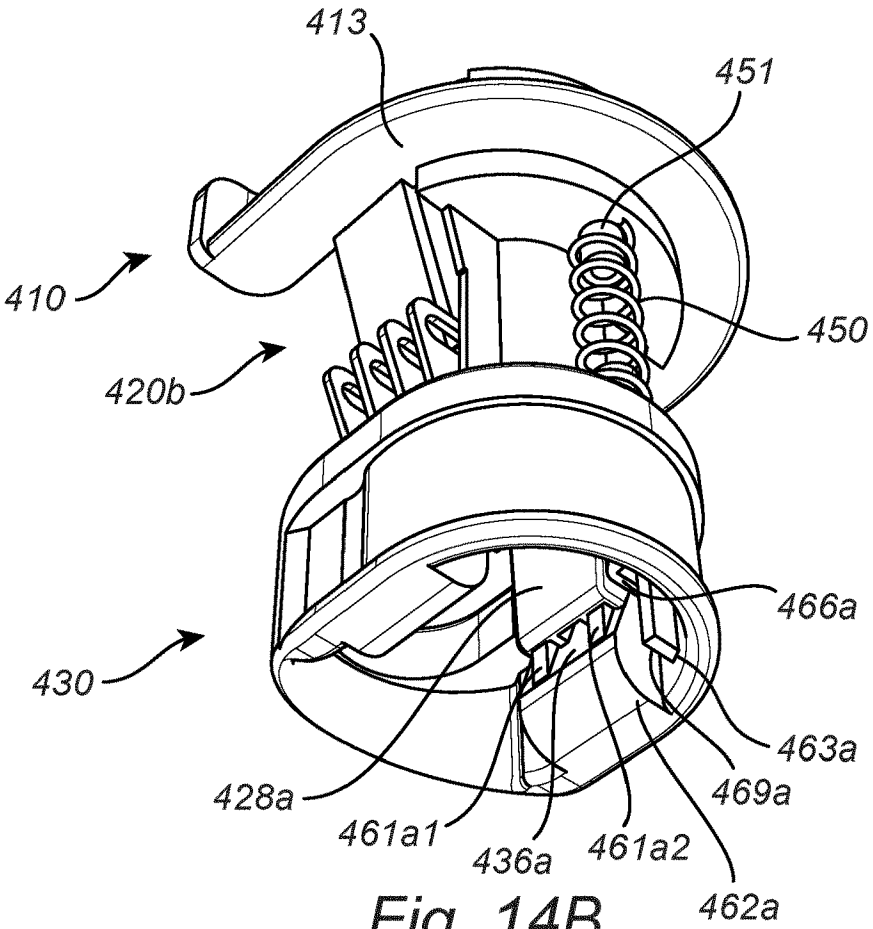

FIGS. 14A to 14C are perspective views of an embodiment of an adaptor assembly 400 to be used with a fluid container 200 with a pump 300*b* of the second type, in particular the fluid container 200 with the elastic and elongated tube chamber 300*b* as shown in FIG. 5.

The adaptor assembly 400 is in general similar to the embodiment shown in FIGS. 6A and 6B as well to the embodiment shown in FIGS. 13A and 13B, with a few differences only. The adaptor assembly 400 comprises a fluid container support 410, two actuation parts 420*a*; 420*b* and a moving part 430. FIG. 14A shows the parts of the adaptor assembly 400 that has not been assembled to form the adaptor assembly 400. FIGS. 14B and 14C show in different views of the adaptor assembly 400 with its part assembled.

In the FIGS. 14A to 15B, like numbers refer to like elements shown for the embodiments of FIGS. 6A, 6*b*, 13A and 13B as described hereinabove and reference is made to details described in relation to these embodiments.

The fluid container support 410 of the adaptor assembly 400 as shown in FIG. 14A is similar to the one described in the embodiments hereinabove. It includes the cap receiving portion 411 being a U-shaped element forming a cavity 412 that extends in a vertical direction and providing a central through-opening 412 for receiving and engaging the connector cap 360 and the of the fluid container 200 of FIG. 5.

One difference is that a vertical rear wall 472 extends downwards from the fluid container support 410 and the supporting flange 418 that laterally extends into the cavity 412 from rear portion of the fluid container support 410. This rear wall 472 has a central rounded vertical cavity 467 that is formed on the inner surface of the rear wall 472 and that extends in a downward direction. On each side of the cavity 467 there are two flat wall edge portions 466*a*; 466*b* that extend along the cavity 467 downwards from the supporting flange 418 of the fluid container support 410. The wall edge portions 466*a*; 466*b* are configured to movably connect the fluid container support 410 to the moving part 430. The wall edge portions will movably engage grooves 469*a* between by two vertical flanges 463*a*; 463*b* extending from opposite sides in the opening 412 and dolly portions 462*a*; 462*b* of the moving part 430 that are arranged in front of the two vertical flanges 463*a*; 463*b* and protrude from opposite sides in the through-opening 432. The dolly portions 462*a*; 462*b* carry the dolly surfaces 436*a*; 436*b* of the moving part 430. Thus, there are formed two grooves 469*a*; 469*b* that are formed on opposite sides of the through-opening 412 of the moving part 430 and that in form can movably engage the two vertical flanges 463*a*; 463*b* of the rear wall 472 to allow the axial displacement of the moving part 430 in relation to the fluid container support 410 and the actuation parts 420*a*; 420*b*. Thus, the wall 472 will extend into the through-opening 430 of the moving part 430 at the rear portion thereof and provide a guided movement of the moving part 430 in relation to the fluid container support 410. The vertical cavity 467 may support a proper insertion of the fluid container 200 into the dispenser 100 as well as a proper support of the pump 300*b*, when the fluid container 200 is mounted in the dispenser 100.

The skilled person appreciates that the fluid container support 410 may adopt other shapes than the U-shaped one, including but not limited to a polygonal shape that still may form the support for fluid container 200 and the connector cap 360 or the like and form an engagement with the U-shaped cavity portion 134 forming the locating flange engagement portion 134 of the dispensing unit 125.

The adaptor assembly 400 further comprises the two actuation parts 420*a*; 420*b* as shown in FIGS. 14A to 14C. Also, in this embodiment, each actuation part 420*a*; 420*b* includes an elongated arm 422*a*; 422*b* that extends in a longitudinal direction thereof between two opposite ends 423*a*; 423*b*; 424*a*; 424*b* of the arm.

Each first end 424*a*; 424*b* is connected to the fluid container support 410 as described in relation to the embodiment of FIGS. 6A and 6B. The arms 422*a*; 422*b* extend from their first ends 424*a*; 424*b* in a direction downwards and towards each other to their second ends 423*a*; 423*b* that carry actuation heads 426*a*; 426*b* with first contact surfaces 427*a*; 427*b* for abutting against the dolly surfaces 436*a*; 436*b* and with second contact surfaces 428*a*; 428*b* for abutting against the pump 300*b* of the second type. Each shown second contact surface 428*a*; 428*b* is flat in its shape to allow a proper compression of the pump 300*b* in this embodiment. The second contact surfaces 428*a*; 428*b* face each other to allow the surfaces to abut against the pump 300*b* of the second type on opposite sides thereof, see FIG. 15A.

The skilled person appreciates that each second contact surface 428*a*; 428*b* may adopt other shapes and dimensions, including but not limited to being convex for smooth contact with the pump 300*b* or concave to match the pump shape, for example.

As shown in FIGS. 14A to 14C, each actuation head 426*a*; 426*b* is wedge-shaped with triangular-shaped surfaces facing to the front portion 112 and the rear portion 110 of the dispenser 1 and tapering downwards to a point. As mentioned above, each second contact surface 428*a*; 428*b* of the wedge-shaped actuation heads 426*a*; 426*b* is flat in its shape and is formed by a vertical wall element 474*a*; 474*b* extending in a rearward direction. Thus, each second contact surface 428*a*; 428*b* forms a vertical surface of the wedge-shaped heads 426*a*; 426*b*. From a wall side of the wall element 474*a*; 474*b*, being the opposite to the side of the wall side that forms the second contact surface 428*a*; 428*b*, four vertical flanges 476*a*1-*a*4; 476*b*1-*b*4 are extending outwards and perpendicularly. These vertical flanges 476*a*1-*a*4; 476*b*1-*b*4 present edge surfaces that faces away from each second contact surface 428*a*; 428*b* and forms first contact surface portions 427*a*1-*a*4; 427*b*1-*b*4. These contact surface portions 427*a*1-*a*4; 427*b*1-*b*4 extend with an oblique angle downwards and inwards towards the point of the wedge-shaped heads 426*a*; 426*b*.

The actuation heads 426*a*; 426*b* are both movable between their non-actuated positions and fully actuated positions to allow the pump 300*b* of the first type to be compressed between the two actuation heads 426*a*; 426*b*.

Figure 15A:
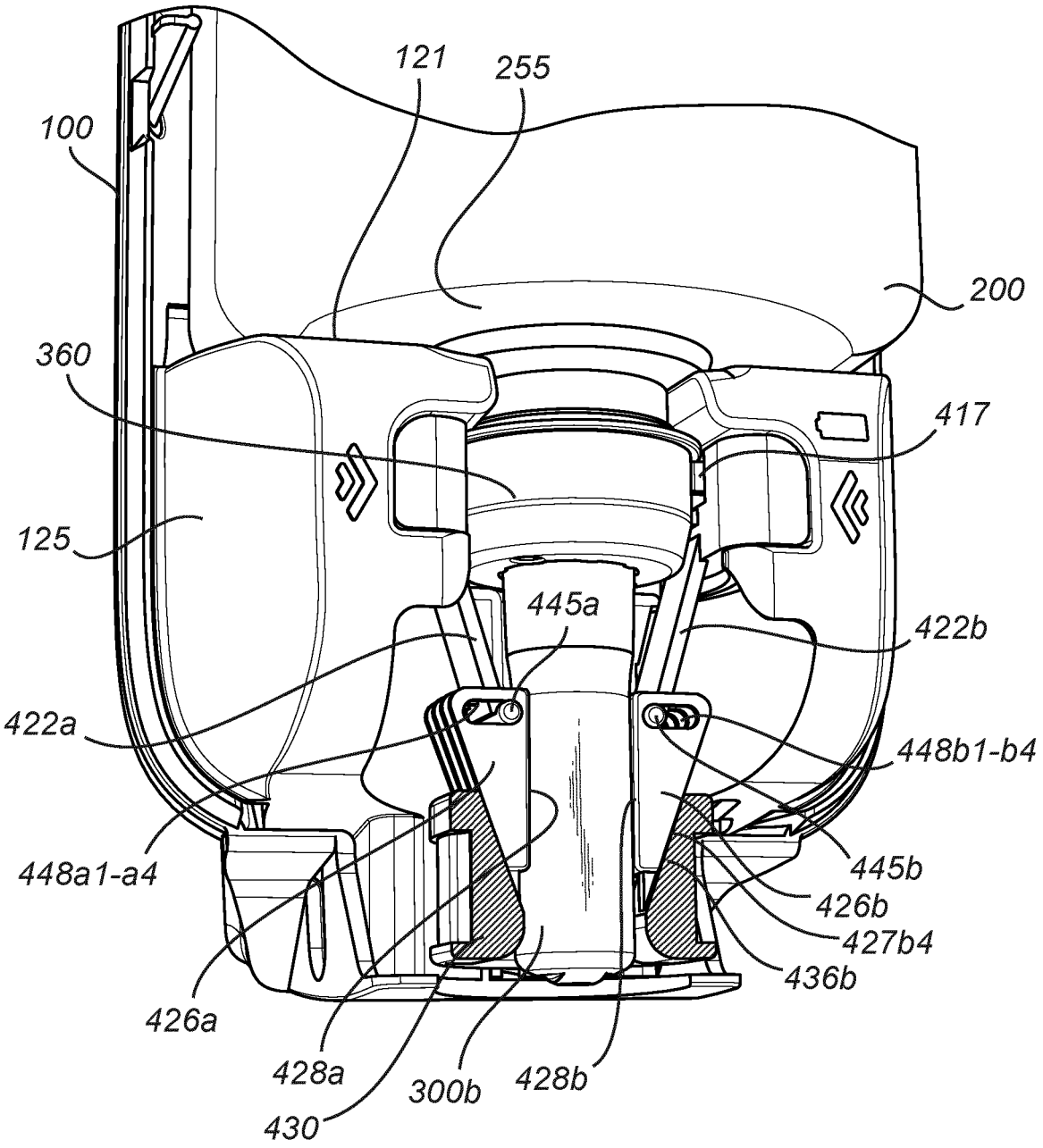
FIGS. 15A and 15B show perspective views of a lower end portion of the fluid dispensing system formed from the dispenser of FIG. 1, a disposable container of FIG. 5 and the adaptor assembly of FIGS. 14A to 14C with the front cover removed and viewed from the front to show details of the interior of the fluid dispensing system in operation.
Figure 15B:
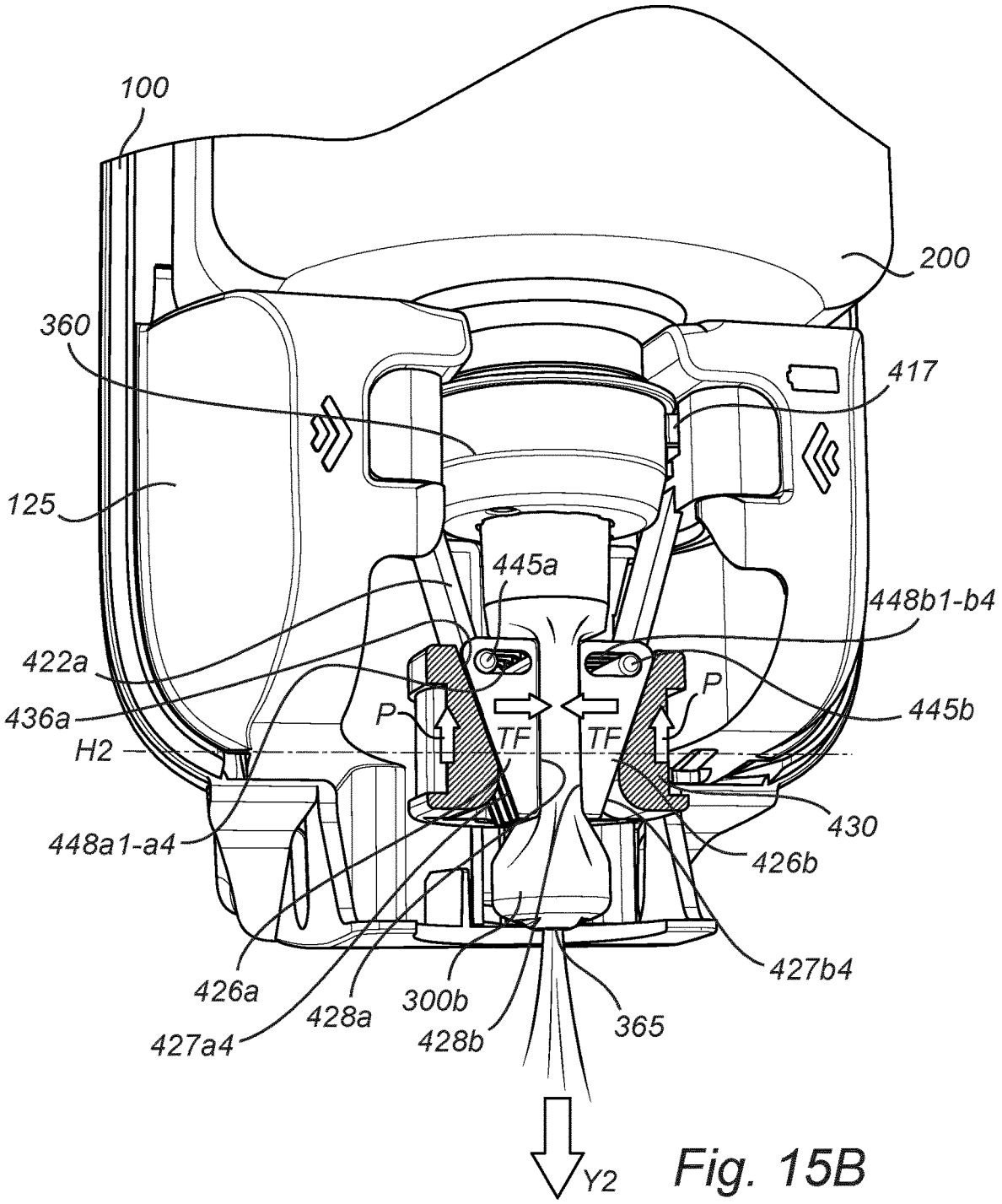

In the shown embodiment, the skilled person envisages that the arms 422*a*; 422*b* are fixedly connected to the fluid container support 410 and that the arms are made stiff. In this embodiment, actuation heads 426*a*; 426*b* are movably connected to the arms 422*a*; 422*b* to allow actuation heads to be displaced in lateral directions X1; X2 between their non-actuated positions and fully actuated positions. The second ends 423*a*; 423*b* of the arms 422*a*; 422*b* each has three finger-like portions 446*a*-446*a*3 configured to be inserted from the top of each actuation head 426*a*; 426*b* into cavities formed by the four vertical flanges 476*a*1-*a*4; 476*b*1-*b*4. The finger-like portions 446*a*-446*a*3 of each arm 422*a*; 422*b* are connected to a rod 445*a*; 445*b* extending rearwards. Each rod 445*a*; 445*b* fits within lateral cavities 448*a*1-448*a*4; 448*b*1-448*b*4 that are formed in each actuation head 426*a*; 426*b* between the vertical flanges 476*a*1-*a*4; 476*b*1-*b*4 at the upper portions thereof and that extend sideward to form elongated grooves 448*a*1-448*a*4; 448*b*1-448*b*4, in which the rod 445*a*; 445*b* fits to support a lateral movement of an actuation head 426*a*; 426*b* along lateral distances in the grooves 448*a*1-448*a*4; 448*b*1-448*b*4. This arrangement allows the actuation heads to be moved between the non-actuated positions to the fully actuated positions. The movements of the actuation heads 426*a*; 426*b* are shown in FIGS. 15A and 15B.

The skilled person also appreciates that other types of movable connections may be used for providing the movements of the actuation heads 426*a*; 426*b*. For example, the skilled person appreciates that it can be realized by movably connect the first ends 424*a*; 424*b* of the arms 422*a*; 422*b* to the fluid container support 410 and/or by making at least a portion of the arm flexible or elastic as has been described hereinabove.

The adaptor assembly 400 further comprises the lower part 430 forming the moving part 430 of the present disclosure that is configured to engage the pump engagement portion 122 of lifter 124 and partly enclose the pump 300*b* of the second type.

As set forth in FIGS. 14A to 14C, the moving part 430 forms a sleeve 430 with an axially extending through-opening 432, as described hereinabove.

The shapes and dimensions of the moving part 430 are configured to be partly enclosed and engaged by the lifter 124 of the dispenser 100. The skilled person appreciates that the moving part 430 may adopt any suitable shape and dimensions for engaging the lifter 124 as described hereinabove.

As described hereinabove, the moving part 430 is movably connected to the fluid container support 410 and the rear wall 472 thereof. In the central through-opening 432 of the moving part 430 on opposite side portions thereof between the front portion and the rear wall are the dolly portions 462*a*; 462*b* presenting dolly surfaces 436*a*; 436*b* facing the through-opening 432 of the moving part 430. The dolly surfaces 436*a*; 436*b* extend with oblique angles downwards and inwards in directions towards each other to form a tapering cavity portion therebetween. They extend in parallel direction to the directions in which the first contact surface portions extend in to form sliding contacts between the dolly surfaces 436*a*; 436*b* and the first contact surface portions 427*a*4; 427*b*1-427*b*4. There are two dolly protrusions protruding from each dolly surface forming vertical cavities therebetween. These protruding portions are configured to fit in the two outermost cavities formed by the vertical flanges 476*a*1-*a*4; 476*b*1-*b*4. In the adaptor assembly 400, the actuation heads contact the dolly surfaces 436*a*; 436*b* so that protruding portions of the dolly portions 462*a*; 462*b* and the vertical flanges 476*a*1-*a*4; 476*b*1-*b*4 of the actuation heads 426*a*; 426*b* are inserted into their respective cavities. In this arrangement, the dolly surfaces 436*a*; 436*b* will be in contact with the first contact surface portions 427*a*4; 427*b*1-427*b*4 of the actuation heads. Both dolly surfaces 436*a*; 436*b* provide sliding surfaces for the actuation heads 426*a*; 426*b* to slide along, when the moving part 430 is moved upwards to move the sliding surfaces 436*a*; 436*b* upwards causing the actuation heads 426*a*; 426*b* move into the tapering space between the dolly surfaces 436*a*; 436*b* and to be displaced towards each other from their non-actuated positions to their actuated positions.

As shown in FIGS. 14B and 14C, a spring 450 is mounted between a rear bottom surface of the fluid container support 410 and a rear upper surface of the moving part 430 in the rear of the vertical rear wall 472. The shown spring arrangement has been described in relation to the embodiment shown in FIGS. 13A and 13B.

According to the disclosure, suitable materials for forming the adaptor assembly 400 may be aluminum or any suitable plastics such as polyoxymethylene (POM), polyamide 12 (PA 12) and olefin plastics, e.g. polyethylene or polypropylene. The adaptor assembly 400 may be formed by injection molding, 3D printing or any other suitable method known to the skilled person. The mentioned materials and forming of the assembly can be used for all parts of the adaptor assembly and a combination of the materials may also be considered for adaptor assembly or parts thereof.

The assembly of a fluid dispensing system 1 comprising the adaptor assembly 400 of FIGS. 14B and 14C resembles the assembly of the fluid dispensing system 1 as shown in FIGS. 11A and 11B.

FIGS. 15A and 15B show perspective views of a lower end portion of the fluid dispensing system 1 formed from the dispenser 100 of FIG. 1, a disposable container of FIG. 5 and the adaptor assembly 400 of FIGS. 14A to 14C with the front cover removed to show details of the interior of the fluid dispensing system 1 in operation. The operation of fluid dispensing system 1 with the adaptor assembly 400 of FIGS. 14B and 14C is similar to the operation as described in relation FIGS. 12B and 12C.

In FIG. 15A, the fluid pump 300*b* of the second type being an elongated and elastic tube chamber 300*b* extends downwards from the connector cap 360 of the fluid container 200 and between actuation parts 420*a*; 420*b* and the second contact surfaces 428*a*; 428*b* of the actuation heads 426*a*; 426*b* located in the through-opening 432 of the moving part 430 to the nozzle 365 at the bottom of the dispenser 100. In this view, the lifter 124 and the moving part 430 are in their lowermost positions, i.e. their rest positions. In these positions, the actuation parts 420*a*; 420*b* and their actuation heads 426*a*; 426*b* are kept in their non-actuated positions between the moving part 430 and the elongated and elastic tube chamber 300*b* forming the pump 300*b* of the second type. The actuation heads 426*a*; 426*b* are both in their non-actuated positions and are partly connected to the dolly portions 462*a*; 462*b* with upper portions of the dolly surfaces 436*a*; 436*b* being in contact with lower portions of the first contact surface portions 427*a*4; 427*b*1-427*b*4.

As shown in FIG. 15A, the second contact surfaces 428*a*; 428*b* are facing each other and are in their non-actuated positions laterally distanced from each other with portions thereof abutting against the elongated and elastic tube chamber 300*b* placed therebetween, so that a pump 300*b* of the second type placed therebetween in the dispenser 100 and in the non-actuated position should be in a non-compressed and non-distorted form and still providing a sufficient dispensing when actuated, as described in relation to the embodiment of FIGS. 6A and 6B. Thus, the minimum lateral dimension between the two second contact surfaces 428*a*; 428*b* in the non-actuated position is slightly larger or substantially matches the outer diameter of the elongated tube of the pump 300*b*. Optionally, the shapes and dimensions may be adjusted to allow the actuation heads 426*a*; 426*b* to rest on the pump 300*b* in prestressed manners in the non-actuated positions to allow an immediate and proper dispensing when the actuation head 426*a*; 426*b* are moved to activated positions.

As shown in FIG. 15A, the adaptor assembly 400 is configured so that second contact surfaces 428*a*; 428*b* abut against the pump 300*b* of the second type in the central portion thereof, so as to provide a proper actuation of dispensing.

The adaptor assembly 400 may also be modified to adjust the position it has in relation to the pump 300*b* as well as to the shape of the pump 300*b* and the maximum volume desired to be dispensed from the fluid container 200 as described in relation to FIG. 12B.

As also shown in FIG. 15A, the fluid container 200 and a bottom surface 255 of the fluid reservoir 250 may at least partly rest on a seat in the dispenser 100 that is formed by an upper surface 121 of the protruding portion 128 of the dispensing unit 125

FIG. 15B shows the dispensing system 1, when a user's hand has been identified by the sensor 123, wherein the motor has been activated and the lifter 124 that is operably connected to the motor has moved upwards and exerted an upwardly-directed force (P) on the moving part 430 that has caused the moving part 430 to be displaced from its lower position to an upper position. The displacement of the moving part 430 has displaced the actuation heads 426*a*; 426*b* in lateral directions from their non-actuated positions towards actuated positions and towards the pump 300*b*, wherein the pump 300*b* is laterally compressed between the two second contact surfaces 428*a*; 428*b* of the actuation heads 426*a*; 426*b*, wherein an actuation force TF is transferred from the moving part 430 via the actuation parts 420*a*; 420*b* and the second contact surfaces 428*a*; 428 to the pump 300*b*. This has caused fluid to be dispensed downwardly in a direction Y2 from the fluid container 200 and the nozzle 365 thereof. In FIG. 15A, the first contact surface portions 427*a*4; 427*b*1-427*b*4 abut against the dolly surfaces 436*a*; 436*b*, when the actuation heads are in their full actuated positions. A horizontal plane H2 through the first and second actuation heads 426*a*; 426*b* that are in their fully actuated positions will then intersect portions of the first and second dolly surfaces 436*a*; 436*b* that are in contact he first contact surface portions 427*a*4; 427*b*1-427*b*4 of the actuation heads. This secures a good force transfer from the lifter 124 to the pump 300*b* for dispensing a dose of a fluid.

Once the lifter 124 is in its uppermost position, the lifter 124 and moving part 430 moves downwards to the positions they had before the user's hand was identified to actuate the dispensing of fluid. The actuation heads 426*a*; 426*b* are then returned to their non-actuated positions, when refilling of the pumping chamber occurs by the provision of a filling force being provided by, inter alia, the inherent resilience of the wall of the pumping chamber 300*b* (not shown).

Figure 16B:
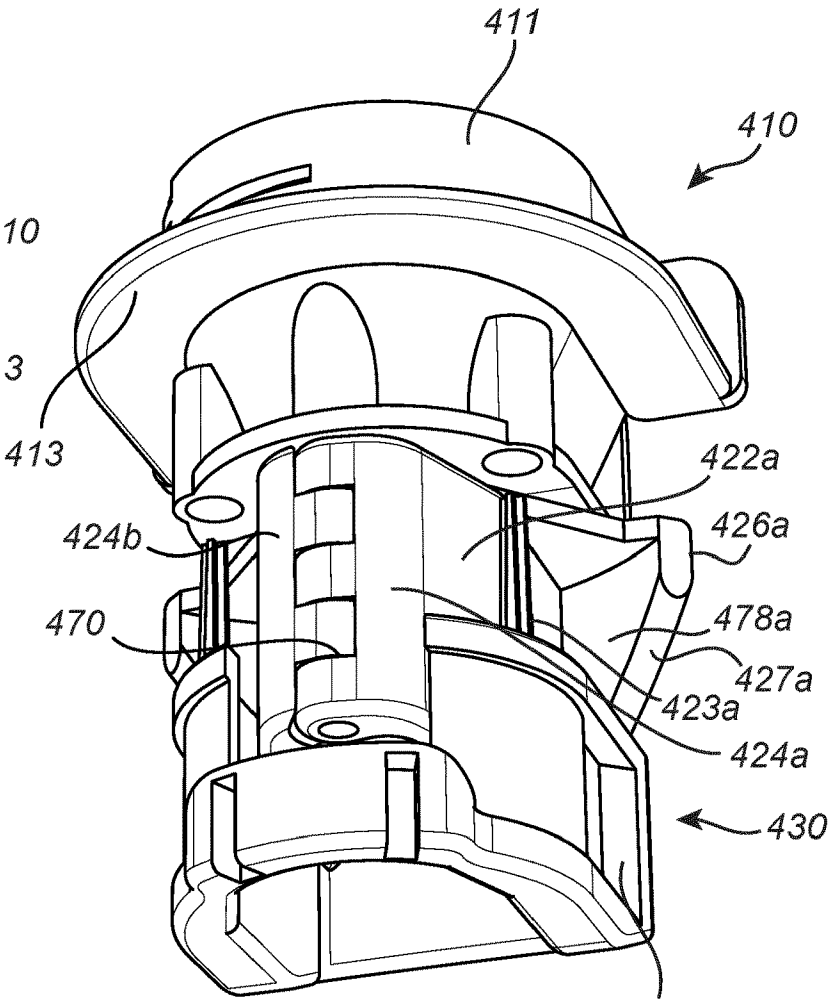
FIGS. 16A and 16B are perspective views of an embodiment of an adaptor assembly.
Figure 16A:
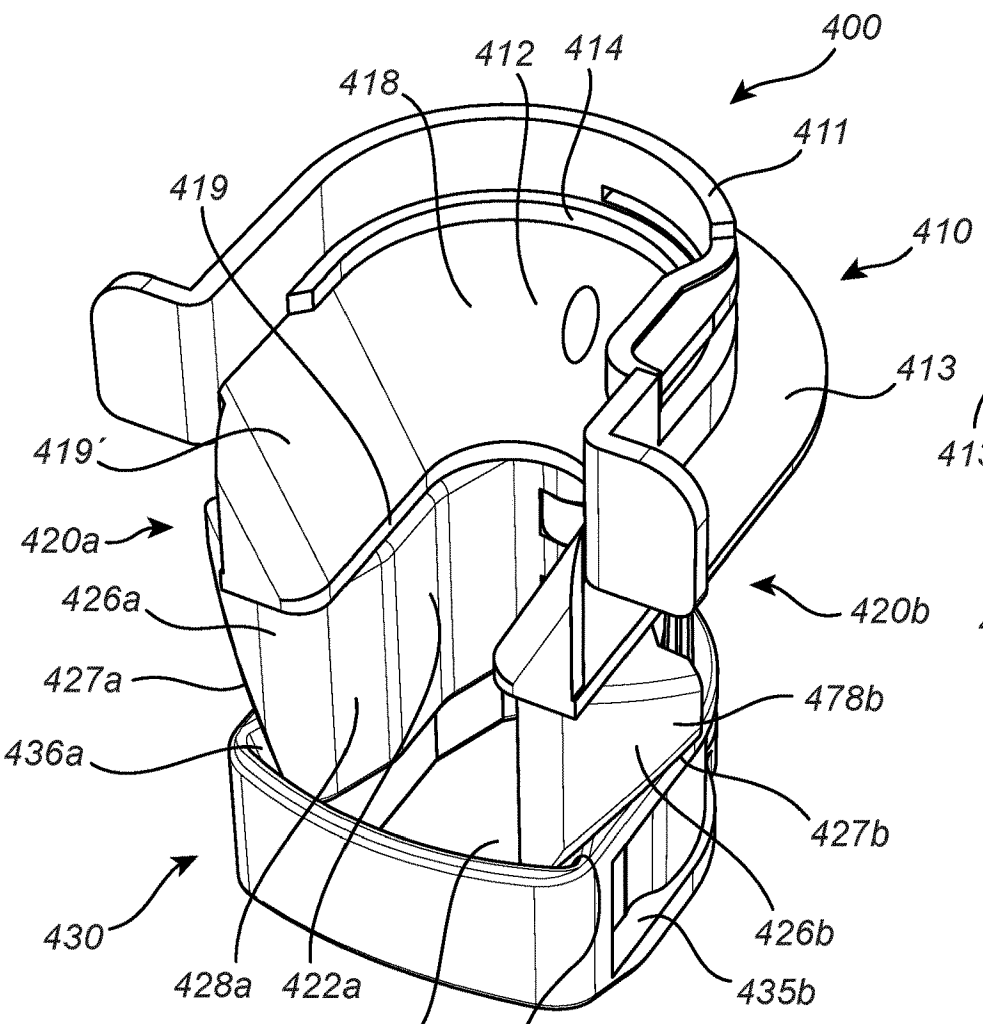

FIGS. 16A and 16B are perspective views of an embodiment of an adaptor assembly 400 to be used with a fluid container 200 with a pump 300*b* of the second type, in particular the fluid container 200 with the elastic and elongated tube chamber 300*b* as shown in FIG. 5.

The adaptor assembly 400 has similarities to the embodiments shown in FIGS. 6A-6B, 13A-13B and 15A-15C. The adaptor assembly 400 comprises a fluid container support 410, two actuation parts 420*a*; 420*b* and a moving part 430. FIGS. 16A and 16B show in different views of the adaptor assembly 400 with its part assembled.

In the FIGS. 16A to 17B, like numbers refer to like elements shown for the embodiments of FIGS. 6A, 6*b*, 13A, 13B, and 15A to 15*c* as described hereinabove and reference is made to details described in relation to these embodiments.

The fluid container support 410 of the adaptor assembly 400 as shown in FIG. 14A is similar to the one described in the embodiments hereinabove. It includes the cap receiving portion 411 being a U-shaped element forming a cavity 412 that extends in a vertical direction and providing a central through-opening 412 for receiving and engaging the connector cap 360 and the of the fluid container 200 of FIG. 5.

At the rear lower portion of the cap receiving portion 411 there is provided a pump supporting element 418 in the form of a U-shaped element that extend downwards and inwards to a U-shaped portion 419 that in is formed to receive the elongated and elastic tube chamber 300*b* shown in FIG. 5. This support element 418 may support a proper insertion of the fluid container into the dispenser 100 as well as a proper support of the pump 300*b*, when the fluid container 200 is mounted in the dispenser 100. The inclined upper surface 419' of the pump supporting element 418 may provide a seat for the connector cap 360 to rest on, see FIG. 17A.

The skilled person appreciates that the fluid container support 410 may adopt other shapes than the U-shaped one, including but not limited to a polygonal shape that still may form the support for fluid container 200 and the connector cap 360 or the like and form an engagement with the U-shaped cavity portion 134 forming the locating flange engagement portion 134 of the dispensing unit 125.

The adaptor assembly 400 further comprises the two actuation parts 420*a*; 420*b* as shown in FIGS. 15A and 15B. In this embodiment, each actuation part 420*a*; 420*b* includes an elongated arm 422*a*; 422*b* that extends in a longitudinal direction thereof between two opposite ends 423*a*; 423*b*; 424*a*; 424*b* of the arm.

Each first end 424*a*; 424*b* is connected to a hinge connection 470 connected to the fluid container support 410 at the rear of the adaptor assembly 400. The arms 422*a*; 422*b* extend from their first ends 424*a*; 424*b* in a substantially frontward direction to their second ends 423*a*; 423*b* that carry actuation heads 426*a*; 426*b* with first contact surfaces 427*a*; 427*b* for abutting against the dolly surfaces 436*a*; 436*b* and with second contact surfaces 428*a*; 428*b* for abutting against the pump 300*b* of the second type. Each shown second contact surface 428*a*; 428*b* is slightly curved from the rear to the front of the second contact surface 428*a*; 428*b* forming a surface being convex in its shape to allow for a proper and smooth compression of the pump 300*b* in this embodiment. The second contact surfaces 428*a*; 428*b* face each other to allow the surfaces to abut against the pump 300*b* of the second type on opposite sides thereof, see FIG. 17A.

The skilled person appreciates that each second contact surface 428*a*; 428*b* may adopt other shapes and dimensions, including but not limited to being flat or concave to match the pump shape, for example.

As shown in FIGS. 16A and 16B, the actuation heads 426*a*; 426*b* has vertical portions 478*a*; 478*b* extending outwards and slightly rearwards. Lower edges portions of the vertical portions 478*a*; 478*b* extend from outer ends of vertical portions 478*a*; 478*b* with oblique angles downwards and inwards in directions towards each other, wherein the lower edge portions form the first contact surfaces 427*a*; 427*b*.

The actuation heads 426*a*; 426*b* are both movable between their non-actuated positions and fully actuated positions to allow a pump 300*b* of the first type to be compressed between the two actuation heads 426*a*; 426*b*.

Figure 17A:
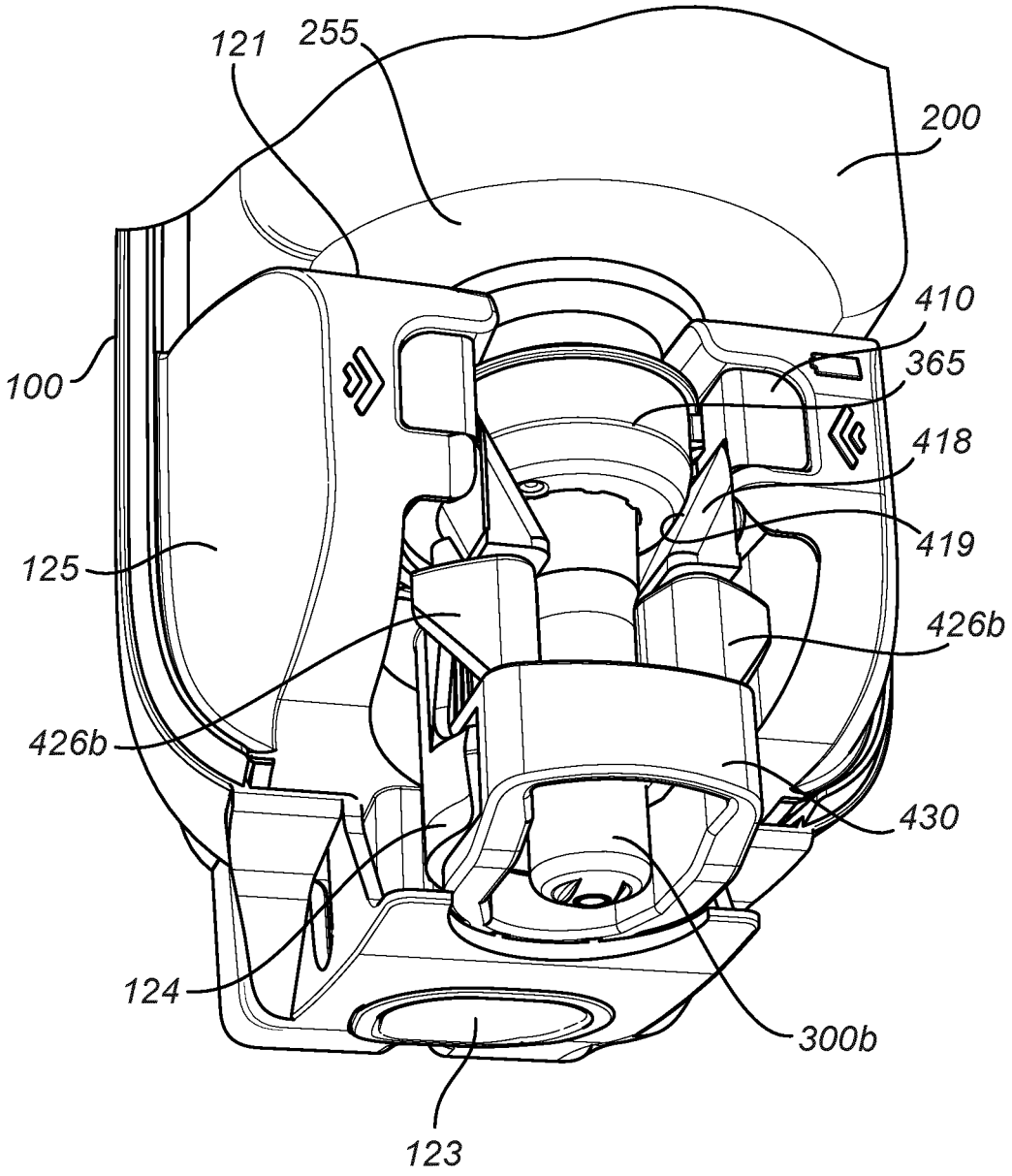
FIGS. 17A and 17B show perspective views of a lower end portion of the fluid dispensing system formed from the dispenser of FIG. 1, a disposable container of FIG. 5 and the adaptor assembly of FIGS. 16A and 16B with the front cover removed and viewed from the front to show details of the interior of the fluid dispensing system in operation.
Figure 17B:
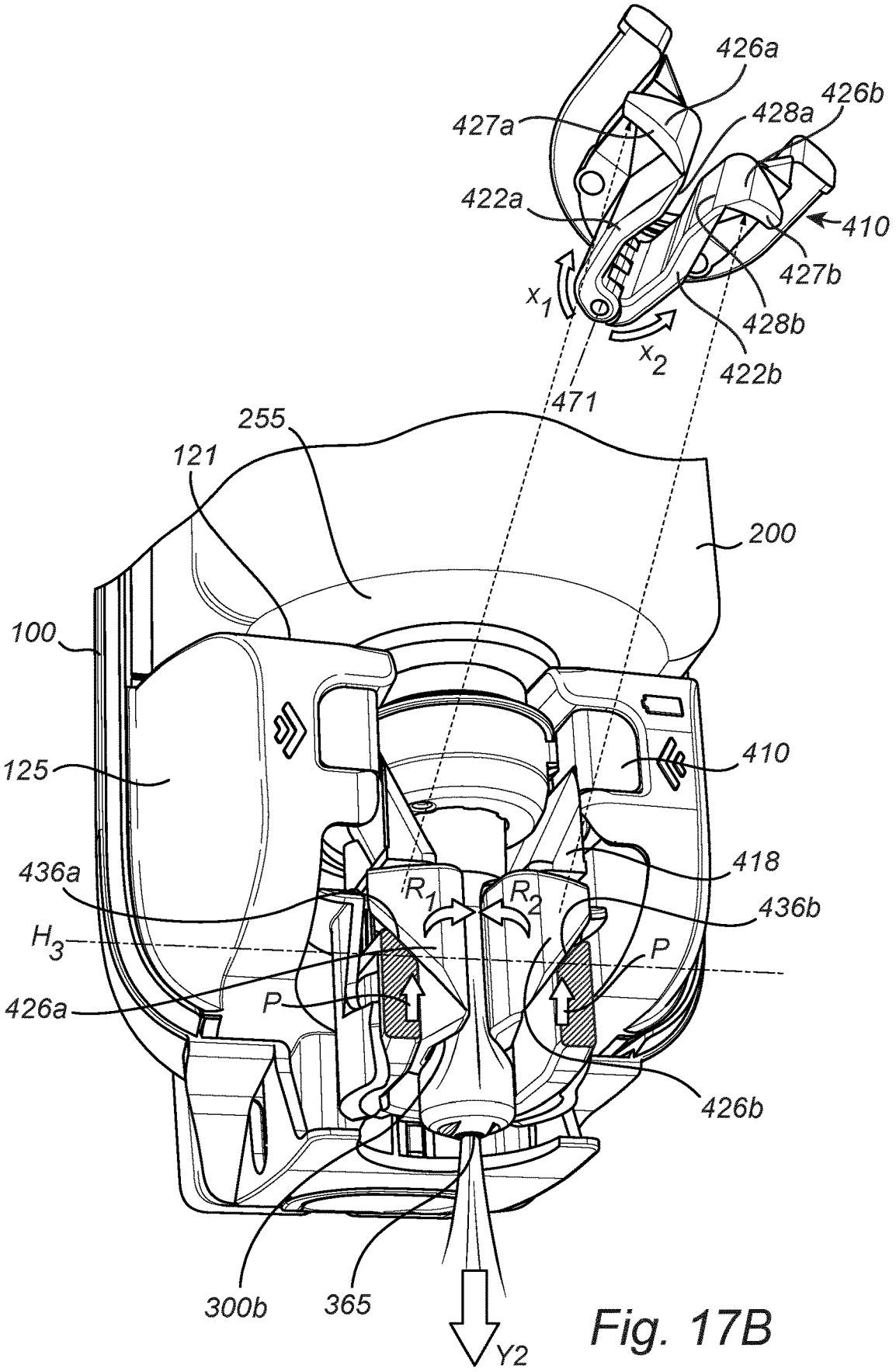

In the shown embodiment, the arms 422*a*; 422*b* are movably connected to a rear portion of the adaptor assembly 400, wherein the arms 422*a*; 422*b* are connected to a hinge 470 with a pivot 471 about which the arm can be moved along rotational directions X1; X2 see FIG. 17B and the exploded view of the adaptor assembly 400 as such. The skilled person appreciates that the arms 422*a*; 422*b* are made stiff. This arrangement allows the actuation heads 426*a*; 426*b* to be moved between the non-actuated positions to the fully actuated positions. The movements of the actuation heads 426*a*; 426*b* are shown in FIGS. 17A and 17B.

The skilled person also appreciates that other types of movable connections may be used for providing the movements of the actuation heads 426*a*; 426*b*. For example, the skilled person appreciates that it can be realized by movably connect the first ends 424*a*; 424*b* of the arms 422*a*; 422*b* to the adaptor assembly 400 by a living hinge or the like, and/or by making at least a portion of the arm flexible or elastic as has been described hereinabove.

The adaptor assembly 400 further comprises the lower part 430 forming the moving part 430 of the present disclosure that is configured to engage the pump engagement portion 122 of lifter 124 and to partly enclose the pump 300*b* of the second type.

As set forth in FIGS. 16A and 16B, the moving part 430 forms a sleeve 430 with an axially extending through-opening 432, as described hereinabove.

The shapes and dimensions of the moving part 430 are configured to be partly enclosed and engaged by the lifter 124 of the dispenser 100. The skilled person appreciates that the moving part 430 may adopt any suitable shape and dimensions for engaging the lifter 124 as described hereinabove.

The moving part 430 is movably connected to the fluid container support 410. In the central through-opening 432 of the moving part 430 on opposite side portions thereof between the front portion and the rear wall are the dolly portions 462*a*; 462*b* presenting dolly surfaces 436*a*; 436*b* facing substantially each other and the through-opening 432. The dolly surfaces 436*a*; 436*b* extend with oblique angles downwards and inwards in directions towards each other to form a tapering cavity portion therebetween, see FIG. 17B. They form sliding contacts between the dolly surfaces 436*a*; 436*b* and the first contact surfaces 427*a*; 427*b*. In this arrangement, the dolly surfaces 436*a*; 436*b* will be in contact with the first contact surfaces 427*a*; 427*b* of the actuation heads 426*a*; 426*b*. Both dolly surfaces 436*a*; 436*b* provide sliding surfaces for the actuation heads 426*a*; 426*b* to slide along, when the moving part 430 is moved upwards to move the sliding surfaces 436*a*; 436*b* upwards causing the actuation heads 426*a*; 426*b* move inwards to be displaced towards each other from their non-actuated positions to their actuated positions, see FIG. 17B.

According to the disclosure, suitable materials for forming the adaptor assembly 400 may be aluminum or any suitable plastics such as polyoxymethylene (POM), polyamide 12 (PA 12) and olefin plastics, e.g. polyethylene or polypropylene. The adaptor assembly 400 may be formed by injection molding, 3D printing or any other suitable method known to the skilled person. The mentioned materials and forming of the assembly can be used for all parts of the adaptor assembly and a combination of the materials may also be considered for adaptor assembly or parts thereof.

The assembly of a fluid dispensing system 1 comprising the adaptor assembly 400 of FIGS. 16A and 16B resembles the assembly of the fluid dispensing system 1 as shown in FIGS. 11A and 11B.

FIGS. 17A and 17B show perspective views of a lower end portion of the fluid dispensing system 1 formed from the dispenser 100 of FIG. 1, a disposable container of FIG. 5 and the adaptor assembly 400 of FIGS. 16A and 16B with the front cover removed to show details of the interior of the fluid dispensing system 1 in operation. The operation of fluid dispensing system 1 with the adaptor assembly 400 of FIGS. 17A and 17B is similar to the operations as described herein in relation to other embodiments.

In FIG. 17A, the fluid pump 300*b* of the second type being an elongated and elastic tube chamber 300*b* extends downwards from the connector cap 360 of the fluid container 200 and between actuation parts 420*a*; 420*b* and the second contact surfaces 428*a*; 428*b* of the actuation heads 426*a*; 426*b* located in the through-opening 432 of the moving part 430 to the nozzle 365 at the bottom of the dispenser 100. In this view, the lifter 124 and the moving part 430 are in their lowermost positions, i.e. their rest positions. In these positions, the actuation parts 420*a*; 420*b* and their actuation heads 426*a*; 426*b* are kept in their non-actuated positions between the moving part 430 and the elongated and elastic tube chamber 300*b* forming the pump 300*b* of the second type. The actuation heads 426*a*; 426*b* are both in their non-actuated positions and are partly connected to the dolly portions 462*a*; 462*b* with upper portions of the dolly surfaces 436*a*; 436*b* being in contact with lower portions of the first contact surfaces 427*a*; 427*b*.

As shown in FIG. 17A, the second contact surfaces 428*a*; 428*b* are facing each other and are in their non-actuated positions laterally distanced from each other with portions thereof abutting against the elongated and elastic tube chamber 300*b* placed therebetween, so that a pump 300*b* of the second type placed therebetween in the dispenser 100 and in the non-actuated position should be in a non-compressed and non-distorted form and still providing a sufficient dispensing when actuated, as described in relation to the embodiment of FIGS. 6A and 6B. Thus, the minimum lateral dimension between the two second contact surfaces 428*a*; 428*b* in the non-actuated position is slightly larger or substantially matches the outer diameter of the elongated tube of the pump 300*b*. Optionally, the shapes and dimensions may be adjusted to allow the actuation heads 426*a*; 426*b* to rest on the pump 300*b* in prestressed manners in the non-actuated positions to allow an immediate and proper dispensing when the actuation head 426*a*; 426*b* are moved to activated positions.

As shown in FIG. 17A, the adaptor assembly 400 is configured so that second contact surfaces 428*a*; 428*b* abut against the pump 300*b* of the second type in the central portion thereof, so as to provide a proper actuation of dispensing.

The adaptor assembly 400 may also be modified to adjust the position it has in relation to the pump 300*b* as well as to the shape of the pump 300*b* and the maximum volume desired to be dispensed from the fluid container 200 as described in relation to FIG. 12B.

As also shown in FIG. 17A, the fluid container 200 and a bottom surface 255 of the fluid reservoir 250 may at least partly rest on a seat in the dispenser 100 that is formed by an upper surface 121 of the protruding portion 128 of the dispensing unit 125.

FIG. 17B shows the dispensing system 1, when a user's hand has been identified by the sensor 123, wherein the motor has been activated and the lifter 124 that is operably connected to the motor has moved upwards and exerted an upwardly-directed force (P) on the moving part 430 that has caused the moving part 430 to be displaced from its lower position to an upper position. The displacement of the moving part 430 has displaced the actuation heads 426*a*; 426*b* in lateral directions from their non-actuated positions towards actuated positions and towards the pump 300*b*, wherein the actuation parts 420*a*; 420*b* has been rotated about its pivot 471 in rotational directions X1; X2 and the actuation heads 426*a*; 426B has moved in rotational directions R1; R2 towards each other, wherein the pump 300*b* is laterally compressed between the two second contact surfaces 428*a*; 428*b* of the actuation heads 426*a*; 426*b*, see FIG. 17B including the exploded view of the adaptor assembly 400 as view from the below. Thus, an actuation force is transferred from the moving part 430 via the actuation parts 420*a*; 420*b* and the second contact surfaces 428*a*; 428 to the pump 300*b*. This has caused fluid to be dispensed downwardly in a direction Y2 from the fluid container 200 and the nozzle 365 thereof. In FIG. 17B, the first contact surfaces 427*a*; 427*b* abut against the dolly surfaces 436*a*; 436*b*, when the actuation heads 426*a*; 426*b* are in their full actuated positions. A horizontal plane H3 through the first and second actuation heads 426*a*; 426*b* that are in their fully actuated positions will then intersect portions of the first and second dolly surfaces 436*a*; 436*b* that are in contact he first contact surfaces 427*a*; 427*b* of the actuation heads 426*a*; 426*b*. This secures a good force transfer from the lifter 124 to the pump 300*b* for dispensing a dose of a fluid.

Once the lifter 124 is in its uppermost position, the lifter 124 and moving part 430 moves downwards to the positions they had before the user's hand was identified to actuate the dispensing of fluid. The actuation heads 426*a*; 426*b* are then returned to their non-actuated positions, when refilling of the pumping chamber occurs by the provision of a filling force being provided, inter alia, by, inter alia, the inherent resilience of the wall of the pumping chamber 300*b* (not shown).

As the skilled person will appreciate, it is intended that the detailed description be regarded as illustrative and that many embodiments and alternatives are possible within the scope of the present disclosure as defined by the appended claims. For example, the adaptor assembly 400 may adopt other shapes than the ones shown in the drawings, e.g. the adaptor assembly 400 may easily be modified to be used a manually actuated dispenser, e.g. as the one described in WO2011/133085. Furthermore, the skilled person also appreciates that the moving part 430 and the fluid container support 410 could adopt a circular sleeve form to provide an adaptor assembly 400 having similar outer shapes and dimensions as pump 300*a* of the first type of FIG. 3, for example.

Furthermore, any actuation part 420 may comprise an actuation part 420*a*; 420*b* with an actuation head 426*a*; 426*b* in the form of a cam wheel having a contact surface portion forming the first contact surface and another contact surface portion forming the second contact surface 428*a*; 428*b* carrying the protruding part of the cam wheel. The dolly surface (-s) 436*a*; 436*b* of the moving part 430 may in this case be a vertical inner surface that is in contact with the cam wheel, wherein a displacement of the moving part 430 upwards causes the dolly surface 436*a*; 436*b* to rotate the cam wheel so that the protruding part of the cam wheel compresses the pump 300*b* of the second type. The skilled person appreciates that the adaptor assembly 400 of this embodiment may comprise one or more additional cam wheels.

The second contact surface (-s) of the actuation head (-s) according to the disclosure may be made of soft and flexible material for a soft fluid dispensing operation.

The actuation part as described herein may also be used together with a fixed dolly forming part of the adaptor assembly 400. In this configuration, the pump of the second type can be positioned between the second contact surface of the actuation part and the fixed dolly, the latter replacing the need of two actuation parts 420*a*; 420*b*. When a force is applied to the actuation part to move the actuation head towards the pump, the pump is compressed between the second contact surface of the actuation head and the dolly surface 436*a*; 436*b* causing fluid to be dispensed from the pump.

Furthermore, it may be provided a dispenser 100 with the dispensing mechanism that allows the connecting support to be non-integrated or integrated part of the dispenser 100 and at the same time providing all the advantages with the use of the first connecting support, the actuation parts 420*a*; 420*b* described herein. Such dispensing mechanism may be fixedly attached via a connecting support being similar to the first fluid container support 410 and/or a lifter adopting the shape of the moving part 430.

The invention claimed is:

1. An adaptor assembly for use in a dispenser for a replaceable fluid container comprising a fluid reservoir and a fluid pump, wherein the dispenser comprises a housing and a compartment therein for containing the fluid container, the dispenser having a front portion, a rear portion, and upper and lower end portions, the lower end portion forming a dispensing end portion of the dispenser and comprising an actuator, which is displaced directly by a user or displaced via a motor for operating the dispenser to dispense a dose of a fluid from the fluid container through a nozzle at the lower end portion, wherein the compartment of the dispenser is sized to receive a fluid container having a pump of a first type being an axially compressible pump and the actuator has a lifter for actuating the pump of the first type by axially compressing it in a vertical direction, wherein the adapter assembly is used in conjunction with the dispenser to allow a use of a fluid container having a pump of a second type within the dispenser, the second type being actuated by laterally compressing it, and wherein the adaptor assembly is configured for removably connect it to the dispenser and the fluid container having the pump of the second type, the adaptor assembly comprising:

a fluid container support configured to be received in the compartment of the dispenser for holding and/or supporting the fluid container in a desired position in the compartment of the dispenser, first actuation part including a first actuation head being movable between a non-actuated position and a fully actuated position, wherein the first actuation head comprises a first contact surface for abutting against a first dolly surface and a second contact surface for abutting against the pump of the second type, second actuation part including a second actuation head being movable between a non-actuated position and a fully actuated position, wherein the second actuation head comprises a first contact surface for abutting against a second dolly surface and a second contact surface for abutting against the pump of the second type, wherein at least portions of the first contact surfaces of the first and second actuation heads abut against the first and second dolly surfaces in the non-actuated and the fully actuated positions, and a moving part being displaceable between a lower position and an upper position, wherein a displacement of the moving part from the lower position to the upper position moves the first and second actuation heads from their non-actuated position towards the fully actuated positions, wherein the lifter engages and acts on the moving part, when the adaptor assembly is mounted in the dispenser, wherein a lifting force (P) applied by the lifter on the moving part displaces the moving part between from its lower position to and an upper position, thereby transferring an actuation force (TF) from the moving part via the actuation heads to the pump of the fluid container, when mounted in the compartment, wherein the pump of the second type is laterally compressed to cause fluid to be dispensed from the fluid container, and wherein a horizontal plane (H1-H3) through the first and second actuation heads in their fully actuated positions intersects portions of the first and second dolly surfaces that are in contact with portions of the first contact surfaces of the actuation heads.

2. The adaptor assembly according to claim 1, wherein the moving part is configured to at least partly be enclosed by a pump engagement portion of the lifter.

3. The adaptor assembly according to claim 2, wherein the moving part is configured to at least partly engage the engagement portion of the lifter in a form-fit manner.

4. The adaptor assembly according to claim 1, wherein a fluid container support forms an upper part of the actuator assembly and the moving part forms a lower part of the adaptor assembly, and the moving part being movably connected to the fluid container support.

5. The adaptor assembly according to claim 4, wherein the first and second actuation parts connect the fluid container support to the moving part.

6. The adaptor assembly according to claim 1, wherein the first and second dolly surfaces form elongated sliding surfaces, against which the first contact surfaces of the actuation parts abut and along which the first contact surfaces slide or move, when the moving part is displaced from its lower position to its upper position.

7. The adaptor assembly according to claim 1, wherein the fluid container support has a vertically extending through-opening for receiving a portion of the fluid container, wherein the through-opening extends to the front and present a front opening of the fluid container support to the surroundings.

8. The adaptor assembly according to claim 1, wherein the moving part has a through-opening extending from the upper part to the lower part of the moving part.

9. The adaptor assembly according to claim 8, wherein the through-opening of the moving part is configured to at least partly receive the pump of the second type.

10. The adaptor assembly according to claim 9, wherein the moving part has an access opening at an upper front portion thereof to access the through-opening of the moving part from the front portion, wherein the access opening forms a continuous opening with the through-opening at the upper portion of the moving part.

11. The adaptor assembly according to claim 10, wherein an access cavity is formed at an inner portion of the moving part that is located below the access opening and faces the through-opening of the moving part.

12. The adaptor assembly according to claim 1, wherein the first and second dolly surfaces form part of the moving part.

13. The adaptor assembly according to claim 7, wherein the first and second dolly surfaces form part of the moving part and the dolly surfaces are arranged on opposite sides of the through-opening of the moving part and face each other.

14. The adaptor assembly according to claim 13, wherein the dolly surfaces extend with oblique angles downwards and inwards in directions ($C_1$; $C_2$) towards each other to form a tapering cavity portion therebetween.

15. The adaptor assembly according to claim 1, wherein each one of the first and second actuation parts comprises an elongated arm extending in a substantially longitudinal direction ($L_1$; $L_2$) thereof between two opposite ends of the arm, of which the first end is connected to the fluid container support, and the second end carries one of the two actuation heads, wherein said actuation head is movable between the non-actuated position and the fully actuated position.

16. The adaptor assembly according to claim 1, wherein the actuation parts are movably connected to the fluid container support, e.g. wherein each actuation part is pivotally attached to the fluid container support and configured to pivot about a pivot.

17. The adaptor assembly according to claim 15, wherein elongated arms are flexible arms for allowing said movements of the actuation head between the non-actuated positions and the fully actuated positions.

18. The adaptor assembly according to claim 15, wherein the actuation heads are movably connected to the respective arms of the actuation parts.

19. The adaptor assembly according to claim 1, wherein the actuation parts contain or are made of polyoxymethylene (POM).

20. The adaptor assembly according to claim 1, wherein the fluid container support contains or is made of polyoxymethylene (POM).

21. The adaptor assembly according to claim 1, wherein the moving part contains or is made of olefin plastics such as polyethylene and/or polypropylene.

22. The adaptor assembly according to claim 1, wherein the pump of the second type has a resilient pumping chamber.

23. The adaptor assembly according to claim 22, wherein the resilient pumping chamber is an elongated and elastic tube chamber extending downwards at the lower portion of the fluid container in a direction from the bottom of the fluid reservoir to a nozzle of the elastic tube chamber.

24. The adaptor assembly according to claim 1, further being configured so that at least a portion of each second contact surface abuts against the pump in the non-actuated position.

25. The adaptor assembly according to claim 1, wherein a portion of each second contact surface extends with angle to the vertical direction in the non-actuated position, e.g. wherein the second contact surface is convex.

26. The adaptor assembly according to claim 1, further comprising one or more positioning means for engaging corresponding one or more connecting portions in the dispenser and preventing axial and/or rotational movement of the adaptor assembly in the dispenser, and/or for preventing wrong positioning of the adapter assembly in the dispenser.

27. The adaptor assembly according to claim 1, wherein energy consumption for a dispensing cycle of dispensing a fluid, by displacing the moving part from the lowermost position to its uppermost position and returning the moving part the lowermost position, is lower than 1100 μWh, e.g. 300 to 1000 μWh or 500 to 1000 μWh, when the adaptor assembly and the fluid container having the pump of the second type are mounted in the dispenser.

* * * * *